US006414662B1

(12) United States Patent
Havel

(10) Patent No.: US 6,414,662 B1
(45) Date of Patent: Jul. 2, 2002

(54) VARIABLE COLOR COMPLEMENTARY DISPLAY DEVICE USING ANTI-PARALLEL LIGHT EMITTING DIODES

(75) Inventor: Karel Havel, Bramalea (CA)

(73) Assignee: Texas Digital Systems, Inc.

( * ) Notice: Subject to any disclaimer, the term of this patent is extended or adjusted under 35 U.S.C. 154(b) by 0 days.

(21) Appl. No.: 09/416,831

(22) Filed: Oct. 12, 1999

(51) Int. Cl.[7] ..... G09G 3/32; G09G 3/04
(52) U.S. Cl. ..... 345/83; 345/34
(58) Field of Search ..... 345/33, 34, 39, 345/46, 83, 204, 589, 690

(56) References Cited

U.S. PATENT DOCUMENTS

| | | | |
|---|---|---|---|
| 2,643,344 | A | 6/1953 | McLaren et al. |
| 2,648,015 | A | 8/1953 | Greenfield et al. |

(List continued on next page.)

FOREIGN PATENT DOCUMENTS

| | | | |
|---|---|---|---|
| DE | 3037500 | | 4/1981 |
| DE | 3009416 | | 9/1981 |
| DE | 220844 | A1 | 4/1985 |
| GB | 2158631 | A | 11/1985 |
| JP | 57146112 | | 9/1982 |

OTHER PUBLICATIONS

Landauer, R. W., "Electroluminescent Display", IBM Technical Disclosure Bulletin, vol. 8 No. 11, pp. 15–16, Apr. 11, 1966.

Wagner, Bill, "2–color LED+driver=versatile visual effects", EDN vol. 25, No. 19, Oct. 20, 1980.

Smithline, Leonard M., "Dual light–emitting diode synthesizes polychromatic light", Electronics, Aug. 16, 1979, pp. 31–32.

Svestka, M. et al. "LEDs change colour to indicate balance voltage", Electronic Engineering, vol. 48, No. 576, p. 19, Feb. 1975.

Saitoh, Tadashi et al., "Multicolor LIght–Emitting Diodes with Double Junction Structure", IEEE Transactions on Electron Devices, vol. ED–28, No. 5, p. 29–32, Feb. 1975.

Yamaguchi, Takao et al., "A High Brightness GaP Multicolor LED", IEEE Transactions on Electron Devices, vol. ED–28, No. 5, May 1981, p. 588–592.

Burke, Marvin, "Chip changes the colors of light–emitting diodes", Electronics, Apr. 7, 1981, p. 158–159.

Rao, V., "Two LEDs blend and blink to indicate six states", Electronic Design, vol. 30, No. 16, p. 220, Aug. 5, 1982.

Kajima, Takehira, "Recent flat panel development in Japan", held in San Diego, CA, Apr. 29–May 1, 1980, SID 80 Digest, p. 22–23.

(List continued on next page.)

*Primary Examiner*—Steven Saras
*Assistant Examiner*—Paul Bell
(74) *Attorney, Agent, or Firm*—James J. Murphy; Winstead Sechrest & Minick

(57) ABSTRACT

A variable color complementary display device includes a plurality of display areas arranged in a pattern for selectively exhibiting a plurality of display units. Each display area includes a plurality of pairs of light emitting diodes for emitting, when forwardly biased, light signals of respective primary colors and a device for combining the light signals in the display area to obtain a light signal of a composite color. Each pair includes a first light emitting diode and a second light emitting diode, both of the same color, connected in an anti-parallel fashion such that their polarities are opposite. A device is provided for selectively forwardly biasing the first light emitting diodes, for illuminating certain of the display areas in a display color. The second light emitting diodes in the remaining display areas are automatically illuminated in a complementary color.

12 Claims, 27 Drawing Sheets

U.S. PATENT DOCUMENTS

| | | | | | |
|---|---|---|---|---|---|
| 2,682,000 | A | | 6/1954 | Clayton et al. | |
| 2,878,450 | A | | 3/1959 | Rabier | |
| 2,889,518 | A | | 6/1959 | Hudson et al. | |
| 3,590,156 | A | | 6/1971 | Easton | |
| 3,595,991 | A | | 7/1971 | Diller | |
| 3,696,393 | A | * | 10/1972 | McDonald | 345/82 |
| 3,719,849 | A | | 3/1973 | Steward | |
| 3,740,570 | A | | 6/1973 | Kaelin et al. | |
| 3,760,174 | A | | 9/1973 | Boenning et al. | |
| 3,771,015 | A | | 11/1973 | Miller | |
| 3,771,155 | A | | 11/1973 | Hayashi et al. | |
| 3,840,873 | A | | 10/1974 | Usui | |
| 3,873,979 | A | | 3/1975 | Craford et al. | |
| 3,875,456 | A | | 4/1975 | Kano et al. | |
| 3,911,418 | A | | 10/1975 | Takeda | |
| 3,911,430 | A | | 10/1975 | Jankowski et al. | |
| 3,924,227 | A | | 12/1975 | Stolov | |
| 3,947,840 | A | | 3/1976 | Craford et al. | |
| 3,975,726 | A | | 8/1976 | Kawakami | |
| 3,987,401 | A | * | 10/1976 | Irving | 345/39 |
| 4,086,514 | A | | 4/1978 | Havel | |
| 4,201,039 | A | | 5/1980 | Marion | |
| 4,204,424 | A | | 5/1980 | Walker | |
| 4,271,408 | A | | 6/1981 | Teshima et al. | |
| 4,301,450 | A | | 11/1981 | Smoliar | |
| 4,360,804 | A | | 11/1982 | Ohura | |
| 4,367,471 | A | | 1/1983 | Gillessen | |
| 4,445,132 | A | | 4/1984 | Ichikawa et al. | |
| 4,488,149 | A | | 12/1984 | Givens, Jr. | |
| 4,491,974 | A | | 1/1985 | Bouchant | |
| 4,525,729 | A | | 6/1985 | Agulnek et al. | |
| 4,559,480 | A | | 12/1985 | Nobs | |
| 4,581,612 | A | | 4/1986 | Jones | |
| 4,644,342 | A | | 2/1987 | Abbas | |
| 4,647,217 | A | | 3/1987 | Havel | |
| 4,689,613 | A | | 8/1987 | Ikeda | |
| 4,709,230 | A | | 11/1987 | Popowski et al. | |
| 4,712,099 | A | | 12/1987 | Maeda | |
| 4,713,579 | A | | 12/1987 | Miura | |
| 4,720,709 | A | | 1/1988 | Imamura et al. | |
| 4,723,119 | A | | 2/1988 | Morimoto | |
| 4,725,828 | A | | 2/1988 | Cowlishaw | |
| 4,740,818 | A | | 4/1988 | Tsilibes et al. | |
| 4,755,807 | A | * | 7/1988 | Guennou | 345/83 |
| 4,771,274 | A | | 9/1988 | Havel | |
| 4,788,535 | A | | 11/1988 | Chikara et al. | |
| 4,831,326 | A | | 5/1989 | Havel | |
| 4,837,565 | A | | 6/1989 | White | |
| 4,845,481 | A | | 7/1989 | Havel | |
| 5,003,298 | A | | 3/1991 | Havel | |
| 5,184,114 | A | | 2/1993 | Brown | 340/701 |
| 5,278,542 | A | * | 1/1994 | Smith et al. | 345/83 |
| 5,561,365 | A | | 10/1996 | Havel | |
| 5,666,129 | A | * | 9/1997 | Wurster et al. | 345/83 |
| 5,936,599 | A | * | 8/1999 | Reymond | 345/46 |
| 5,982,345 | A | * | 11/1999 | Takayama et al. | 345/82 |
| 6,121,767 | A | | 9/2000 | Havel | |
| 6,018,237 | A | | 10/2000 | Havel | |
| 6,133,722 | A | | 10/2000 | Havel | |
| 6,147,483 | A | | 11/2000 | Havel | |
| 6,239,776 | B1 | | 5/2001 | Havel | |

OTHER PUBLICATIONS

Niina, T. et al., "A multi–color GaP LED flat panel display device" New York, NY, USA, Apr. 28–30, 1981. 1981 SID International Symposium Digeswt of Papers, vol. XII (1981), p. 140–141.

Niina, T. et al, "A multi–color LED flat panel display device for colorful displays of letters and figures", Proceedings of the SID, vol. 23, No. 2, p. 73–76 1982.

O'Mara, P. A. et al., "Microprocessor–controlled light–emitting diode dark adaptometer", Medical & Biological Engineering and Computing, vol. 20, No. 1, p. 70–76, 1982.

SenSym Solid State Barometers Catalog, p. 9–30, 1983.

Palphsnyder, William G., "2–color LED+bits=8 visual effects", EDN, vol. 26, No. 14, pp. 382–383, Jul. 22, 1981.

* cited by examiner

PRIOR ART

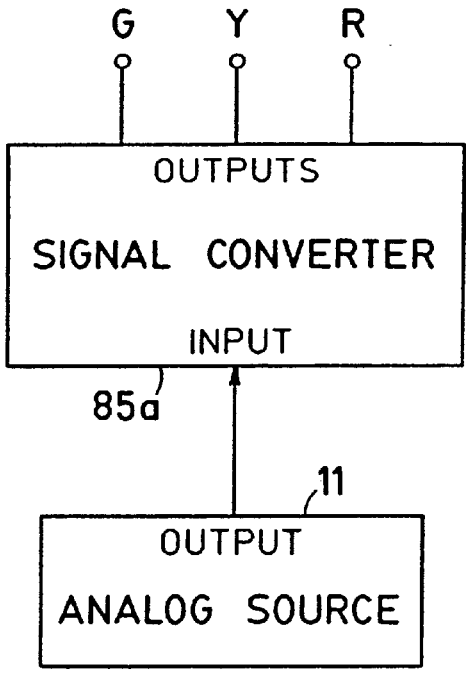
FIG. 21
PRIOR ART
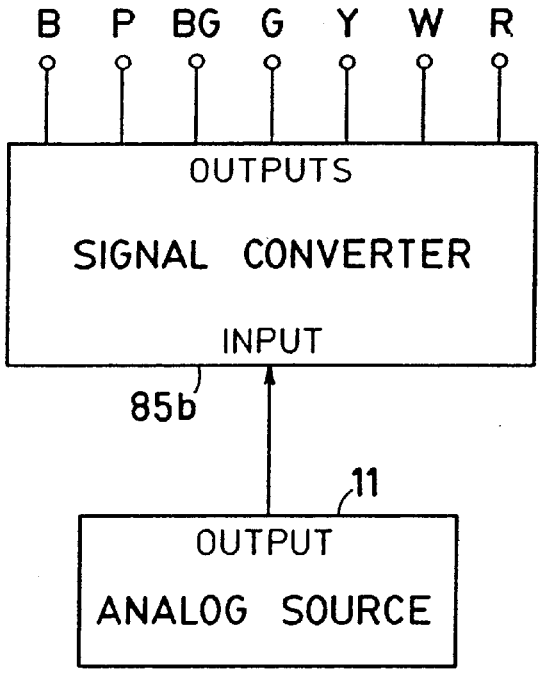
FIG. 22
PRIOR ART
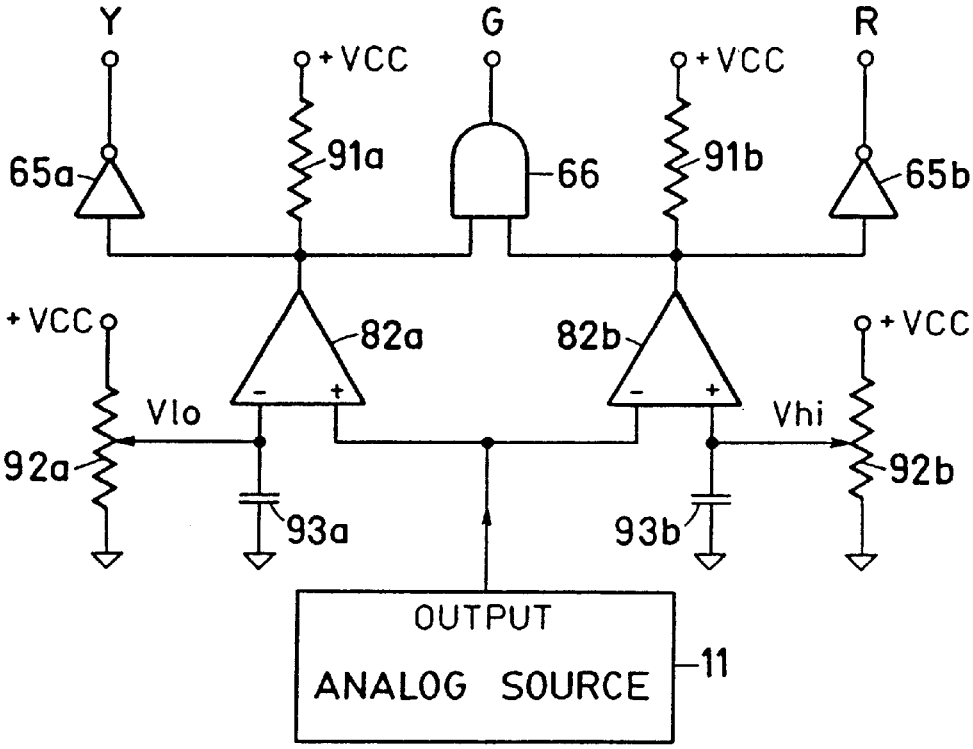
PRIOR ART FIG. 23

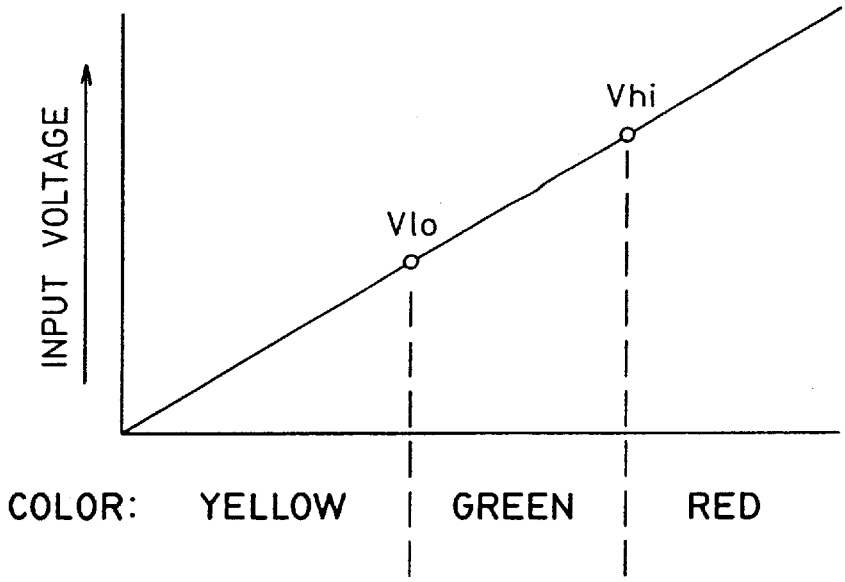
PRIOR ART FIG. 24
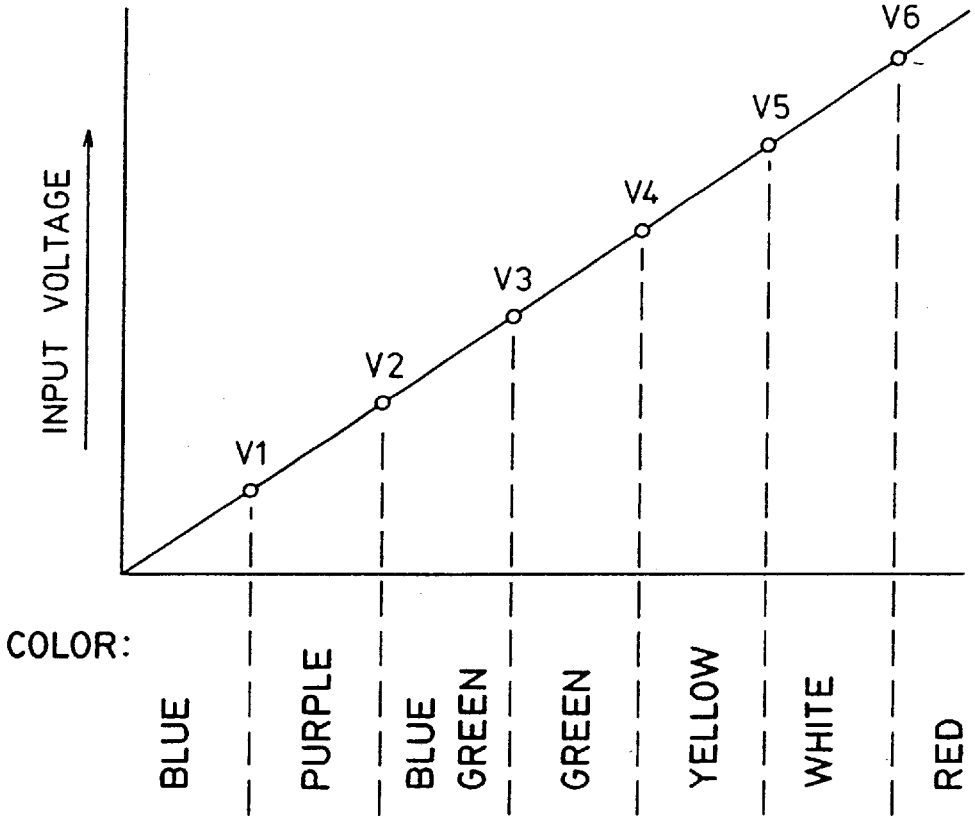
PRIOR ART FIG. 26

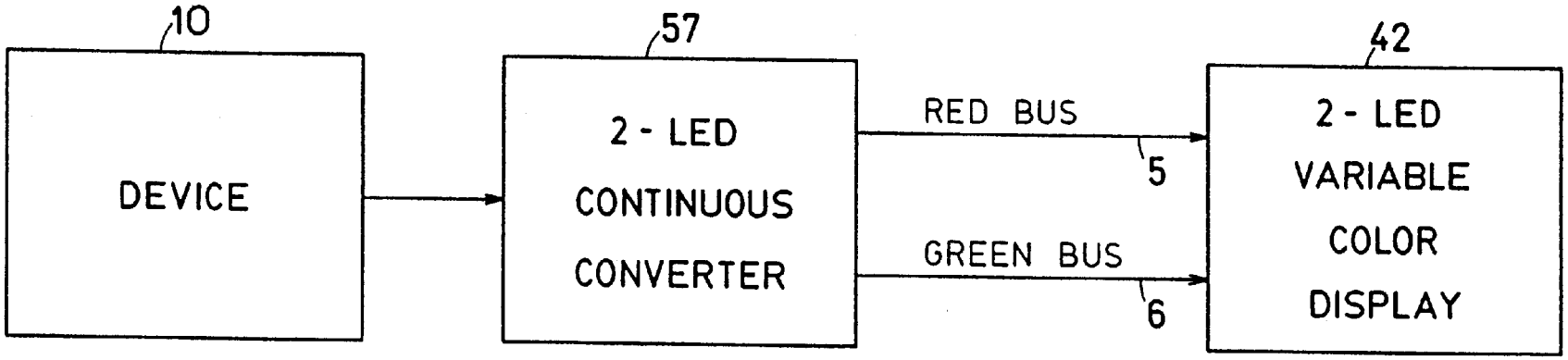
PRIOR ART FIG. 27
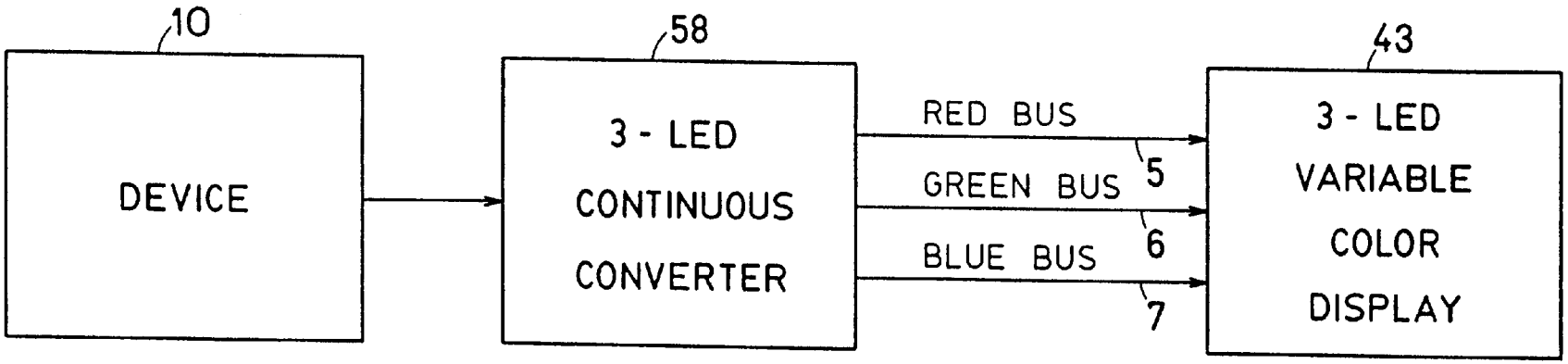
PRIOR ART FIG. 28

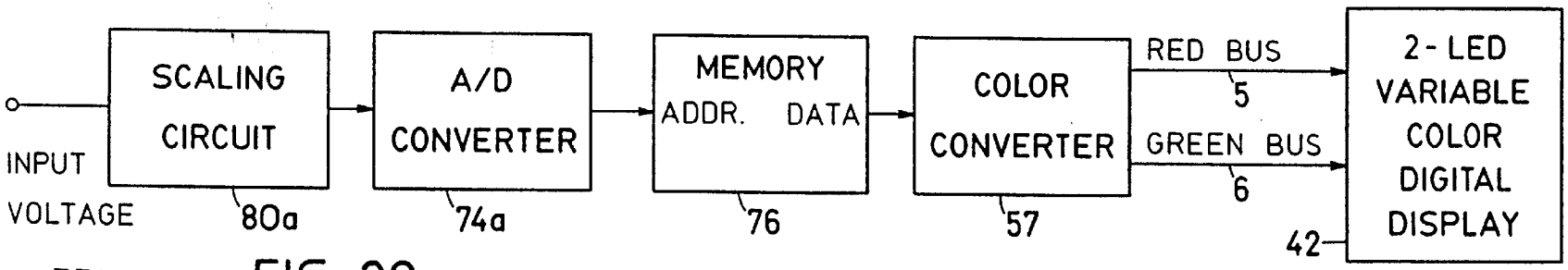
PRIOR ART FIG. 29
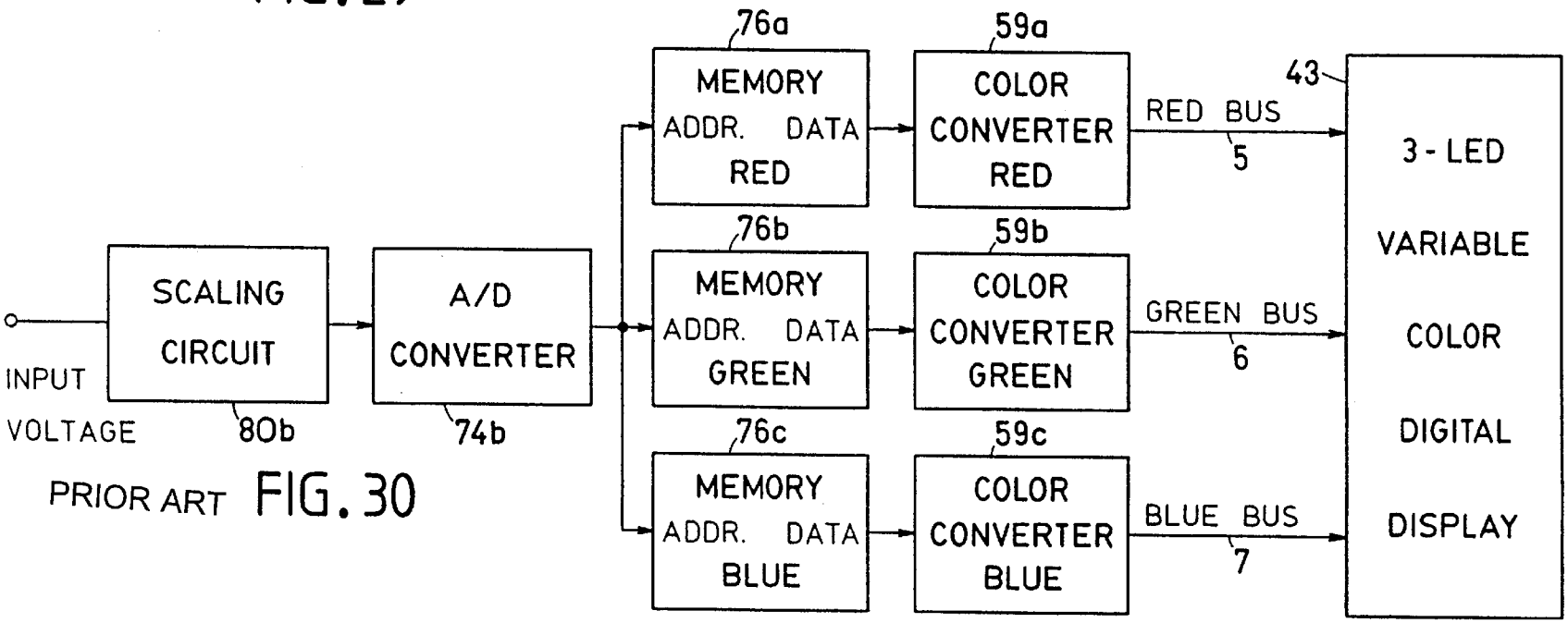
PRIOR ART FIG. 30

PRIOR ART FIG. 33

PRIOR ART FIG. 34

PRIOR ART FIG. 36

PRIOR ART FIG. 37

ICI CHROMATICITY DIAGRAM

VARIABLE COLOR COMPLEMENTARY DISPLAY DEVICE USING ANTI-PARALLEL LIGHT EMITTING DIODES

CROSS-REFERENCE TO RELATED APPLICATIONS

This relates to my copending application Ser. No. 09/109,948, filed on Jul. 6, 1998, entitled Continuously Variable Color Display System, which is a division of my application Ser. No. 08/910,080, filed on Aug. 12, 1997, entitled Variable Color Display System, which is a division of my application Ser. No. 08/571,246, filed on Dec. 12, 1995, entitled Variable Color Display System, now U.S. Pat. No. 5,656,935 issued on Aug. 12, 1997, which is a division of my application Ser. No. 08/187,350, filed on Jan. 27, 1994, entitled Variable Color Digital Multimeter, now U.S. Pat. No. 5,475,300 issued on Dec. 12, 1995, which is a division of my application Ser. No. 07/865,460, filed on Apr. 9, 1992, entitled Variable Color Digital Multimeter, now U.S. Pat. No. 5,283,517 issued on Feb. 1, 1994, which is a division of my application Ser. No. 07/628,328, filed on Dec. 14, 1990, entitled Variable Color Digital Multimeter, now U.S. Pat. No. 5,122,733 issued on Jun. 16, 1992, which is a division of my application Ser. No. 07/197,322, filed on May 23, 1988, entitled Variable Color Digital Multimeter, now abandoned, which is a division of my application Ser. No. 06/819,111, filed on Jan. 15, 1986, entitled Variable Color Digital Multimeter, now U.S. Pat. No. 4,794,383 issued on Dec. 27, 1988.

Reference is also made to my related applications Ser. No. 06/817,114, filed on Jan. 8, 1986, entitled Variable Color Digital Timepiece, now U.S. Pat. No. 4,647,217 issued on Mar. 3, 1987, Ser. No. 06/919,425, filed on Oct. 16, 1986, entitled Electronic Timepiece with Transducers, now U.S. Pat. No. 4,687,340 issued on Aug. 18, 1987, Ser. No. 06/926,511, filed on Nov. 3, 1986, entitled Electronic Timepiece with Physical Transducer, now U.S. Pat. No. 4,705,406 issued on Nov. 10, 1987, Ser. No. 07/150,913, filed on Feb. 1, 1988, entitled Variable Color Display Typewriter, now U.S. Pat. No. 4,824,269 issued on Apr. 25, 1989, Ser. No. 07/336,080, filed on Apr. 11, 1989, entitled Variable Color Display Typewriter, now U.S. Pat. No. 4,934,852 issued on Jun. 19, 1990, Ser. No. 06/839,526, filed on Mar. 14, 1986, entitled Variable Color Display Telephone, now U.S. Pat. No. 4,726,059 issued on Feb. 16, 1988, Ser. No. 06/940/100, filed on Dec. 10, 1986, entitled Digital Voltmeter with Variable Color Background, now U.S. Pat. No. 4,831,326 issued on May 16, 1989, Ser. No. 06/882,430, filed on Jul. 7, 1986, entitled Display Device with Variable Color Background, now U.S. Pat. No. 4,734,619 issued on Mar. 29, 1988, Ser. No. 07/518,779, filed on May 4, 1990, entitled Measuring Device with Variable Color Background, now U.S. Pat. No. 5,003,247 issued on Mar. 26, 1991, Ser. No. 07/528,229, filed on May 24, 1990, entitled Measuring Device with Variable Color Display, now U.S. Pat. No. 5,057,768 issued on Oct. 15, 1991, Ser. No. 08/422,090, filed on Mar. 31, 1995, entitled Digital Color Display System, now U.S. Pat. No. 5,561,365 issued on Oct. 1, 1996, Ser. No. 06/922,847, filed on Oct. 24, 1986, entitled Continuously Variable Color Display Device, now U.S. Pat. No. 4,845,481 issued on Jul. 4, 1989, Ser. No. 07/322,341, filed on Mar. 13, 1989, entitled Continuously Variable Color Optical Device, now U.S. Pat. No. 4,965,561 issued on Oct. 23, 1990, Ser. No. 07/379,616, filed on Jul. 14, 1989, entitled Variable Color Digital Display for Emphasizing Position of Decimal Point, now U.S. Pat. No. 5,003,298 issued on Mar. 26, 1991, Ser. No. 06/925,543, filed on Oct. 31, 1986, entitled Variable Color Complementary Display Device, now U.S. Pat. No. 4,804,890, issued on Feb. 14, 1989, Ser. No. 06/920,740, filed on Oct. 20, 1986, entitled Step Variable Color Display Device, now abandoned, Ser. No. 06/931,626, filed on Nov. 17, 1986, entitled Variable Color Hybrid Display Device, now abandoned, Ser. No. 07/157,603, filed on Feb. 19, 1988, entitled Variable Color Multiplexed Display System, now abandoned, and Ser. No. 07/000,478, filed on Jan. 5, 1987, entitled Variable Color Digital Tachometer, now abandoned, which describe the devices employing a variable color display.

BACKGROUND OF THE INVENTION

1. Field of the Invention

This invention relates to a variable color complementary display device.

2. Description of the Prior Art

A display device described in U.S. Pat. No. 3,740,570, issued on Jun. 19, 1973 to George R. Kaelin et al., uses special LEDs that exhibit different colors when subjected to different currents. The LEDs are biased by pulses of different amplitudes, to achieve different colors of the display, and by the length inversely proportional to the pulse amplitude, to compensate for variable brightness of the display caused by different amplitudes of the pulses.

A circuit employing a dual-color LED driven by a dual timer is described in the article by Bill Wagner entitled 2-color LED+driver=versatile visual effects, published on Oct. 2, 1980 in EDN volume 25, No. 19, page 164. Since dual-color LEDs are connected to conduct currents in opposite directions, it would be impossible to forwardly bias them simultaneously.

A luminescent solid state status indicator is disclosed in U.S. Pat. No. 3,873,979 issued on Mar. 25, 1975 to Magnus G. Craford et al. The status indicator includes two light emitting diodes inverted in parallel, which may be of different colors or of the same color.

An electronic display having segments wherein each segment is capable of selectively illuminating two colors is disclosed in U.S. Pat. No. 4,488,149 issued on Dec. 11, 1984 to William A. Givens, Jr. Two AND gates are provided for biasing, in each display segment, either a first light emitting diode, for emitting a first color, or a second light emitting diode, for emitting a second color. It is not contemplated to illuminate both light emitting diodes in each segment simultaneously for blending the colors.

A multi-color LED display for seven segment figures is disclosed in German Patent No. 3,009,416 issued on Sep. 17, 1981 to Klaus Gillessen. The LED circuit consists of seven group of diodes, each group made up of two diodes, one red and one green. The cathodes of all red diodes are terminated in a common connection, and the green ones likewise, the anodes of each pair of diodes being common for that pair. Two transistors connected in cascade are utilized for activating either all green LEDs, or all red LEDs, but not both simultaneously. When a low level signal is applied to the base of the first transistor, the first transistor is blocked, and the second transistor is turned ON to illuminate the second set of the diodes. When a high level signal is applied to the input of the first transistor, the first transistor is turned ON, while the second transistor is blocked, whereby the first set of the diodes is illuminated. Since the first transistor cannot be simultaneously turned ON and OFF, it would be impossible to illuminate the two sets of the diodes simultaneously. In another embodiment is shown a multi-color LED display utilizing three sets of LEDs: red, green, and blue, which are respectively commonly. connected and may be activated by manual switches. It is not contemplated that the three sets of LEDs be activated in selective combinations to blend the colors.

A digital electrooptical display with anti-parallel light emitting diodes is disclosed in East German Patent No. 220,844 issued on Apr. 10, 1985 to Thomas Hoffmann et al. Two light emitting diodes for emitting light of different colors are connected in each segment back-to-back. Since the light emitting diodes are connected to conduct currents in opposite directions, it would be impossible to illuminate them simultaneously, because the opposite currents attempting to pass through a single conductor would cancel.

A method and apparatus for independent color control of alphanumeric display and background therefor are disclosed in U.S. Pat. No. 3,911,418, issued on Oct. 7, 1975 to Minoru Takeda. Two color control signals, for the foreground area and for the background area, are provided separately from a computer and are processed separately, by means of a foreground selector and background selector. The two color control signals are then merged at a CRT display in raster fashion.

An error detection for multi-segmented indicia display is disclosed in U.S. Pat. No. 4,301,450, issued on Nov. 17, 1981 to Gerald D. Smoliar. A contiguous "OFF" segment of one color is provided next to each "ON" segment so as to indicate unambiguously that each non-illuminated "ON" segment is in fact indicating "OFF".

The prior art does not contemplate a variable color complementary display device using anti-parallel (back-to-back connected) light emitting diodes, on which a selective display unit may be exhibited in a desired color, by activating the display areas which correspond by their positions to the display unit, and on which the remaining display areas automatically illuminate in a complementary, or otherwise contrasting, color, without the need for conversion of the color control signals to complementary color control signals.

SUMMARY OF THE INVENTION

In a broad sense, it is the principal object of this invention to provide an improved variable color complementary display device.

It is another object of the invention to provide a variable color display device having improved readability of the exhibited display unit.

It is still another object of the invention to provide a variable color display device in which the display unit, exhibited in a selective color, is enhanced by a substantially complementary or otherwise contrasting color.

It is still another object of the invention to provide a variable color complementary display device for illuminating certain display areas in a selected color, and for automatically illuminating the remaining display areas in a color substantially complementary, without the need for converting the color control signals.

It is still another object of the invention to provide a variable color complementary display device using the pairs of anti-parallel (back-to-back connected) light emitting diodes of respective primary colors, the light emitting diodes in each pair being of the same color.

It is still another object of the invention to provide a variable color complementary display device including a decoder for developing output signals for illuminating the light emitting diodes in certain display areas in a display color, and for developing opposite output signals for illuminating the light emitting diodes in the remaining display areas in a complementary, or otherwise contrasting, color to the display color.

In summary, a variable color complementary display device of the invention includes a plurality of display areas arranged in a pattern for selectively exhibiting a plurality of display units. Each display area includes a plurality of pairs of light emitting diodes for emitting, when forwardly biased, light signals of respective primary colors and a device for combining the light signals in the display area to obtain a light signal of a composite color. Each pair includes a first light emitting diode and a second light emitting diode of the same color.

The invention resides in the anti-parallel connecting of the first light emitting diode and the second light emitting diode in each pair, such that their polarities are opposite. An activation device is provided for forwardly biasing the selective ones of the first light emitting diodes in the selected display areas, for illuminating them in a desired display color. As a result of the anti-parallel arrangement, a new and unexpected result is obtained: the second light emitting diodes in the remaining display areas are automatically illuminated in the remaining primary colors, resulting in a color which is substantially complementary to the display color. In the preferred embodiment, the activation device includes a decoder for developing active output signals, for selecting the display areas that correspond by their arrangement to the desired display unit, and for developing the opposite output signals, -for selecting the remaining display areas. The activation device further includes a plurality of buses, equal in number to the plurality of primary colors and respectively associated therewith, to which the first light emitting diodes are commonly coupled in accordance with their colors, for being forwardly biased when the respective bus is energized.

BRIEF DESCRIPTION OF THE DRAWINGS

In the drawings in which are shown several possible embodiments of the invention.

FIG. 21 is a block diagram of a signal converter for 2-primary color display.

FIG. 22 is a block diagram of a signal converter for 3-primary color display.

FIG. 23 is a schematic diagram of a comparator circuit for 2-primary color display.

FIG. 24 is a graph showing the relationship between the inputs and outputs of the comparator circuit in FIG. 23.

FIG. 26 is a graph showing the relationship between the inputs and outputs of the comparator circuit in FIG. 25.

FIG. 27 is a block diagram of a continuously variable color display system utilizing two primary colors.

FIG. 28 is a block diagram of a continuously variable color display system utilizing three primary colors.

FIG. 29 is an expanded block diagram of FIG. 27.

FIG. 30 is an expanded block diagram of FIG. 28.

Throughout the drawings, like characters indicate like parts.

BRIEF DESCRIPTION OF THE TABLES

In the tables which show examples of the relationship between an input voltage, memory contents, and resulting color in the color converter of the present invention, TABLE 1 shows the characteristic of a step variable 2-primary color converter.

TABLE 2 shows a rainbow-like characteristic of a continuously variable 3-primary color converter.

Throughout the tables, memory addresses and data are expressed in a well known hexadecimal notation.

DESCRIPTION OF THE PREFERRED EMBODIMENTS

Figure 1:
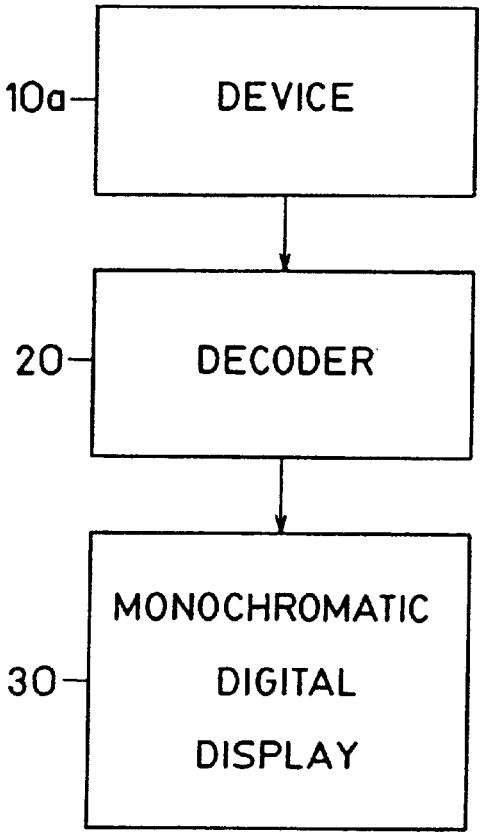
FIG. 1 is a block diagram of a typical prior art monochromatic digital display system.

Referring now, more particularly, to the drawings, in FIG. 1 is shown a block diagram of a typical prior art digital display system which usually includes a device 10*a* for developing digital data, a suitable decoder 20 for converting the digital data into a displayable code, and a monochromatic digital display 30 for indicating the digital data visually.

Figure 2:
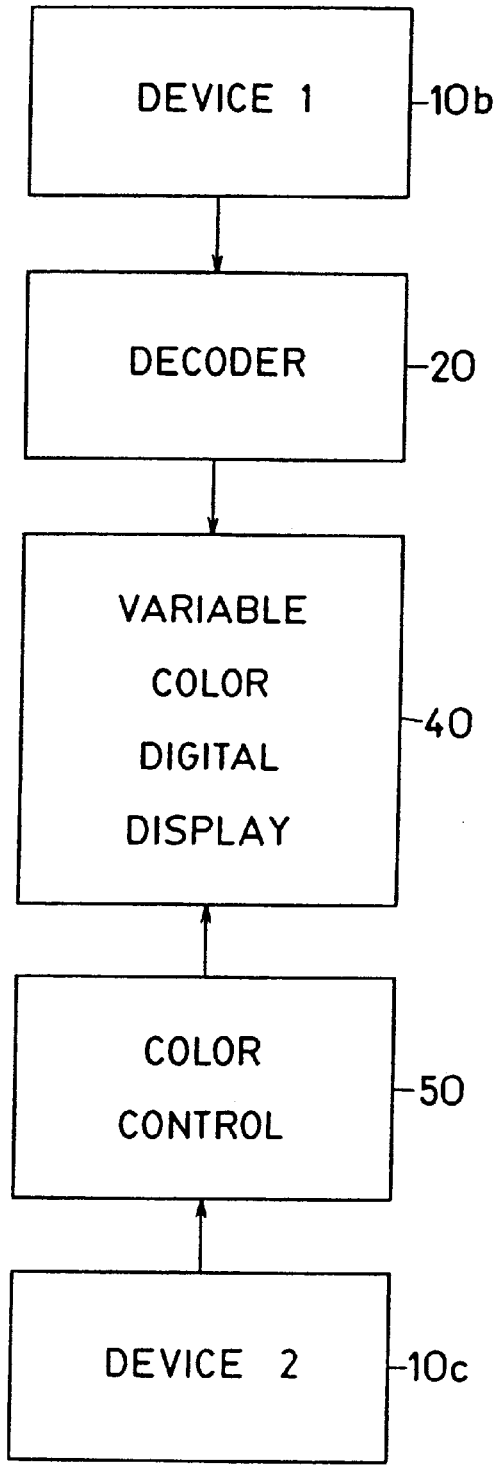
FIG. 2 PRIOR ART
FIG. 2 is a generalized block diagram of a variable color digital display system for the practice of the present invention.

As shown in FIG. 2, the present invention resides in the substitution of a commercially well known monochromatic digital display with a variable color digital display 40, and in the addition of a color control circuit 50 for controlling the color of display 40. The variable color digital display system of this invention can simultaneously indicate the values of two different quantities, from the outputs of respective devices 10*b*, 10*c*, by causing the value of the first quantity to be indicated on display 40 in digital format, and by controlling the color of display 40 in accordance with the value of the second quantity.

Figure 3:
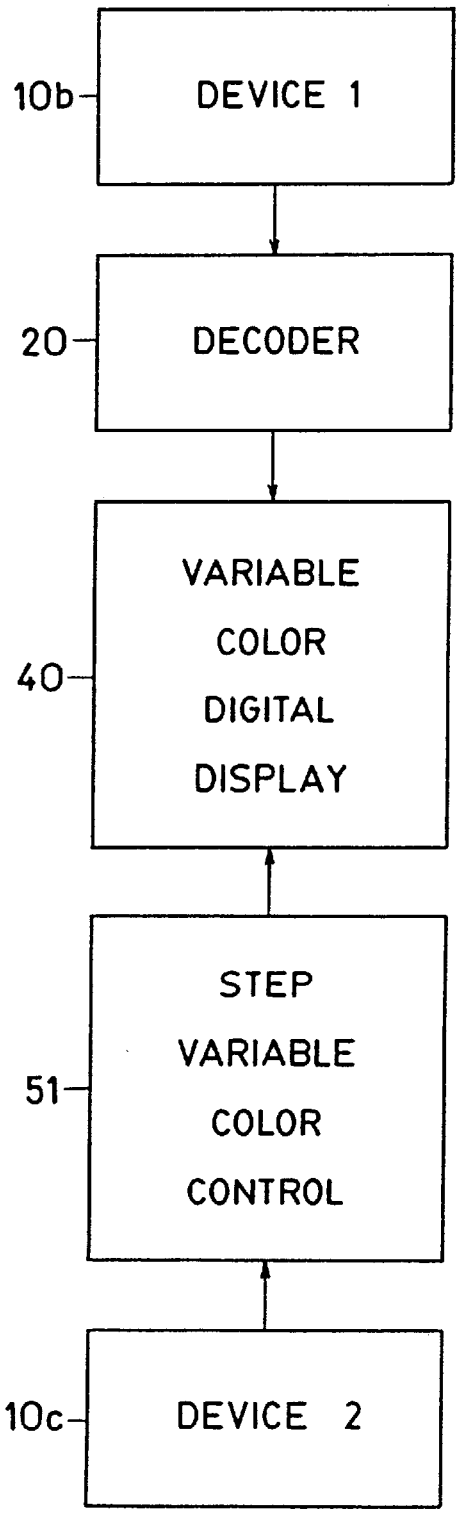
FIG. 3 PRIOR ART
FIG. 3 is a block diagram of a step variable color display system.

In FIG. 3 is shown a block diagram of another embodiment of a variable color digital display system of the present invention, characterized by a step variable color control circuit 51.

Figure 4:
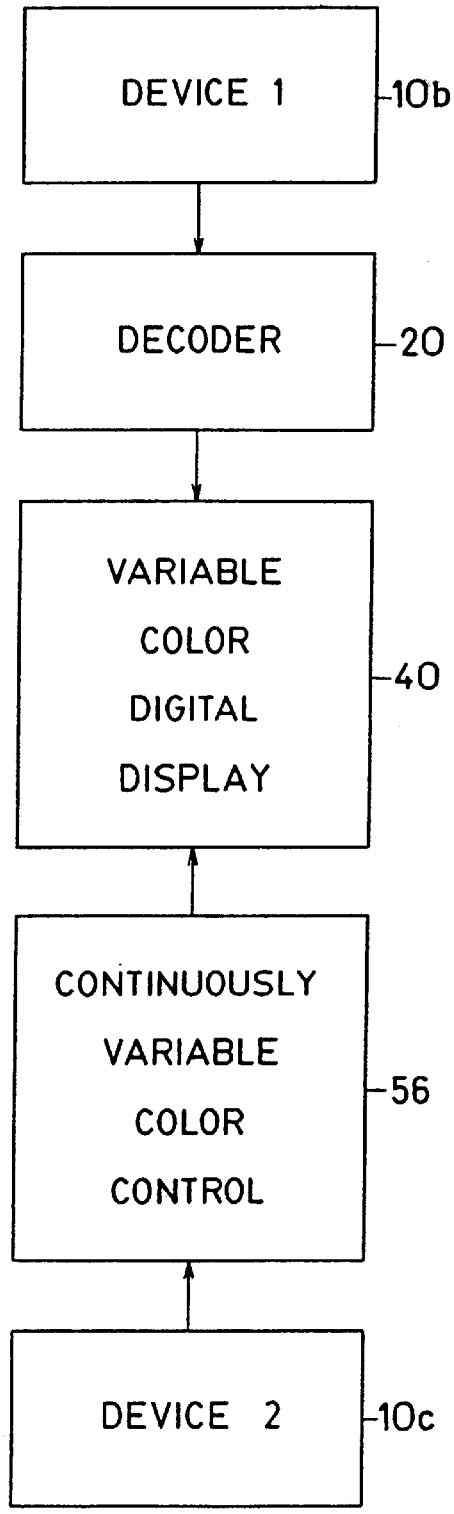
FIG. 4 PRIOR ART
FIG. 4 is a block diagram of a continuously variable color display system.

In FIG. 4 is shown a block diagram of still another embodiment of variable color digital display system, characterized by a continuously variable color control circuit 56.

Figure 5:
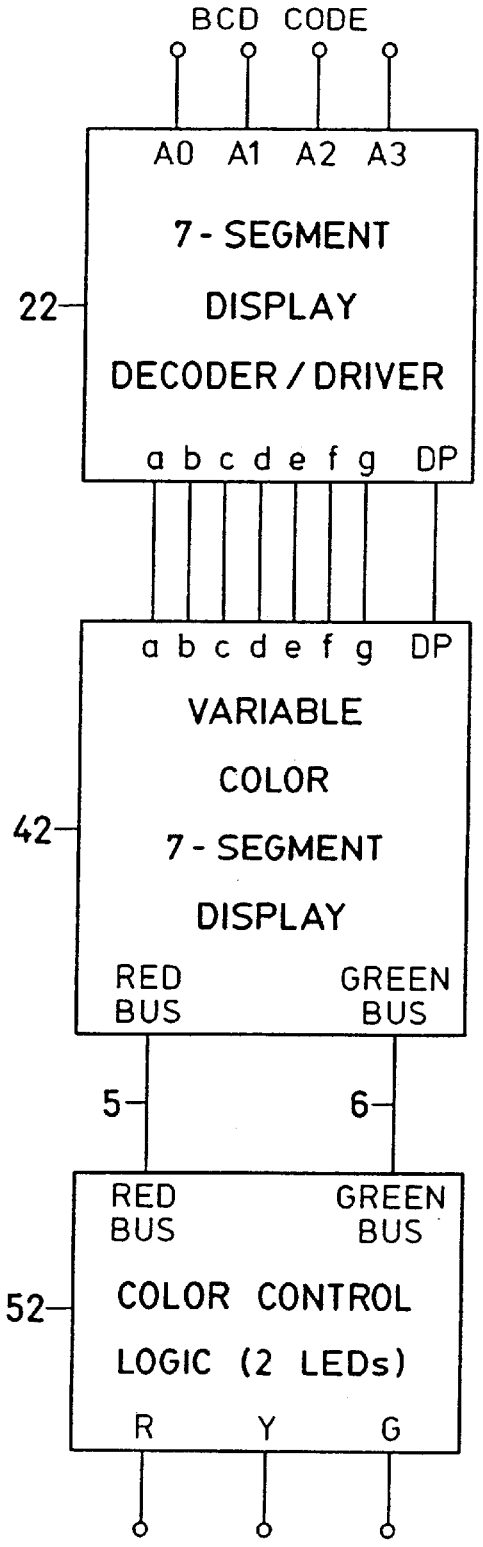
FIG. 5 PRIOR ART
FIG. 5 is a block diagram of 2-primary color digital display.

In FIG. 5 is shown a block diagram of a 2-primary color display system including a commercially well known 7-segment display decoder driver 22, a variable color 7-segment display element 42, and a 2-primary color control logic circuit 52. The decoder driver 22 accepts a 4-bit BCD (binary coded decimal) code at its inputs A0, A1, A2, A3 and develops output drive signals at its outputs a, b, c, d, e, f, g, and DP (decimal point) to drive respective segments of 7-segment display element 42. The color control circuit 52 accepts color control logic signals at its inputs R (red), Y (yellow), and G (green) and develops at its outputs drive signals for red bus 5 and green bus 6, respectively, to illuminate display element 42 in a selected color.

Figure 6:
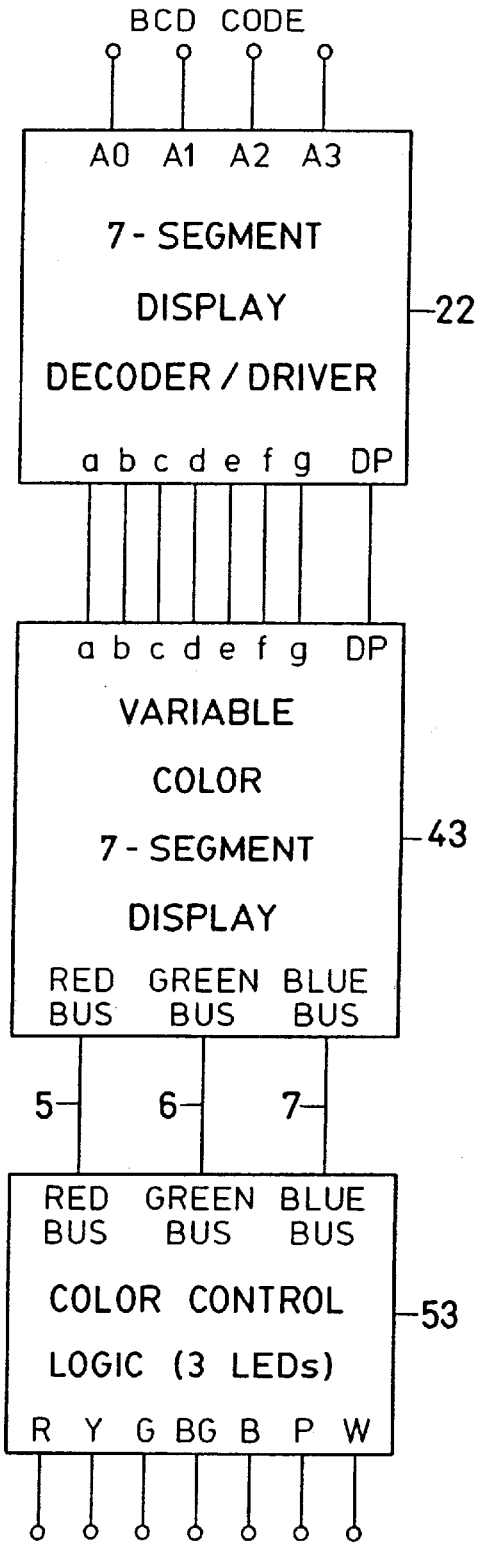
FIG. 6 PRIOR ART
FIG. 6 is a block diagram of 3-primary color digital display.

In FIG. 6 is shown a block diagram of a 3-primary color display system including a 7-segment display decoder driver 22, variable color 7-segment display element 43, and a 3-primary color control logic circuit 53. The color control circuit 53 accepts color control logic signals at its inputs R (red), Y (yellow), G (green), BG (blue-green), B (blue), P (purple), and W (white) and develops at its outputs drive signals for red bus 5, green bus 6, and blue bus 7, respectively, to illuminate display element 43 in a selected color.

Figure 7:
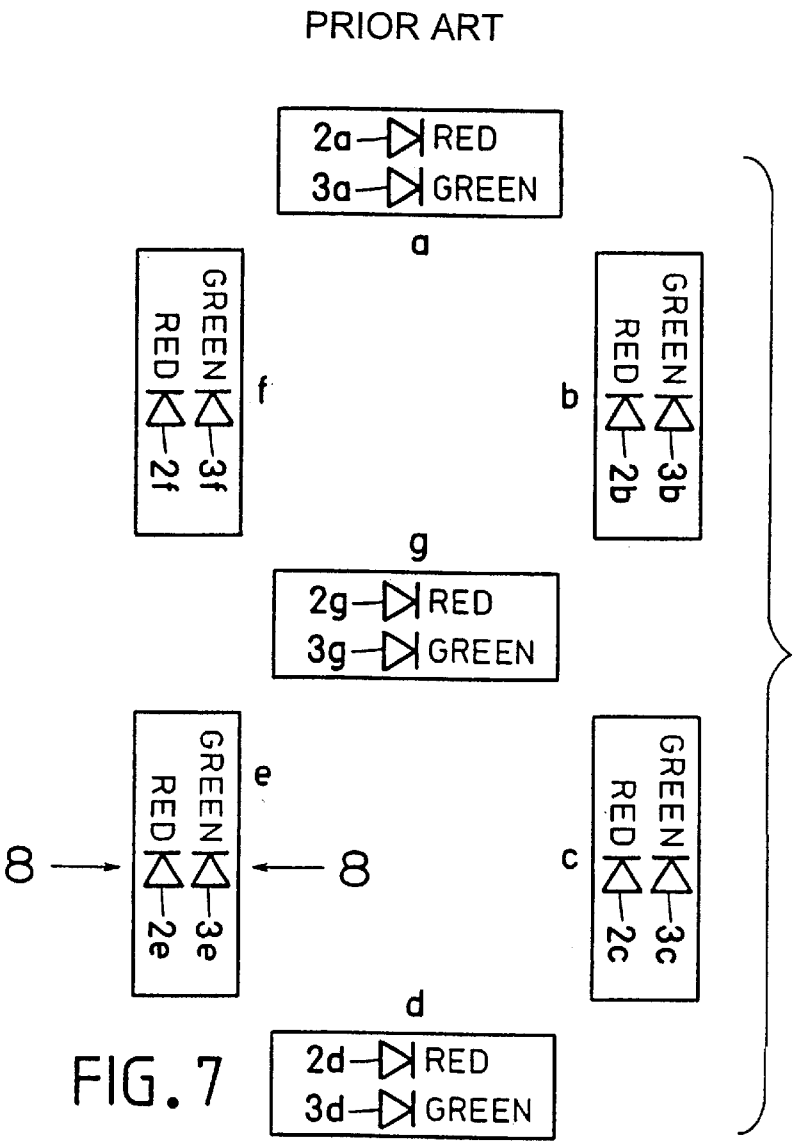
FIG. 7 is an enlarged detail of one digit of 2-primary color digital display.

In FIG. 7, the 2-primary color display element includes seven elongated display segments a, b, c, d, e, f, and g, arranged in a conventional pattern, which may be selectively energized in different combinations to display the desired digits. Each display segment includes a pair of LEDs (light emitting-diodes): red LED 2 and green LED 3, which are closely adjacent such that the light signals emitted therefrom are substantially superimposed upon each other to mix the colors. To facilitate the illustration, the LEDs are designated by segment symbols, e. g., the red LED in the segment a is designated as 2*a*, etc.

Figure 8:
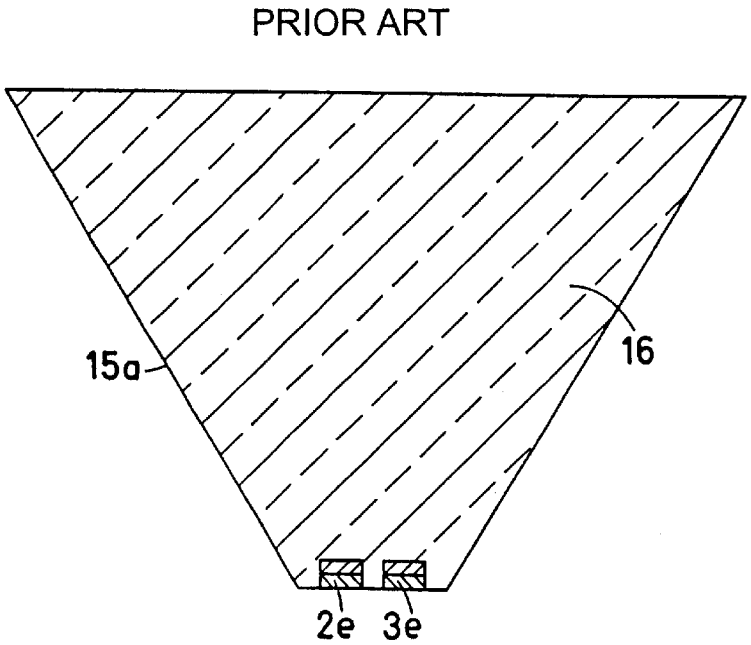
FIG. 8 is an enlarged cross-sectional view of one display segment in FIG. 7, taken along the line 8—8.

In FIG. 8, red LED 2*e* and green LED 3*e* are placed on the base of a segment body 15*a* which is filled with a transparent light scattering material 16. When forwardly biased, LEDs 2*e* and 3*e* emit light signals of red and green colors, respectively, which are scattered within transparent material 16, thereby blending the red and green light signals into a composite light signal that emerges at the upper surface of segment body 15*a*. The color of the composite light signal may be controlled by varying the portions of the red and green light signals.

Figure 9:
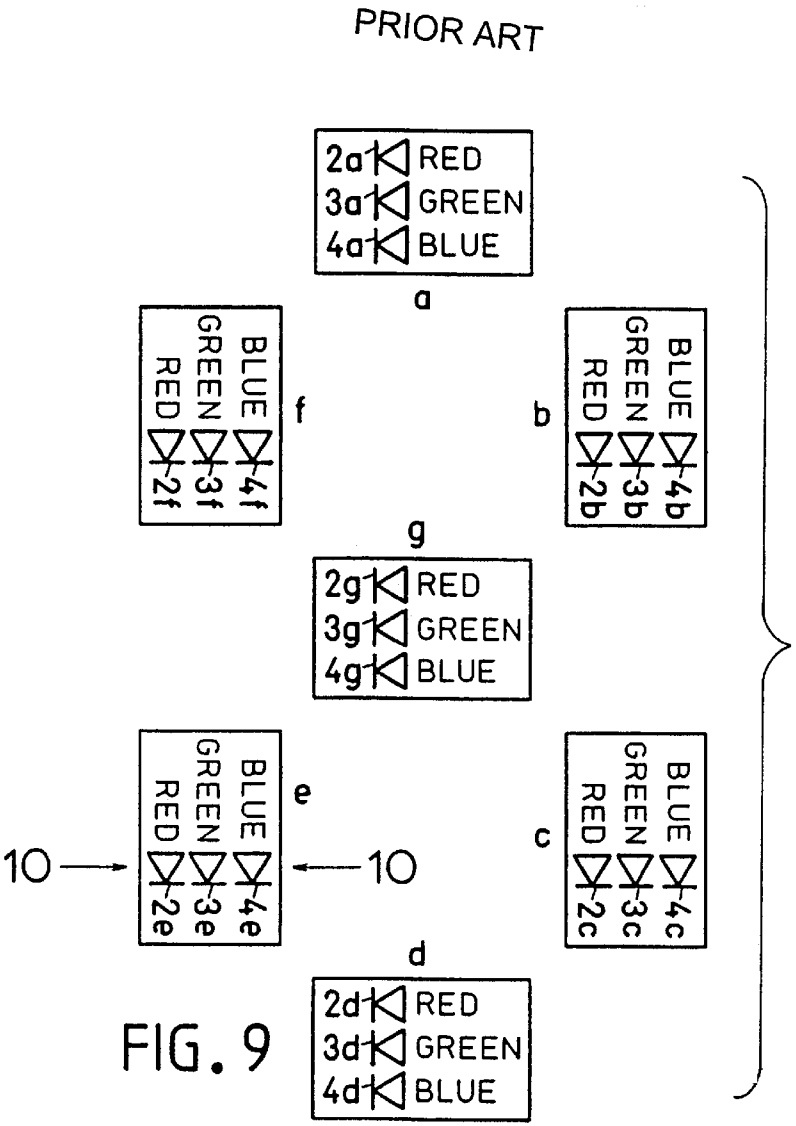
FIG. 9 is an enlarged detail of one digit of 3-primary color digital display.

In FIG. 9, each display segment of the 3-primary color display element includes a triad of LEDs: red LED 2, green LED 3, and blue LED 4, which are closely adjacent such that the light signals emitted therefrom are substantially superimposed upon one another to mix the colors.

Figure 10:
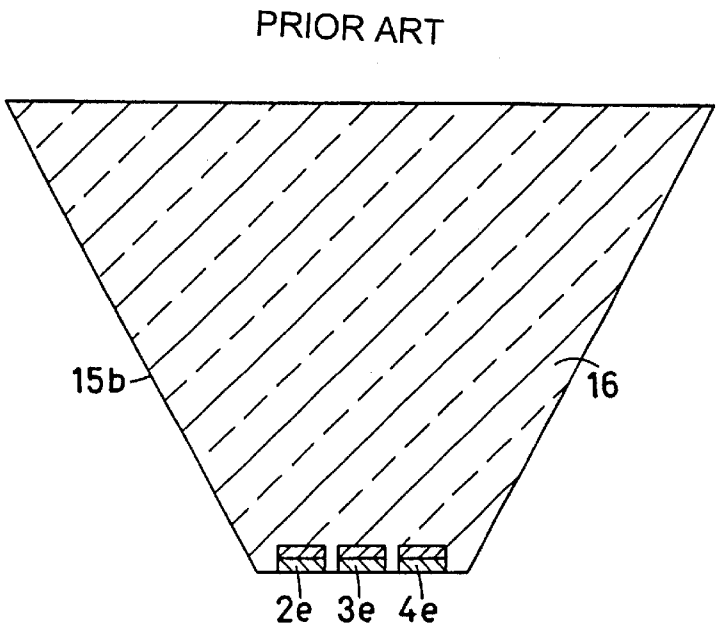
FIG. 10 is an enlarged cross-sectional view of one display segment in FIG. 9, taken along the line 10—10.

In FIG. 10, red LED 2*e*, green LED 3*e*, and blue LED 4*e* are placed on the base of a segment body 15*b* which is filled with a transparent light scattering material 16. Red LEDs are typically manufactured by diffusing a p-n junction into a GaAsP epitaxial layer on a GaAs substrate; green LEDs typically use a GaP epitaxial layer on a GaP substrate; blue LEDs are typically made from SiC material.

When forwardly biased, LEDs 2*e*, 3*e*, and 4*e* emit light signals of red, green, and blue colors, respectively, which are scattered within transparent material 16, thereby blending the red, green, and blue light signals into a composite light signal that emerges at the upper surface of segment body 15*b*. The color of the composite light signal may be controlled by varying the portions of the red, green, and blue light signals.

Figure 11:
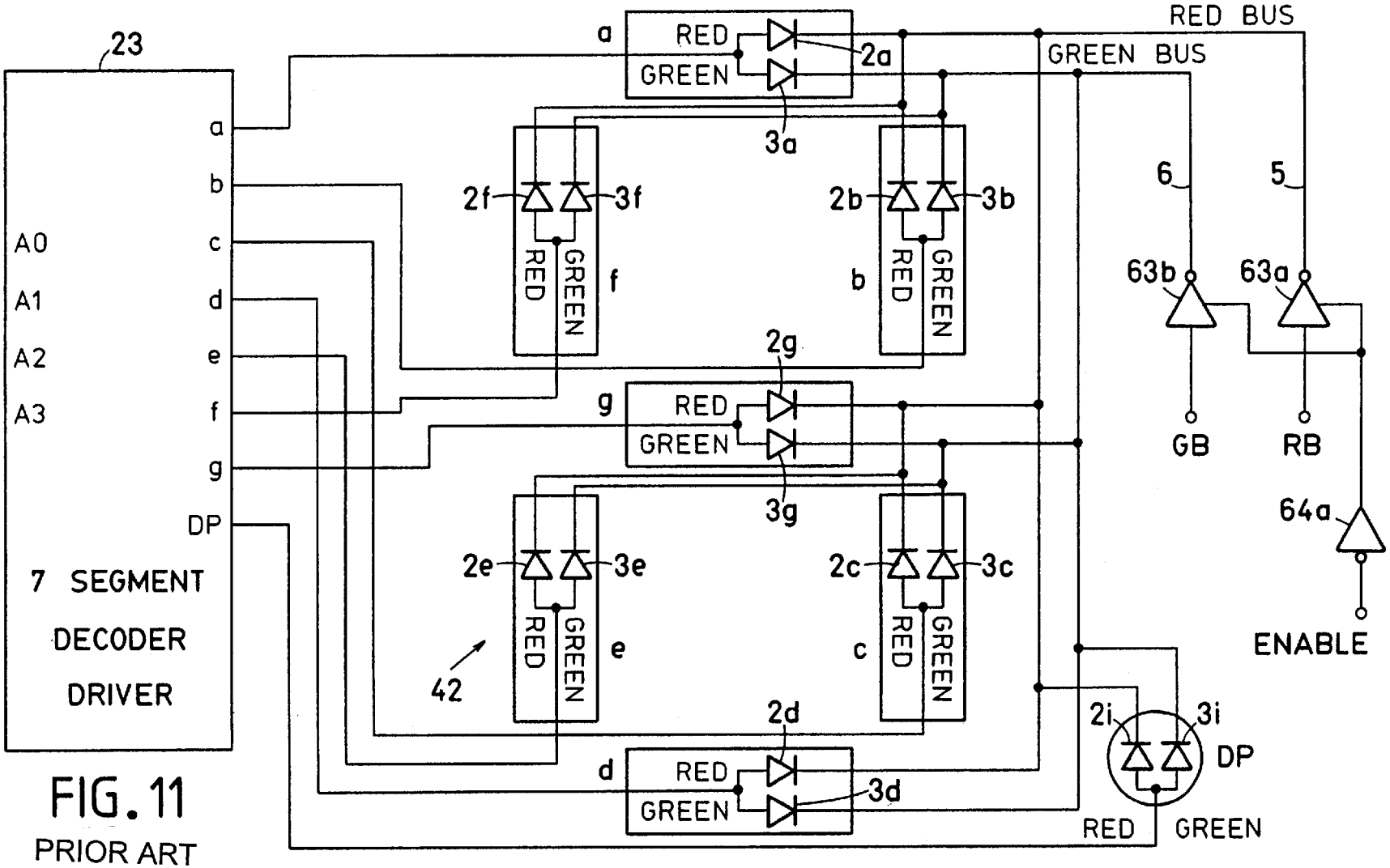
FIG. 11 PRIOR ART
FIG. 11 is a schematic diagram of one digit of two-primary color control circuit of this invention.

In FIG. 11 is shown a schematic diagram of a 2-primary color common cathodes 7-segment display element 42 which can selectively display various digital fonts in different colors on display segments a, b, c, d, e, f, g, and DP (Decimal Point). The anodes of all red and green LED pairs are interconnected in each display segment and are electrically connected to respective outputs of a commercially well known common-cathode 7-segment decoder driver 23. The cathodes of all red LEDs 2*a*, 2*b*, 2*c*, 2*d*, 2*e*, 2*f*, 2*g*, and 2*i* are interconnected to a common electric path referred to as a red bus 5. The cathodes of all green LEDs 3*a*, 3*b*, 3*c*, 3*d*, 3*e*, 3*f*, 3*g*, and 3*i* are interconnected to a like common electric path referred to as a green bus 6.

The red bus 5 is connected to the output of a tri-state inverting buffer 63*a*, capable of sinking sufficient current to forwardly bias all red LEDs 2*a* to 2*i* in display element 42. The green bus 6 is connected to the output of a like buffer 63*b*. The two buffers 63*a*, 63*b* can be simultaneously enabled by applying a low logic level signal to the input of inverter 64*a*, and disabled by applying a high logic level signal thereto. When buffers 63*a*, 63*b* are enabled, the conditions of red bus 5 and green bus 6 can be selectively controlled by applying suitable logic control signals to the bus control inputs RB (red bus) and GB (green bus), to illuminate display element 42 in a selected color. When the buffers 63*a*, 63*b* are disabled, both red bus 5 and green bus 6 are effectively disconnected to cause display element 42 to be completely extinguished.

Figure 12:
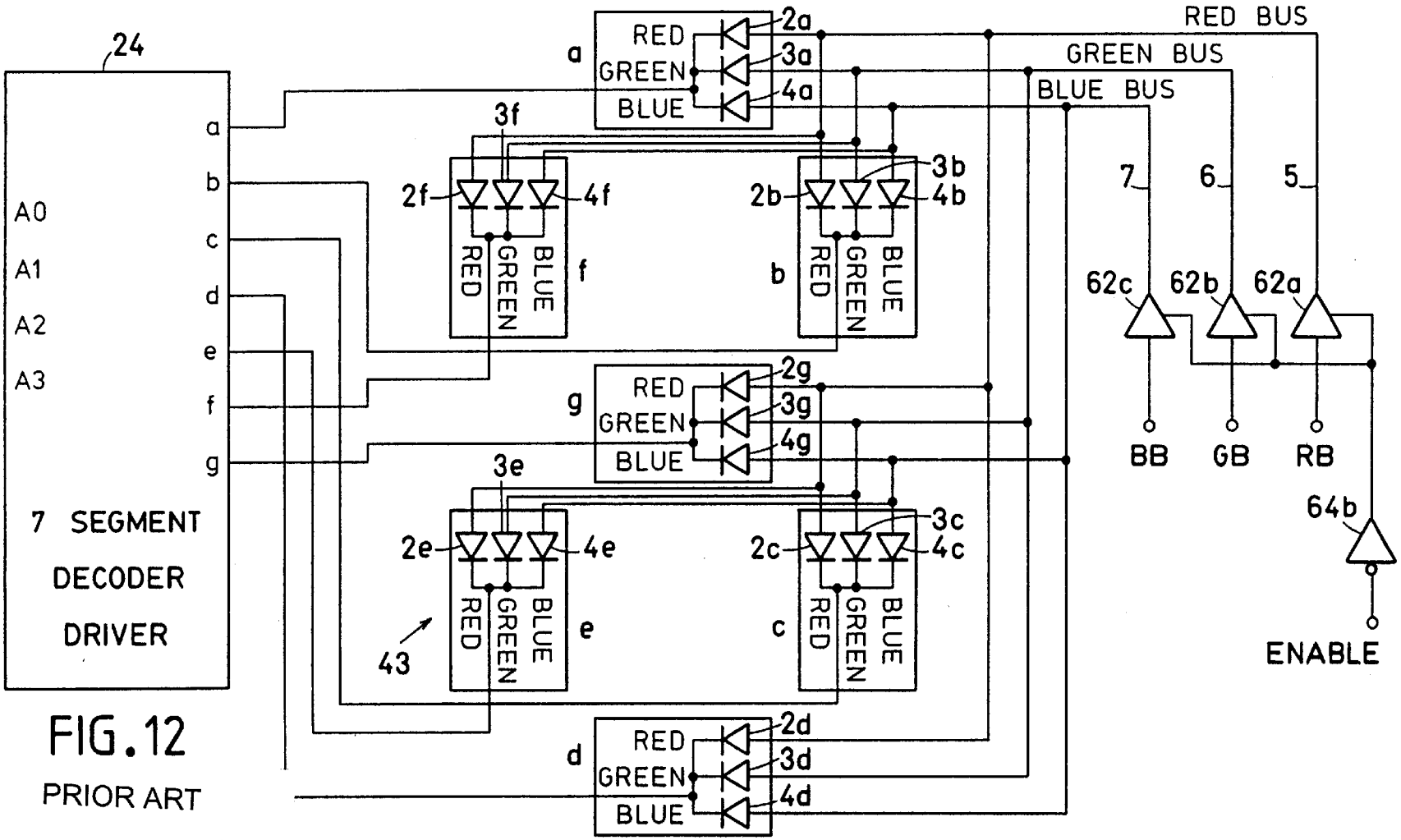
FIG. 12 PRIOR ART
FIG. 12 is a schematic diagram of one digit of 3-primary color control circuit of this invention.

In FIG. 12 is shown a schematic diagram of a 3-primary color common anodes 7-segment display element 43 which can selectively display digital fonts in different colors. The cathodes of all red, green, and blue LED triads in each display segment are interconnected and electrically connected to respective outputs of a commercially well known common anode 7-segment decoder driver 24. The anodes of all red LEDs 2*a*, 2*b*, 2*c*, 2*d*, 2*e*, 2*f*, and 2*g* are interconnected to form a common electric path referred to as a red bus 5. The anodes of all green LEDs 3*a*, 3*b*, 3*c*, 3*d*, 3*e*, 3*f*, and 3*g* are interconnected to form a like common electric path referred to as a green bus 6. The anodes of all blue LEDs 4*a*, 4*b*, 4*c*, 4*d*, 4*e*, 4*f*, and 4*g* are interconnected to form a like common electric path referred to as a blue bus 7.

The red bus 5 is connected to the output of a non-inverting tri-state buffer 62*a*, capable of sourcing sufficient current to illuminate all red LEDs 2*a* to 2*g* in display element 43. The green bus 6 is connected to the output of a like buffer 62*b*. The blue bus 7 is connected to the output of a like buffer 62*c*. The three buffers 62*a*, 62*b*, and 62*c* can be simultaneously enabled, by applying a low logic level signal to the input of inverter 64*b*, and disabled by applying a high logic level signal thereto. When buffers 62*a*, 62*b*, and 62*c* are enabled, the conditions of red bus 5, green bus 6, and blue bus 7 can be selectively controlled by applying valid combinations of logic level signals to the bus control inputs RB (red bus), GB (green bus), and BB (blue bus), to illuminate display element 43 in a selected color. When buffers 62*a*, 62*b*, and 62*c* are disabled, red bus 5, green bus 6, and blue bus 7 are effectively disconnected to cause display element 43 to be completely extinguished.

Step Variable Color Control

Figure 13:
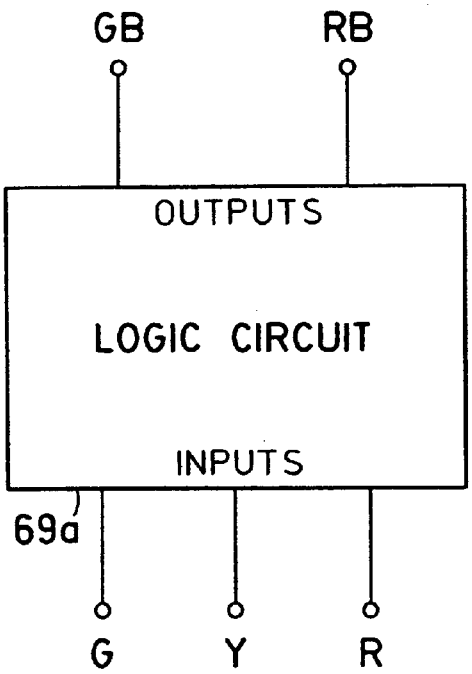
FIG. 13 PRIOR ART
FIG. 13 is a block diagram of a color control logic circuit for controlling 2-primary color display.

In FIG. 13 is shown a logic circuit 69*a* for developing drive signals for red bus 5 and green bus 6, to control the color of display element 42 shown in FIG. 11. Two voltage levels, referred to as logic high and low, are used throughout the description of the digital circuits. The color of display element 42 may be controlled by applying valid combinations of logic level signals to its color control inputs R (red), Y (yellow), and G (green) . The logic circuit 69*a* combines the input signals in a logic fashion and develops output drive signals RB (red bus) and GB (green bus), for activating red bus 5 and green bus 6, respectively, of display element 42.

Figure 14:
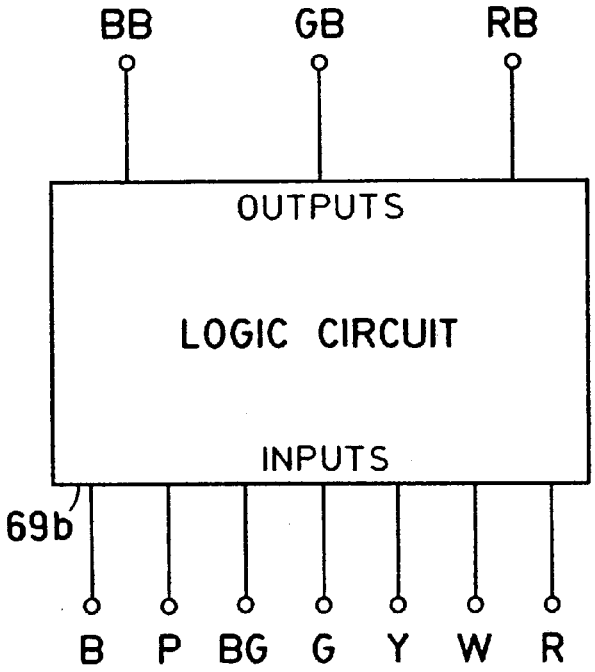
FIG. 14 PRIOR ART
FIG. 14 is a block diagram of a color control logic circuit for controlling 3-primary color display.

In FIG. 14 is shown a like logic circuit 69*b* for developing drive signals for red bus 5, green bus 6, and blue bus 7, to control the color of display element 43 shown in FIG. 12. The color of display element 43 may be controlled by applying valid combinations of logic level signals to its color control inputs B (blue), P (purple), BG (blue-green), G (green), Y (yellow), W (white), and R (red). The logic circuit 69*b* combines the input signals in a logic fashion and develops output drive signals RB (red bus), GB (green bus), and BB (blue bus), for activating red bus 5, green bus 6, and blue bus 7, respectively, of display element 43.

Figure 15:
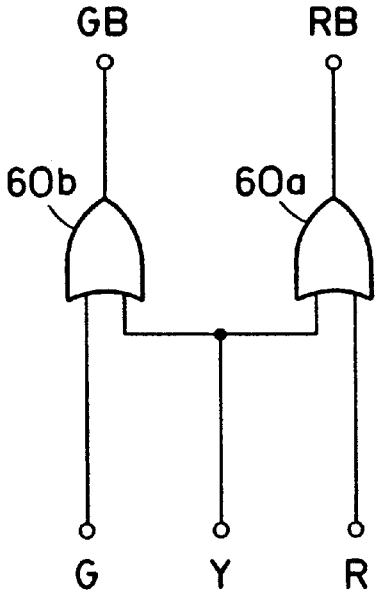
FIG. 15 PRIOR ART
FIG. 15 is a schematic diagram of a color control logic circuit for controlling 2-primary color display.
Figure 16:
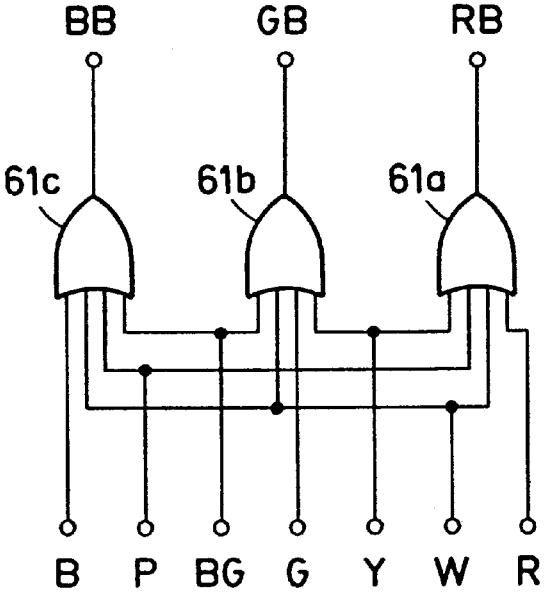
FIG. 16 PRIOR ART
FIG. 16 is a schematic diagram of a color control logic circuit for controlling 3-primary color display.

Exemplary schematic diagrams of the color control logic circuits shown in FIGS. 15 and 16 consider active high logic levels, which means that only the selected color control input is maintained at a high logic level, while all remaining color control inputs are maintained at a low logic level. The circuit in FIG. 15 is a detail of the color control logic circuit 69*a* employing 2-input logic OR gates 60*a* and 60*b*, interposed between the color control inputs R, Y, G and bus control outputs RB, GB, in a manner which will become more apparent from the description below. A like circuit in FIG. 16 is a detail of the color control logic circuit 69*b* employing 4-input logic OR gates 61*a*, 61*b*, and 61*c* similarly interposed between the color control inputs B, P, BG, G, Y, W, R and bus control outputs RB, GB, BB. It will be obvious to those skilled in the art that other types of logic devices may be effectively used.

Figure 17:
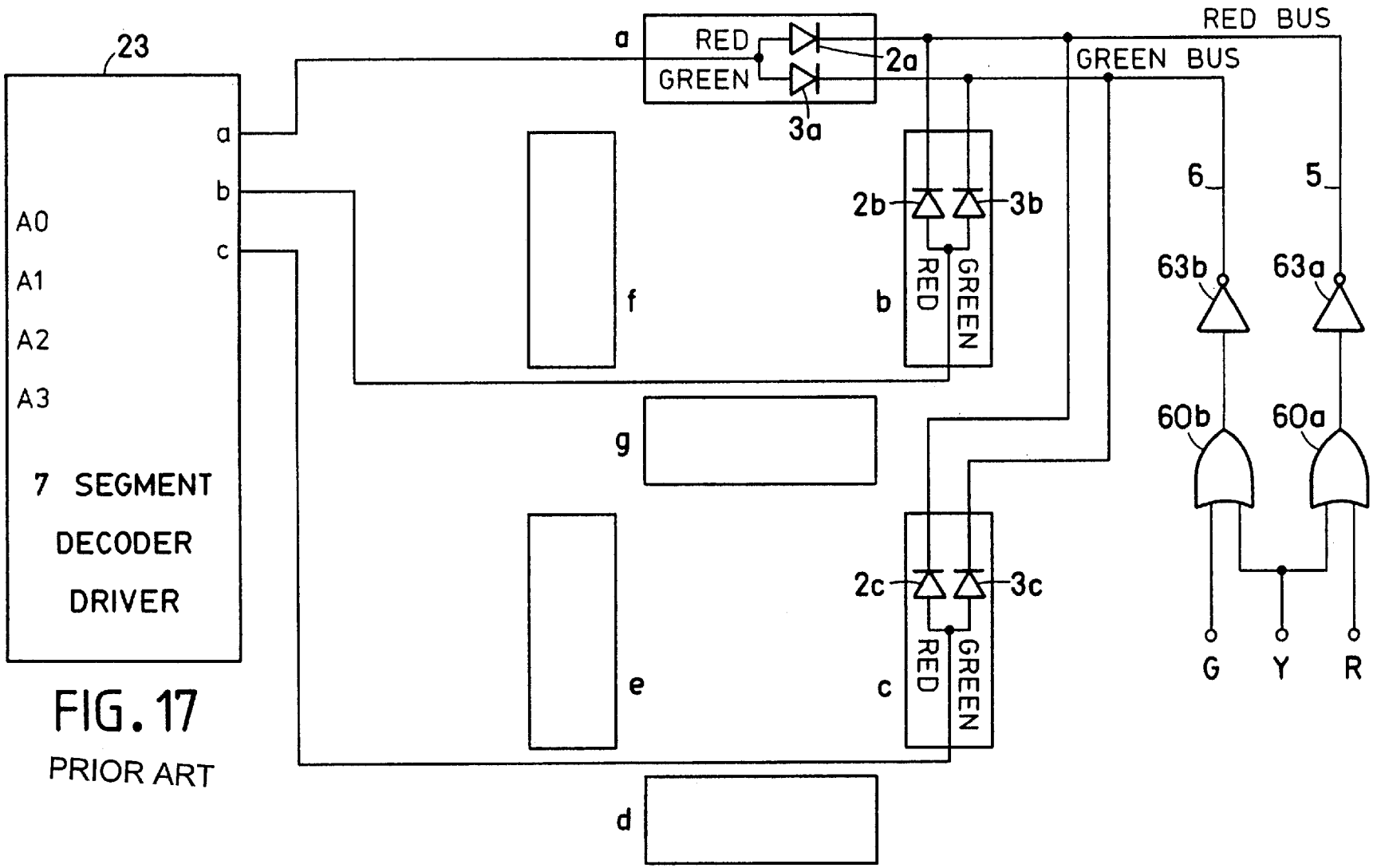
FIG. 17 PRIOR ART
FIG. 17 is a simplified schematic diagram, similar to FIG. 11, showing how the number '7' can be displayed in three different colors.

The operation of display element 42 shown in FIG. 11 will be now explained by the example of illuminating a digit '7' in three different colors. A simplified schematic diagram to facilitate the explanation is shown in FIG. 17. Any digit between 0 and 9 can be selectively displayed by applying the appropriate BCD code to the inputs A0, A1, A2, and A3 of common-cathode 7-segment decoder driver 23. The decoder driver 23 develops at its outputs a, b, c, d, e, f, g, and DP drive signals for energizing selected groups of the segments to thereby visually display the selected number, in a manner well known to those having ordinary skill in the art. To display decimal number '7', a BCD code 0111 is applied to the inputs A0, A1, A2, and A3. The decoder driver 23 develops high voltage levels at its outputs a, b, and c, to illuminate equally designated segments a, b, and c, and low voltage levels at all remaining outputs (not shown), to extinguish all remaining segments d, e, f, and g. To illuminate display element 42 in red color, the color control input R is raised to a high logic level, and the color control inputs Y and G are maintained at a low logic level. As a result, the output of OR gate 60*a* rises to a high logic level, thereby causing the output of buffer 63*a* to drop to a low logic level. The current flows from the output a of decoder driver 23, via red LED 2*a* and red bus 5, to current sinking output of buffer 63*a*. Similarly, the current flows from the output b of decoder driver 23, via red LED 2*b* and red bus 5, to the output of buffer 63*a*. The current flows from the output c of decoder driver 23, via red LED 2*c* and red bus 5, to the output of buffer 63*a*. As a result, segments a, b, and c illuminate in red color, thereby causing a visual impression of a character '7'. The green LEDs 3*a*, 3*b*, 3*c* remain extinguished because the output of buffer 63*b* is at a high logic level, thereby disabling green bus 6.

To illuminate display element 42 in green color, the color control input G is raised to a high logic level, while the color control inputs R and Y are maintained at a low logic level. As a result, the output of OR gate 60*b* rises to a high logic level, thereby causing the output of buffer 63*b* to drop to a low logic level. The current flows from the output a of decoder driver 23, via green LED 3*a* and green bus 6, to current sinking output of buffer 63*b*. Similarly, the current flows from the output b of decoder driver 23, via green LED 3*b* and green bus 6, to the output of buffer 63*b*. The current flows from the output c of decoder driver 23, via green LED 3*c* and green bus 6, to the output of buffer 63*b*. As a result, segments a, b, and c illuminate in green color. The red LEDs 2*a*, 2*b*, and 2*c* remain extinguished because the output of buffer 63*a* is at a high logic level, thereby disabling red bus 5.

To illuminate display element 42 in yellow color, the color control input Y is raised to a high logic level, while the color inputs R and G are maintained at a low logic level. As a result, the outputs of both OR gates 60*a* and 60*b* rise to a high logic level, thereby causing the outputs of both buffers 63*a* and 63*b* to drop to a low logic level. The current flows from the output a of decoder driver 23, via red LED 2*a* and red bus 5, to current sinking output of buffer 63*a*, and, via green LED 3*a* and green bus 6, to current sinking output of buffer 63*b*. Similarly, the current flows from the output b of decoder driver 23, via red LED 2*b* and red bus 5, to the output of buffer 63*a*, and, via green LED 3*b* and green bus 6, to the output of buffer 63*b*. The current flows from the output c of decoder driver 23, via red LED 2*c* and red bus 5, to the output of buffer 63*a*, and, via green LED 3*c* and green bus 6, to the output of buffer 63*b*. As a result of blending light of red and green colors in each segment, segments a, b, and c illuminate in substantially yellow color.

Figure 18:
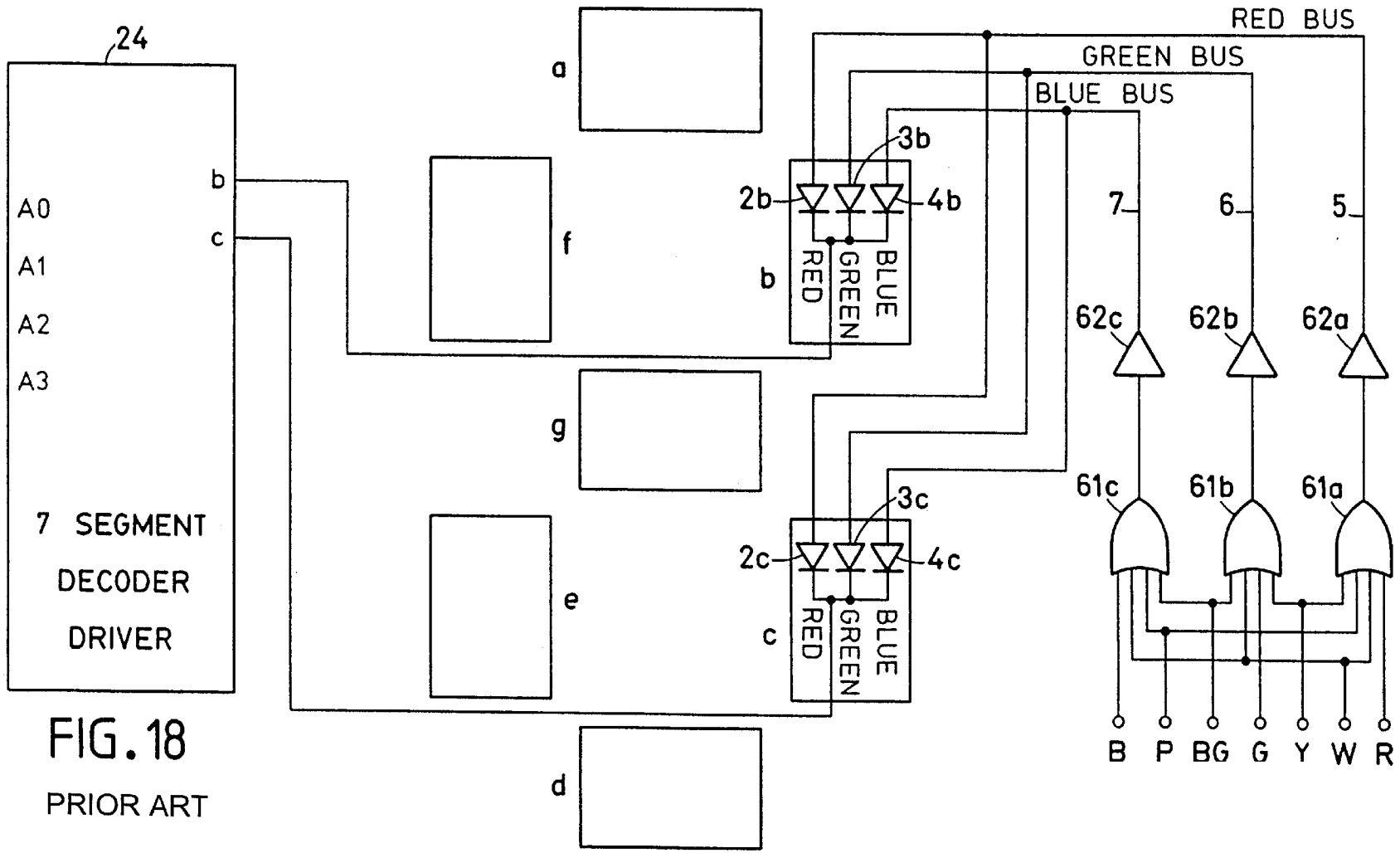
FIG. 18 PRIOR ART
FIG. 18 is a simplified schematic diagram, similar to FIG. 12, showing how the number '1' can be displayed in seven different colors.

The operation of display element 43 shown in FIG. 12 will be now explained by the example of illuminating a digit '1' in seven different colors. A simplified schematic diagram to facilitate the explanation is shown in FIG. 18. To display decimal number '1', a BCD code 0001 is applied to the inputs A0, A1, A2, and A3 of common anode 7-segment decoder driver 24. The decoder driver 24 develops low voltage levels at its outputs b and c, to illuminate equally designated segments b and c, and high voltage levels at all remaining outputs (not shown), to extinguish all remaining segments a, d, e, f, and g.

To illuminate display element 43 in red color, the color control input R is raised to a high logic level, while all remaining color control inputs are maintained at a low logic level. As a result, the output of OR gate 61*a* rises to a high logic level, thereby causing the output of buffer 62*a* to rise to a high logic level. The current flows from the output of buffer 62*a*, via red bus 5 and red LED 2*b*, to the output b of decoder driver 24, and, via red LED 2*c*, to the output c of decoder driver 24. As a result, segments b and c illuminate in red color, thereby causing a visual impression of a character '1'. The green LEDs 3*b*, 3*c* and blue LEDs 4*b*, 4*c* remain extinguished because green bus 6 and blue bus 7 are disabled.

To illuminate display element 43 in green color, the color control input G is raised to a high logic level, while all remaining color control inputs are maintained at a low logic level. As a result, the output of OR gate 61*b* rises to a high logic level, thereby causing the output of buffer 62*b* to rise to a high logic level. The current flows from the output of buffer 62*b*, via green bus 6 and green LED 3*b*, to the output b of decoder driver 24, and, via green LED 3*c*, to the output c of decoder driver 24. As a result, segments b and c illuminate in green color.

To illuminate display element 43 in blue color, the color control input B is raised to a high logic level, while all remaining color control inputs are maintained at a low logic level. As a result, the output of OR gate 61*c* rises to a high logic level, thereby causing the output of buffer 62*c* to rise to a high logic level. The current flows from the output of buffer 62*c*, via blue bus 7 and blue LED 4*b*, to the output b of decoder driver 24, and, via blue LED 4*c*, to the output c of decoder driver 24. As a result, segments b and c illuminate in blue color.

To illuminate display element 43 in yellow color, the color control input Y is raised to a high logic level, while all remaining color control inputs are maintained at a low logic level. As a result, the outputs of OR gates 61*a* and 61*b* rise to a high logic level, thereby causing the outputs of buffers 62*a* and 62*b* to rise to a high logic level. The current flows from the output of buffer 62*a*, via red bus 5 and red LED 2*b*, to the output b of decoder driver 24, and, via red LED 2*c*, to the output c of decoder driver 24. The current also flows from the output of buffer 62*b*, via green bus 6 and green LED 3*b*, to the output b of decoder driver 24, and, via green LED 3*c*, to the output c of decoder driver 24. As a result of blending light of red and green colors in each segment, the segments b and c illuminate in substantially yellow color.

To illuminate display element 43 in purple color, the color control input P is raised to a high logic level, while all remaining color control inputs are maintained at a low logic level. As a result, the outputs of OR gates 61*a* and 61*c* rise to a high logic level, thereby causing the outputs of buffers 62*a* and 62*c* to rise to a high logic level. The current flows from the output of buffer 62*a*, via red bus 5 and red LED 2*b*, to the output b of decoder driver 24, and, via red LED 2*c*, to the output c of decoder driver 24. The current also flows from the output of buffer 62*c*, via blue bus 7 and blue LED 4*b*, to the output b of decoder driver 24, and, via blue LED 4*c*, to the output c of decoder driver 24. As a result of blending light of red and blue colors in each segment, segments b and c illuminate in substantially purple color.

To illuminate display element 43 in blue-green color, the color control input BG is raised to a high logic level, while all remaining color control inputs are maintained at a low logic level. As a result, the outputs of OR gates 61*b* and 61*c* rise to a high logic level, thereby causing the outputs of buffers 62*b* and 62*c* to rise to a high logic level. The current flows from the output of buffer 62*b*, via green bus 6 and green LED 3*b*, to the output b of decoder driver 24, and, via green LED 3*c*, to the output c of decoder driver 24. The current also flows from the output of buffer 62*c*, via blue bus 7 and blue LED 4*b*, to the output b of decoder driver 24, and, via blue LED 4*c*, to the output c of decoder driver 24. As a result of blending light of green and blue colors in each segment, segments b and c illuminate in substantially blue-green color.

To illuminate display element 43 in white color, the color control input W is raised to a high logic level, while all remaining color control inputs are maintained at a low logic level. As a result, the outputs of OR gates 61*a*, 61*b*, and 61*c* rise to a high logic level, thereby causing the outputs of respective buffers 62*a*, 62*b*, and 62*c* to rise to a high logic level. The current flows from the output of buffer 62*a*, via red bus 5 and red LED 2*b*, to the output b of decoder driver 24, and, via red LED 2*c*, to the output c of decoder driver 24. The current also flows from the output of buffer 62*b*, via green bus 6 and green LED 3*b*, to the output b of decoder driver 24, and, via green LED 3*c*, to the output c of decoder driver 24. The current also flows from the output of buffer 62*c*, via blue bus 7 and blue LED 4*b*, to the output b of decoder driver 24, and, via blue LED 4*c*, to the output c of decoder driver 24. As a result of blending light of red, green, and blue colors in each segment, segments b and c illuminate in substantially white color.

Since the outputs of decoder driver 24 may be overloaded by driving a triad of LEDs in parallel in display element 43, rather than a single LED in a monochromatic display, it would be obvious to employ suitable buffers to drive respective color display segments (not shown).

Figure 19:
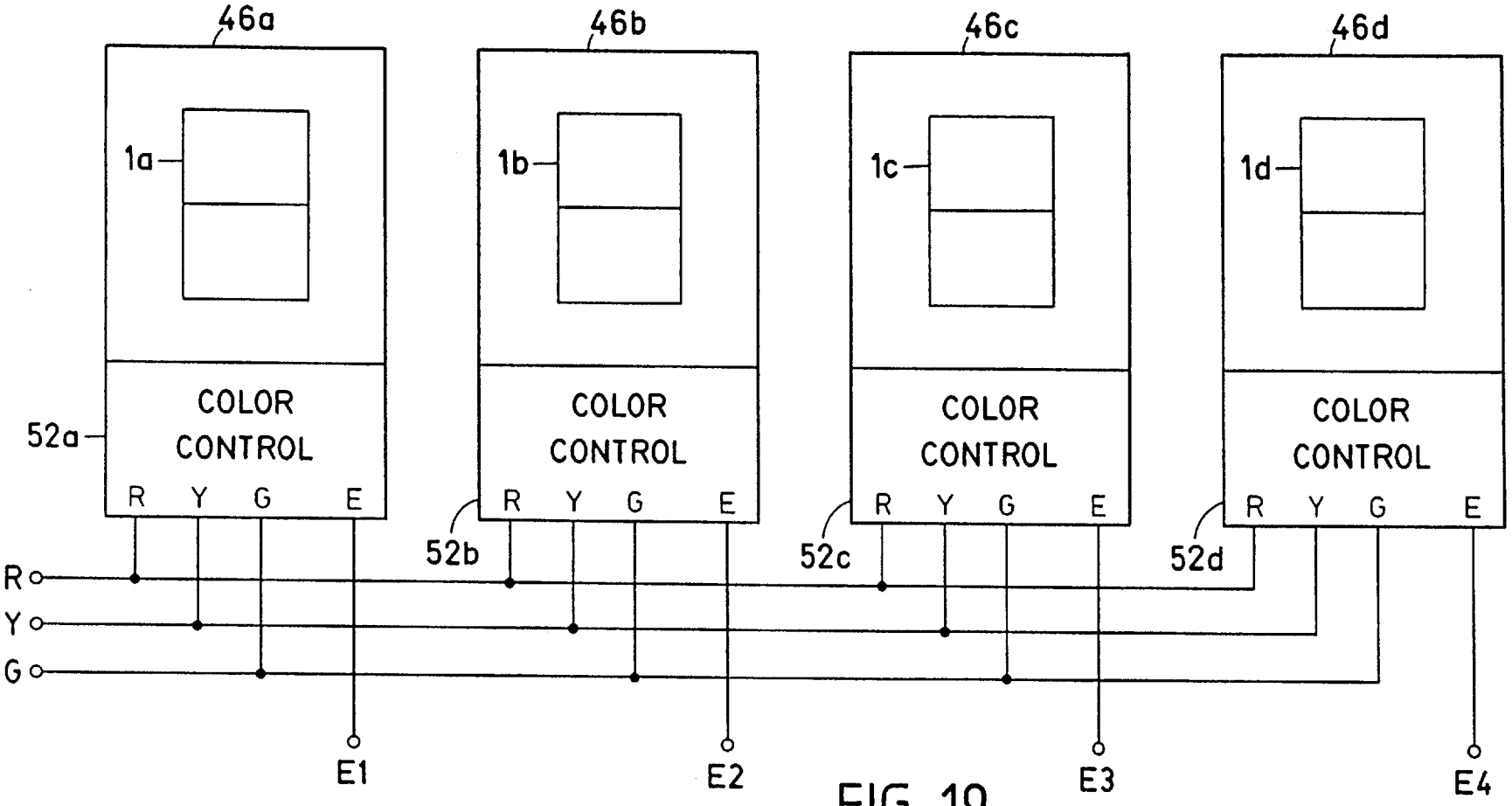
FIG. 19 PRIOR ART
FIG. 19 is a block diagram of 2-primary color 4-digit display.

To illustrate how the present invention can be utilized in a multi-element variable color display configuration, in FIG. 19 is shown a detail of the interconnection in a 2-primary color 4-digit display having display segments 1*a*, 1*b*, 1*c*, and 1*d* arranged in a 7-segment font. The color control inputs R, Y, and G of color controls 52*a*, 52*b*, 52*c*, and 52*d* of all display elements 46*a*, 46*b*, 46*c*, and 46*d* are interconnected, respectively, and enable inputs E1, E2, E3, and E4 are used to control the conditions of respective display elements 46*a*, 46*b*, 46*c*, and 46*d*. A high logic level at the enable input E extinguishes the particular display element 46*a*,. 46*b*, 46*c*, or 46*d*; a low logic level therein illuminates display element 46*a*, 46*b*, 46*c*, or 46*d* in a color determined by the instant conditions of the color control inputs R, Y, and G.

Figure 20:
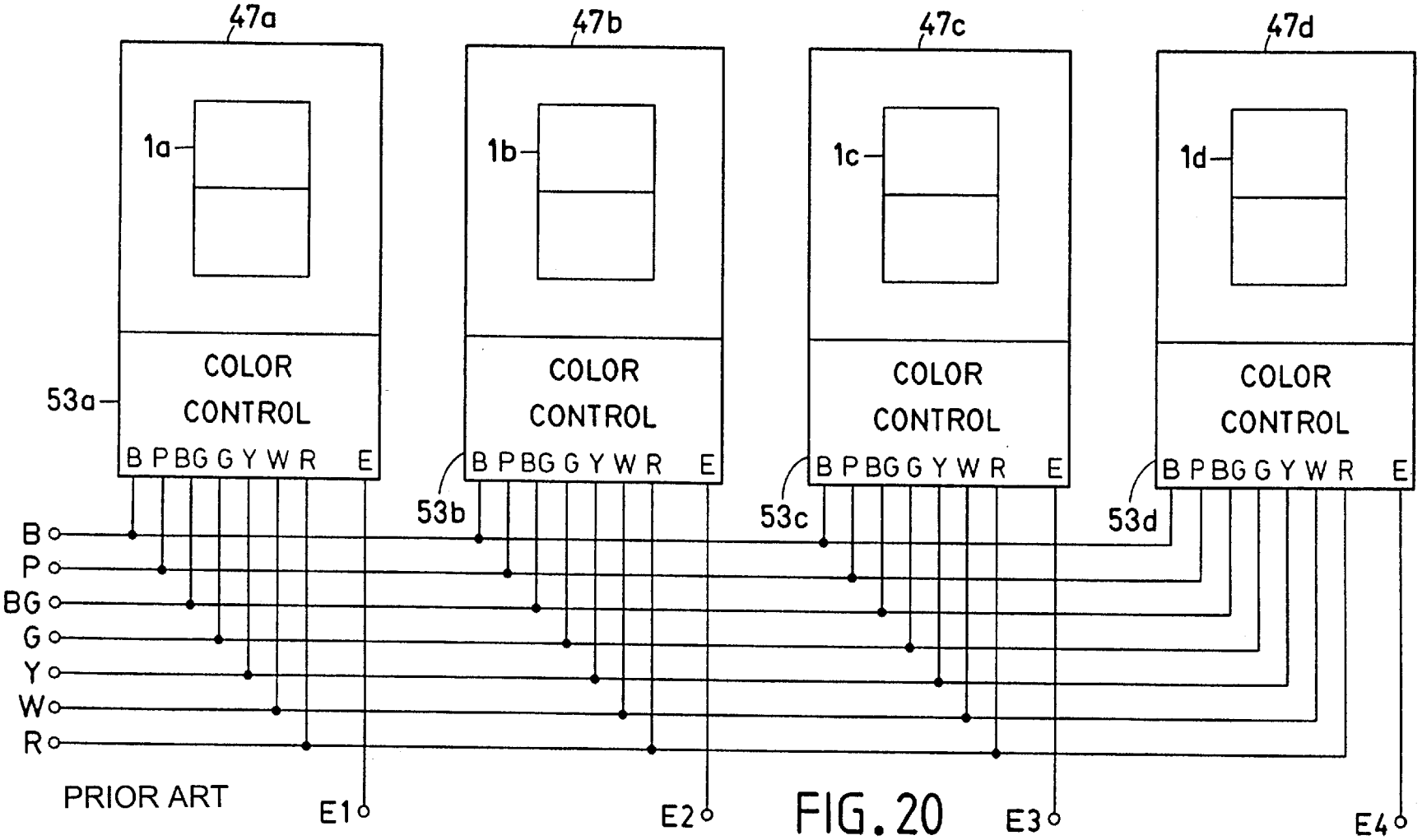
FIG. 20 PRIOR ART
FIG. 20 is a block diagram of 3-primary color 4-digit display.

In FIG. 20 is shown a like detail of the interconnection in a 3-primary color 4-digit display having display segments 1*a*, 1*b*, 1*c*, and 1*d* arranged in a 7-segment font. Similarly, the color control inputs B, P, BG, G, Y, W, and R of color controls 53*a*, 53*b*, 53*c*, and 53*d* of all display elements 47*a*,47*b*,47*c*, and 47*d* are interconnected, and the conditions of respective display elements 47*a*,47*b*,47*c*, and 47*d* are controlled by enable inputs E1, E2, E3, and E4. A high logic level at the enable input E extinguishes the particular display element 47*a*,47*b*,47*c*, or 47*d*; a low logic level therein illuminates display element 47*a*,47*b*,47*c*, or 47*d* in a color determined by the instant conditions of the color control inputs B, P, BG, G, Y, W, and R.

The exemplary color control circuits described herein will cooperate equally well with a multi-element variable color display constructed either in common cathodes or in common anodes configuration.

The enable inputs E1, E2, E3, E4 may be utilized to control the variable color multi-digit display in a multiplexed configuration, wherein the color codes for the display digits are presented in a sequence, one at a time, at a relatively fast rate, while the particular display digit is enabled.

In FIG. 21 is shown a block diagram of a signal converter for developing color control logic signals for 2-primary color display. The signal converter 85*a* accepts at its input voltage from a variable analog voltage source 11 and develops at its outputs color control logic signals R, Y, G, having relation to the magnitude of instant input analog voltage, for controlling the color of variable color display element 42, shown in FIGS. 11 and 15, in accordance with the magnitude of input voltage.

In FIG. 22 is shown a block diagram of a like signal converter for developing color control logic signals for 3-primary color display. The signal converter 85*b* accepts at its inputs voltage from source 11 and develops output color control logic signals B, P. BG, G. Y. W. R. related to the magnitude of instant input analog voltage, for controlling the color of variable color display element 43, shown in FIGS. 12 and 16, in accordance with the magnitude of input voltage.

In FIG. 23, the output voltage of variable analog voltage source 11 is applied to interconnected inputs of two analog comparators 82*a*, 82*b*, in a classic 'window' comparator configuration. When the voltage developed by source 11 is lower than the low voltage limit Vlo, set by a potentiometer 92*a*, the output of comparator 82*a* drops to a low logic level, thereby forcing the output of inverter 65*a* to rise to a high logic level, to activate the color control logic input Y, to thereby illuminate display element 42, shown in FIGS. 11 and 15, in yellow color.

When the voltage developed by source 11 is higher than the high voltage limit Vhi, set by a potentiometer 92*b*, the output of comparator 82*b*. drops to a low logic level, thereby forcing the output of inverter 65*b* to rise to a high logic level, to activate the color control logic input R, to thereby illuminate display element 42 in red color.

When the voltage developed by source 11 is between the low voltage limit Vlo and high voltage limit Vhi, the outputs of comparators 82*a*, 82*b* rise to a high logic level, thereby causing the output of AND gate 66 to rise to a high logic level, to activate the color control logic input G, to thereby illuminate display element 42 in green color.

FIG. 24 is a graph depicting the relationship between the input voltage of the comparator circuit shown in FIG. 23 and the color of the display element shown in FIG. 11. The display element illuminates in yellow color for the input voltage lower than the limit Vlo, in green color for the input voltage between the limits Vlo and Vhi, and in red color for the input voltage higher than the limit Vhi.

Figure 25:
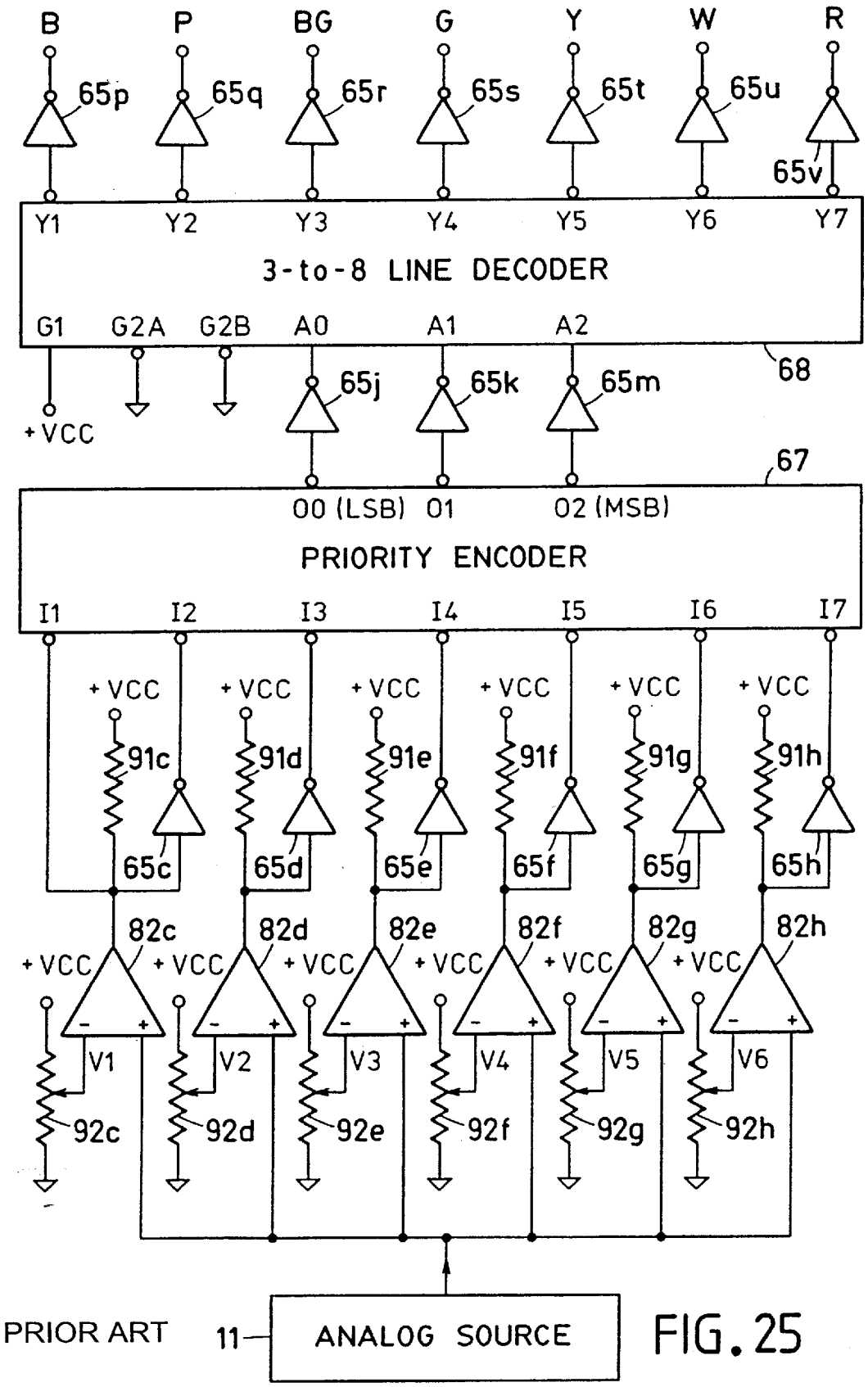
PRIOR ART FIG. 25
FIG. 25 is a schematic diagram of a comparator circuit for 3-primary color display.

In FIG. 25, the output voltage of variable analog voltage source 11 is applied to interconnected '+' inputs of six analog comparators 82*c*, 82*d*, 82*e*, 82*f*, 82*g*, 82*h*, connected in a well known 'multiple aperture window' configuration.

There are six progressively increasing voltage limits V1 to V6, set by respective potentiometers 92*c* to 92*h*. The outputs of comparators 82*c* to 82*h* are respectively connected, via inverters 65*c* to 65*h*, to the inputs I1 to I7 of a priority encoder 67. Each of the inputs I1 to I7 has assigned a certain priority (from I1 being the lowest priority progressively to I7 being the highest one). The priority encoder 67 develops at its outputs 00, 01, 02 a code identifying the highest priority input activated. The outputs of encoder 67 are respectively connected, via inverters 65*j* to 65*m*, to the inputs A0, A1, A2 of a 3-to-8 line decoder 68, to decode the outputs of encoder 67 into seven mutually exclusive active logic low outputs Y1 to Y7. The outputs Y1 to Y7 are respectively connected, via inverters 65*p* to 65*v*, to the color control logic inputs B, P, BG, G, Y, W, R of display element 43 shown in FIGS. 12 and 16.

When the output voltage of source 11 is lower than the lowest voltage limit V1, the output of comparator 82*c* drops to a low logic level, thereby activating the input I1 of priority encoder 67. The code 110 developed at the outputs 00, 01, 02 is inverted by inverters 65*j* to 65*m* to yield the code 001 which produces a low logic level at the output Y1, to force, via inverter 65*p*, the color control input B to a high logic level for causing display element 43 to illuminate in blue color.

When the output voltage of the source 11 is between the adjacent voltage limits, e. g., V4 and V5, the output of comparator 82*f* rises to a high logic level, thereby activating the input I5 of priority encoder 67. The code 100 developed at the inputs of decoder 68 produces a high logic level at the color control logic input Y, and display element 43 illuminates in yellow color.

FIG. 26 is a graph depicting the relationship between the input voltage of the comparator circuit shown in FIG. 25 and the color of display element 42 shown in FIG. 12. The display element illuminates in blue color for the input voltage lower than the limit V1, in purple color for the input voltage between the limits V1 and V2, in blue-green color for the input voltage between the limits V2 and V3, in green color for the input voltage between the limits V3 and V4, in yellow color for the input voltage between the limits V4 and V5, in white color for the input voltage between the limits V5 and V6, and in red color for the input voltage higher than the limit V6.

It would be obvious to those having ordinary skill in the art, in the view of this disclosure, that the color sequences could be readily changed by differently interconnecting the outputs of the comparator circuit with the color control logic inputs of display element 43.

Continuously Variable Color Converter

FIG. 27 is a block diagram of a 2-LED continuously variable color display system, which includes a device 10 for developing electric signals and 2-LED color converter 57 for controlling red bus 5 and green bus 6, respectively, of 2-LED variable color display element 42 in accordance with the electric signals.

FIG. 28 is a block diagram of a 3-LED continuously variable color display system which differs from the like system shown in FIG. 27 in that a 3-LED color converter circuit 58 is utilized to control red bus 5, green bus 6, and blue bus 7, respectively, of 3-LED variable color display element 43, in accordance with the electric signals developed by device 10.

The display system shown in FIG. 29 utilizes a scaling circuit 80*a* which scales input analog voltage levels to a voltage range suitable for an A/D converter 74*a*, which in turn develops at its outputs a digital code having relation to the value of the input analog voltage. The output lines of A/D converter 74*a* are connected to the address inputs of a memory 76 having a plurality of addressable locations which contain data indicating the portions of red color for several different values of the input analog voltage. The output data of memory 76 are applied to the inputs of a color converter 57 which will develop control signals for red bus 5 and green bus 6, respectively, of variable color display element 42.

The display system shown in FIG. 30 utilizes a scaling circuit 80*b* and an A/D converter 74*b* for converting the instant value of an input analog voltage to a digital code. The outputs of A/D converter 74*b* are connected, in parallel, to the address inputs of memory 76*a*, which contains data indicating the portions of red color, to the address inputs of memory 76*b*, which contains data indicating the portions of green color, and to the address inputs of memory 76*c*, which contains data indicating the portions of blue color. The output data of memory 76*a* are applied to red color converter 59*a* which will develop control signals for red bus 5 of variable color display element 43. The output data of memory 76*b* are applied to green color converter 59*b* which will develop control signals for green bus 6 of display element 43. The output data of memory 76*c* are applied to blue color converter 59*c* which will develop control signals for blue bus 7 of display element 43.

Figure 31:
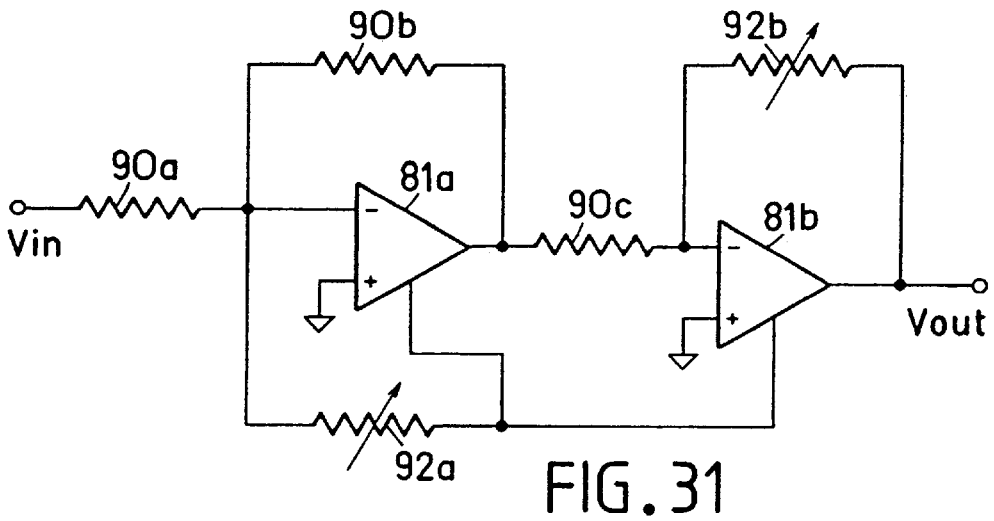
FIG. 31 PRIOR ART
FIG. 31 is a schematic diagram of a scaling circuit.

FIG. 31 is a schematic diagram of a scaling circuit capable of shifting and amplifying the input voltage levels. The circuit utilizes two operational amplifiers 81*a* and 81*b* in a standard inverting configuration. The amplifier 81*a* is set for a unity gain by using resistors 90*a* and 90*b* of equal values; potentiometer 92*a* is adjusted to set a desired offset voltage. The amplifier 81*b* sets the gain by adjusting feedback potentiometer 92*b* to a desired value with respect to resistor 90*c*. As a result, an input voltage, which may vary between arbitrary limits Vlow and Vhigh, may be scaled and shifted to the range between 0 Volts and 9.961 Volts, to facilitate the use of a commercially available A/D converter.

Figure 32:
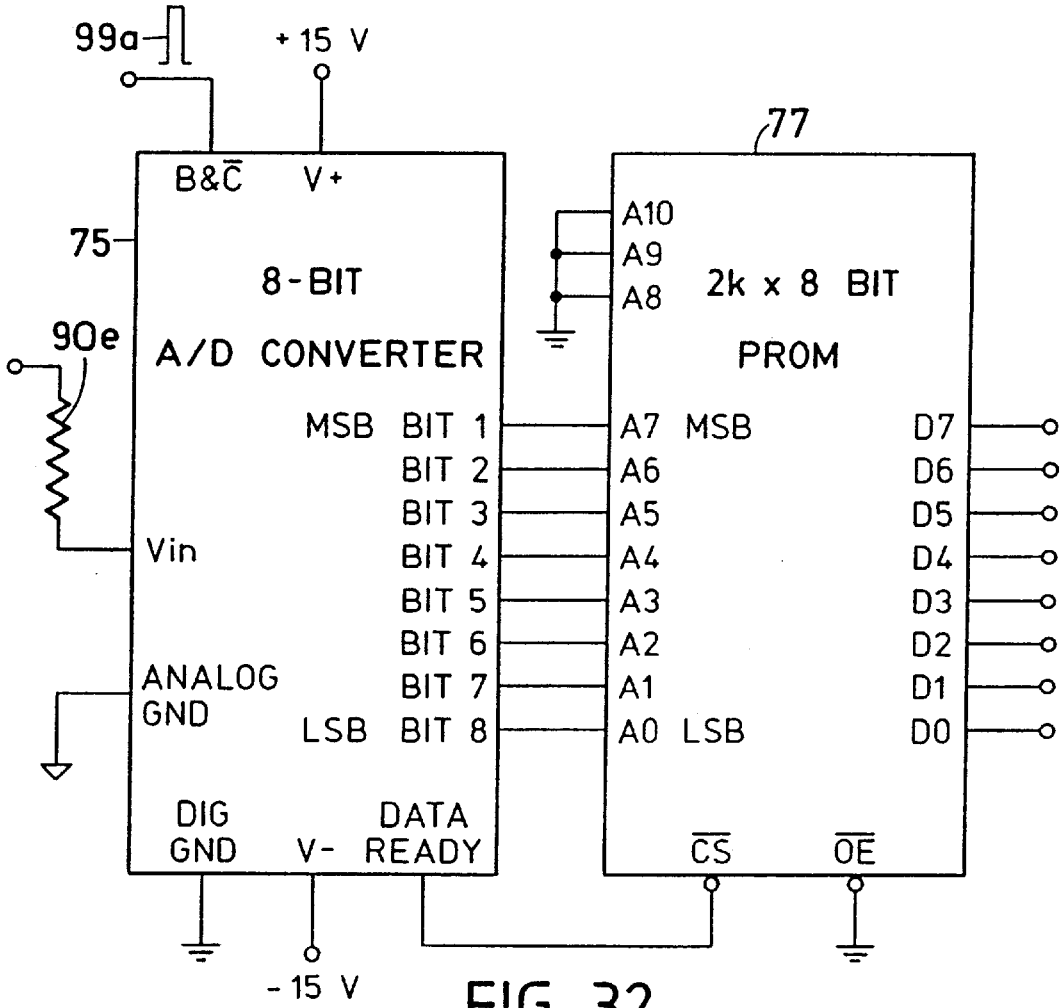
FIG. 32 PRIOR ART
FIG. 32 is a schematic diagram of an A/D converter and memory combination of FIGS. 29 and 30.

FIG. 32 is a schematic diagram of an A/D (analog-to-digital) converter 75 which is capable of converting input analog voltage, applied via resistor 90*e* to its input Vin, to 8-bit digital data for addressing a memory 77. The conversion may be initiated from time to time by applying a short positive pulse 99*a* to the Blank and Convert input B&C. A/D converter 75 will thereafter perform a conversion of the instant input voltage to 8-bit data indicative of its value. When the conversion is completed, the Data Ready output DR drops to a low logic level, thereby indicating that the data are available at the outputs Bit 1 to Bit 8, which are directly connected to respective address inputs A0 to A7 of memory 77. When the DR output drops to a low logic level, the Chip Select input CS of memory 77 is activated, memory 77 is enabled, and the data, residing at the address selected by the instant output of A/D converter 75, will appear at its data outputs D0 to D7.

Figure 33:
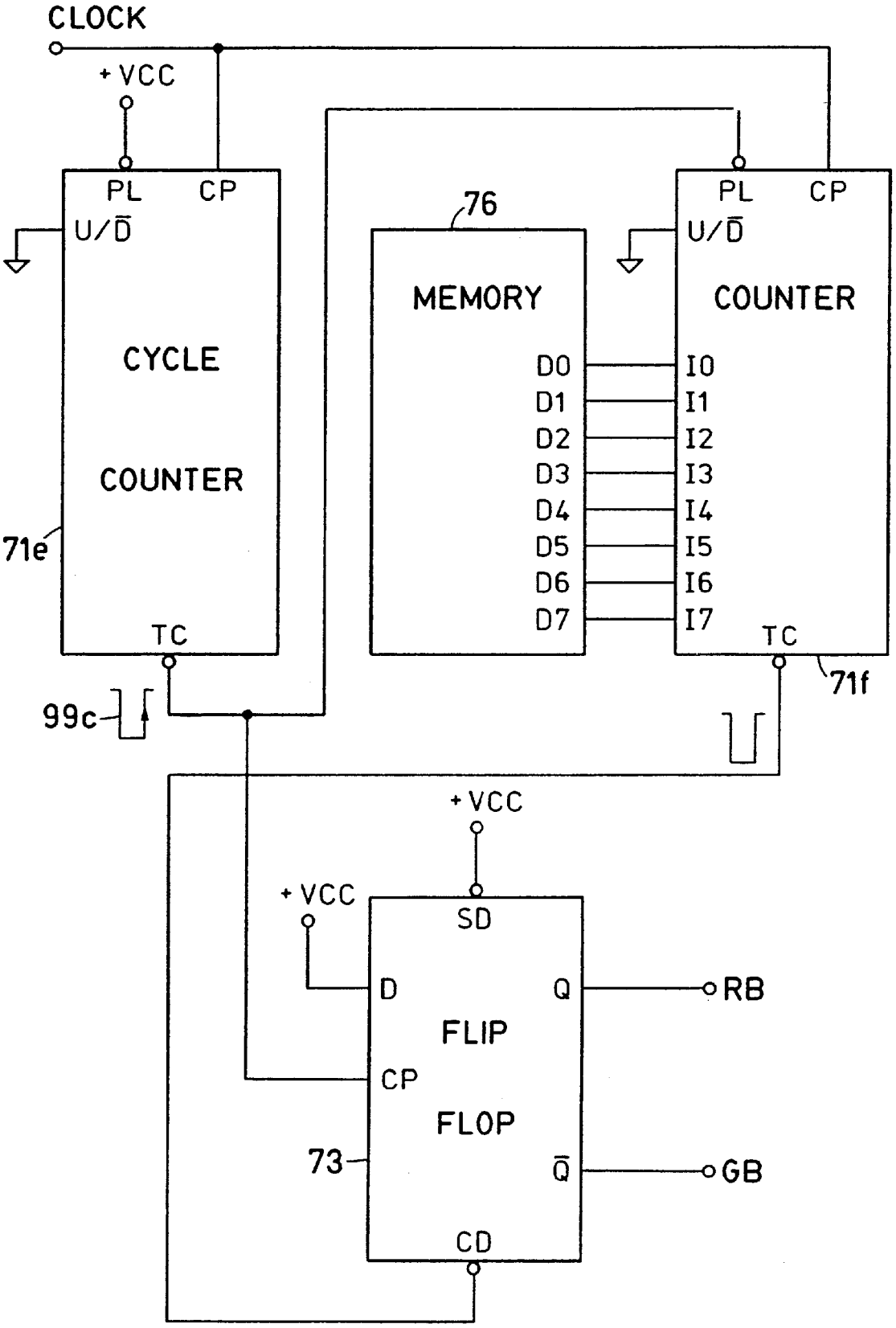
FIG. 33 is a schematic diagram of a memory and color converter combination of FIG. 29.
Figure 34:
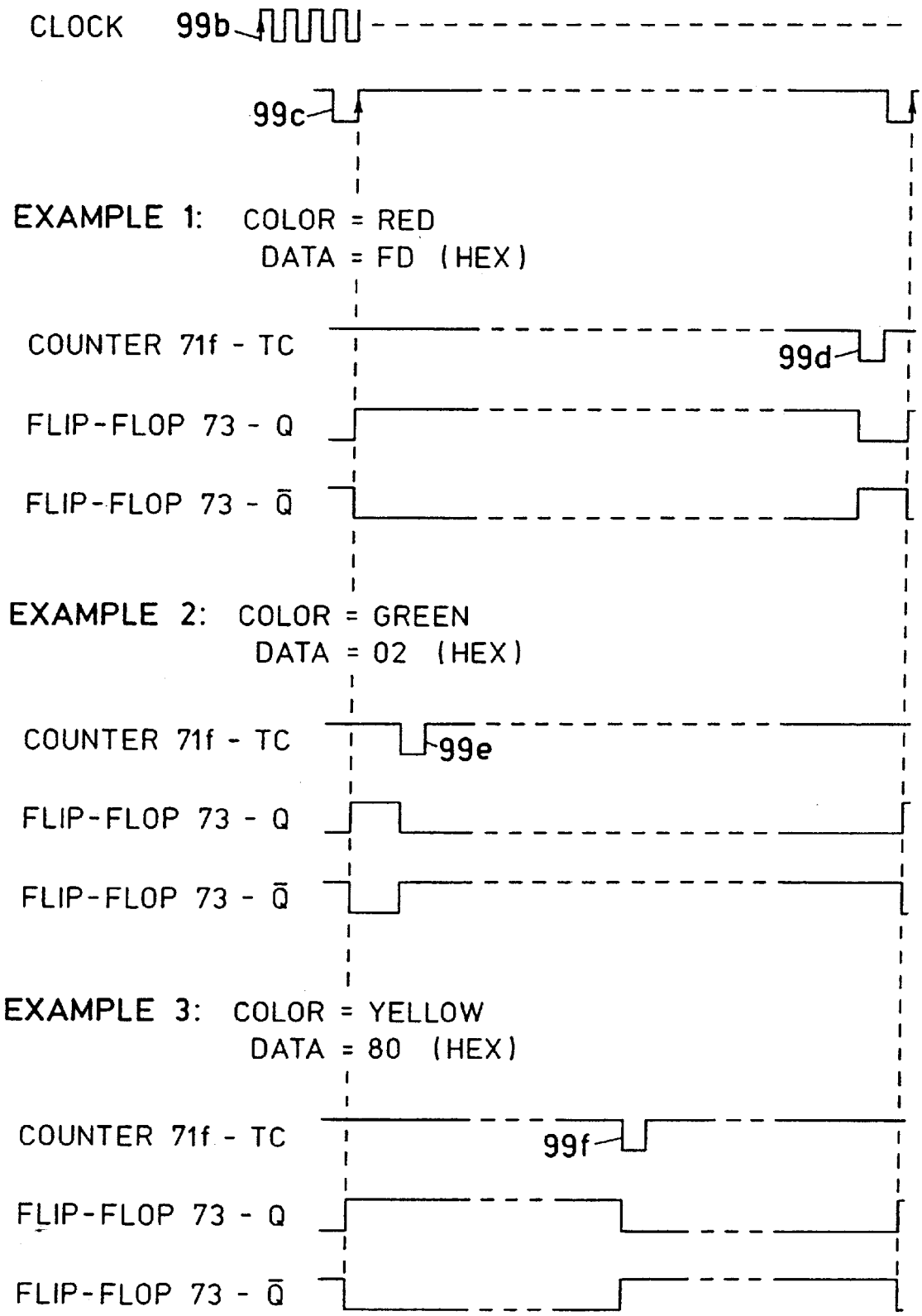
FIG. 34 is a timing diagram of the circuit shown in FIG. 33.

The description of the schematic diagram in FIG. 33 should be considered together with its accompanying timing diagram shown in FIG. 34. A clock signal 99*b* of a suitable frequency (e. g., 10 kHz), to provide a flicker-free display, is applied to the Clock Pulse inputs CP of 8-bit binary counters 71*e* and 71*f* to step them down. At the end of each counter cycle, which takes 256 clock cycles to complete, the Terminal Count output TC of counter 71*e* drops to a low logic level for one clock cycle, to thereby indicate that the lowest count was reached. The negative pulse 99*c* at the TC output of counter 71*e*, which is connected to the Parallel Load input PL of counter 71*f*, causes the instant data at the outputs of memory 76 to be loaded into counter 71*f*. The data at memory 76 represent the portion of red color; the portion of green color is complementary. The rising edge of the TC pulse 99*c* triggers flip-flop 73 into its set condition wherein its output Q rises to a high logic level.

The counter 71*f* will count down, from the loaded value, until it reaches zero count, at which moment its TC output drops to a low logic level. The negative pulse at the TC output of counter 71*f*, which is connected to the Clear Direct input CD of flip-flop 73, causes the latter to be reset and to remain in its reset condition until it is set again at the beginning of the next 256-count cycle. It is thus obvious that the Q output of flip-flop 73 is at a high logic level for a period of time proportional to the data initially loaded into counter 71*f*. The complementary output $\overline{Q}$ is at a high logic level for a complementary period of time.

The Q and $\overline{Q}$ outputs of flip-flop 73 are connected to red bus 5 and green bus 6, respectively, via suitable buffers 63*a* and 63*b*, shown in detail in FIG. 11, to respectively energize red bus 5 and green bus 6 for variable time periods, depending on the data stored in memory 76.

By referring now, more particularly, to the timing diagram shown in FIG. 34, in which the waveforms are compressed to facilitate the illustration, the EXAMPLE 1 considers the memory data 'FD', in a standard hexadecimal notation, to generate light of substantially red color. At the beginning of the counter cycle, pulse 99*c* loads data 'FD' into counter 71*f*. Simultaneously, flip-flop 73 is set by the rising edge of pulse 99*c*. The counter 71*f* will be thereafter stepped down by clock pulses 99*b*, until it reaches zero count, 2 clock cycles before the end of the counter cycle. At that instant a short negative pulse 99*d* is produced at its output TC to reset flip-flop 73, which will remain reset for 2 clock cycles and will be set again by pulse 99*c* at the beginning of the next counter cycle, which will repeat the process. It is readily apparent that flip-flop 73 was set for 254 clock cycles, or about 99% of the time, and reset for 2 clock cycles, or about 1% of the time. Accordingly, red bus 5 of display element 42 is energized for about 99% of the time, and green bus 6 is energized for the remaining about 1% of the time. As a result, display element 42 illuminates in substantially red color.

The EXAMPLE 2 considers the memory data '02' (HEX) to generate light of substantially green color. At the beginning of the counter cycle, data '02' are loaded into counter 71*f*, and, simultaneously, flip-flop 73 is set. The counter 71*f* will count down and will reach zero count after 2 clock cycles. At that instant it produces at its output TC a negative pulse 99*e* to reset flip-flop 73. It is readily apparent that flip-flop 73 was set for 2 clock cycles, or about 1% of the time, and reset for 254 clock cycles, or about 99% of the time. Accordingly, red bus 5 of display element 42 is energized for about 1% of the time, and green bus 6 is energized for the remaining about 99% of the time. As a result, display element 42 illuminates in substantially green color.

The EXAMPLE 3 considers the memory data '80' (HEX) to generate light of substantially yellow color. At the beginning of the counter cycle, data '80' are loaded into counter 71*f*, and, simultaneously, flip-flop 73 is set. The counter 71*f* will count down and will reach zero count after 128 clock cycles. At that instant it produces at its output TC a negative pulse 99*f* to reset flip-flop 73. It is readily apparent that flip-flop 73 was set for 128 clock cycles, or about 50% of the time, and reset for 128 clock cycles, or about 50% of the time. Accordingly, red bus 5 of display element 42 is energized for about 50% of the time, and green bus 6 is energized for the remaining about 50% of the time. As a result of blending substantially equal portions of red and green colors, display element 42 illuminates in substantially yellow color.

Figure 35:
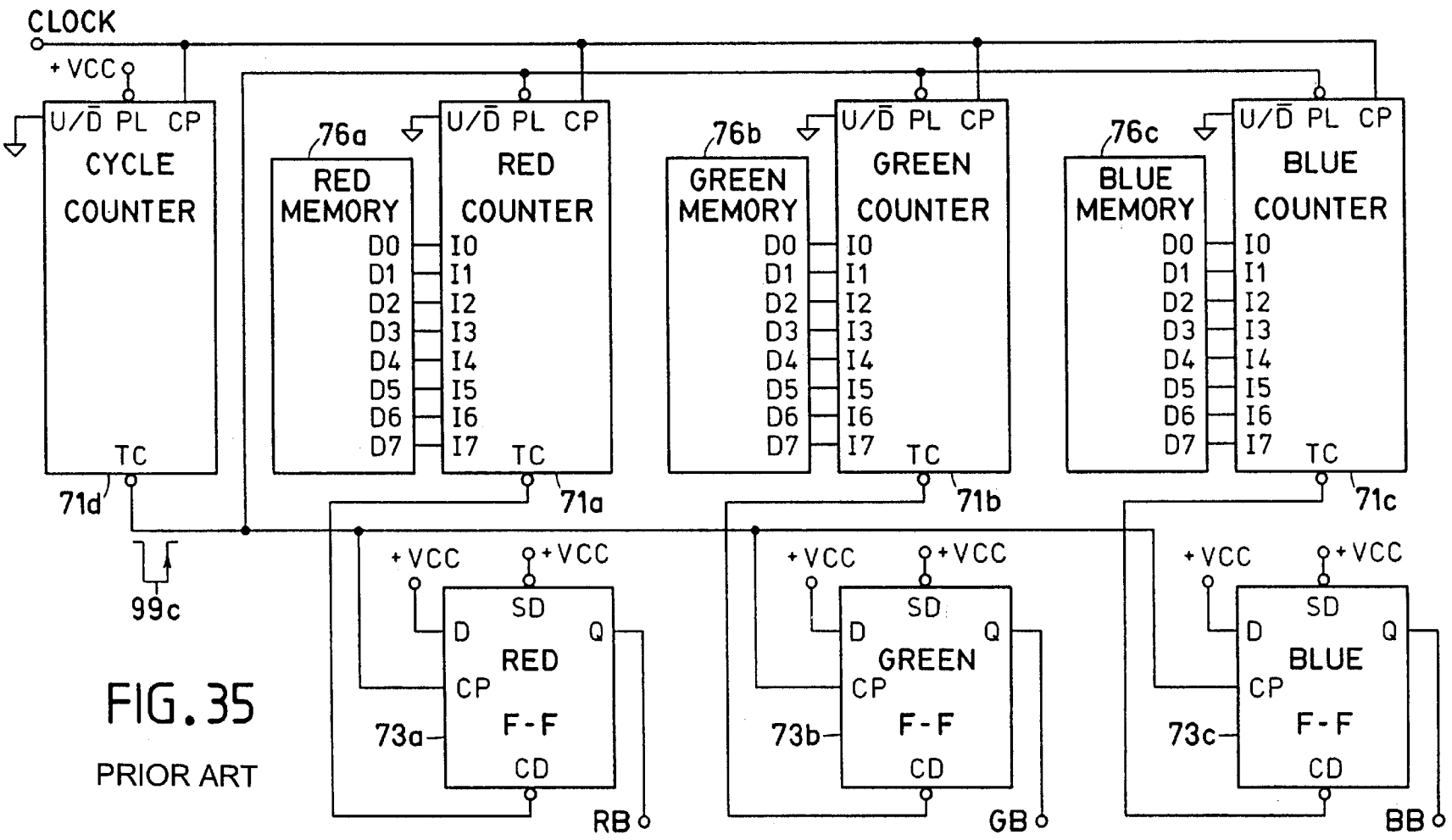
FIG. 35 PRIOR ART
FIG. 35 is a schematic diagram of a memory and color converter combination of FIG. 30.
Figure 36:
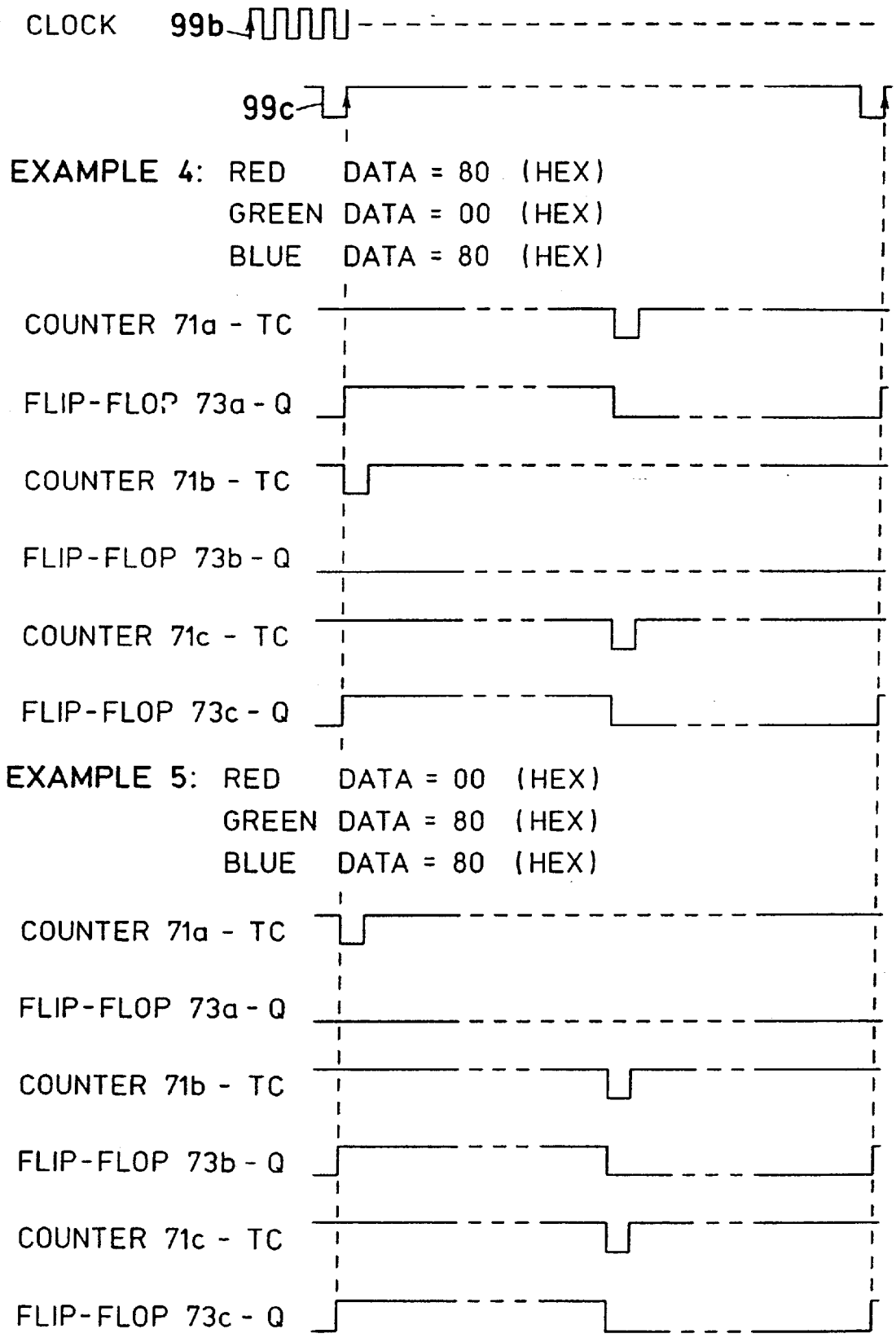
FIG. 36 is a timing diagram of the circuit shown in FIG. 35.
Figure 37:
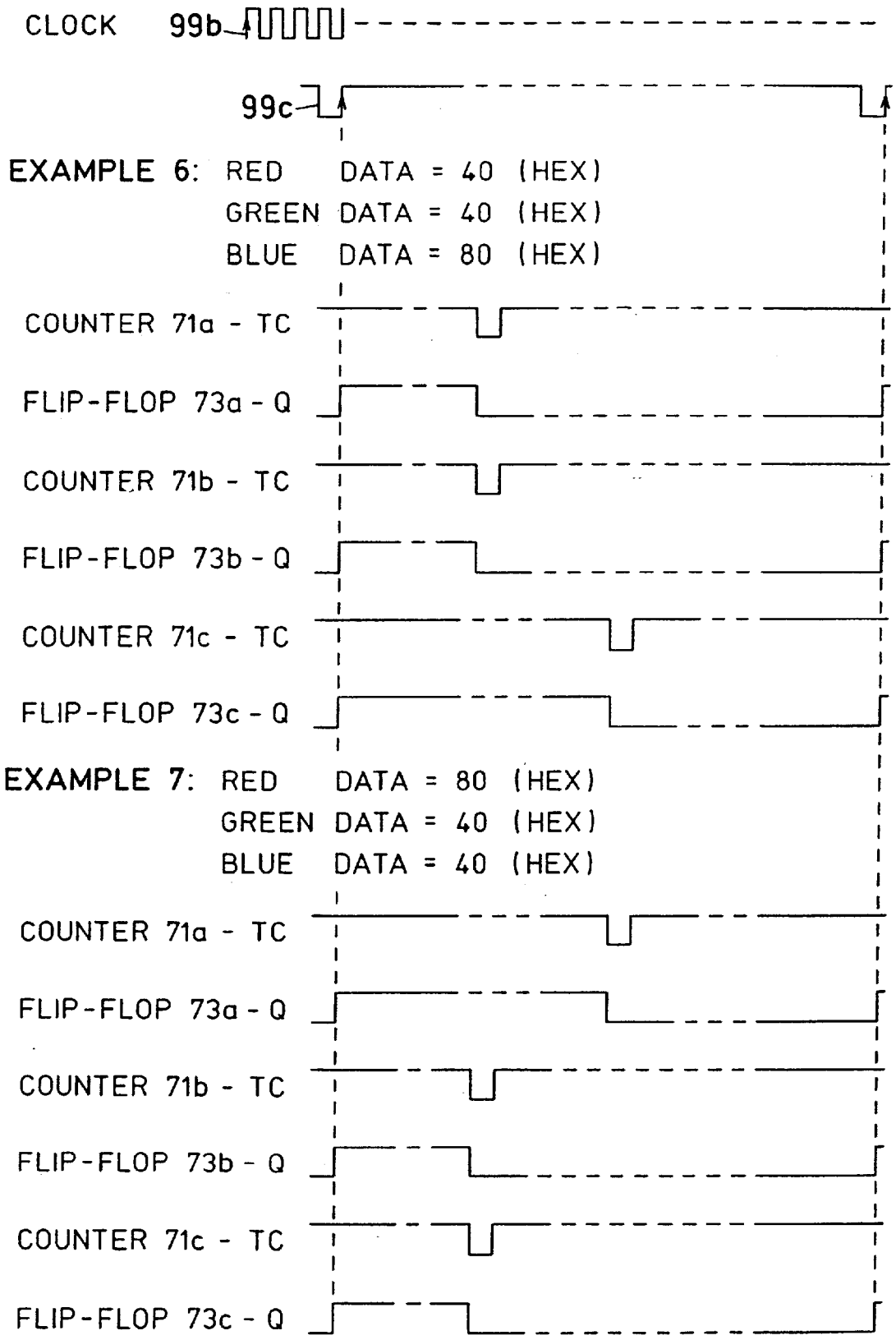
FIG. 37 is a continuation of the timing diagram of FIG. 36.

The description of the schematic diagram of a 3-LED color converter in FIG. 35 should be considered together with its accompanying timing diagrams shown in FIGS. 36 and 37. A clock signal 99*b* is applied to the CP inputs of counters 71*d*, 71*a*, 71*b*, and 71*c* to step them down. Every 256 counts a negative pulse 99*c* is generated at the TC output of counter 71*d*, to load data into counters 71*a*, 71*b*, and 71*c* from respective memories 76*a*, 76*b*, and 76*c*, and to set flip-flops 73*a*, 73*b*, and 73*c*. The data in red memory 76*a* represent the portions of red color, the data in green memory 76*b* represent the portions of green color, and the data in blue memory 76*c* represent the portions of blue color to be blended.

The counters 71*a*, 71*b*, and 71*c* will count down, from the respective loaded values, until zero counts are reached. When the respective values of the loaded data are different, the length of time of the count-down is different for each counter 71*a*, 71*b*, and 71*c*. When a particular counter 71*a*, 71*b*, or 71*c* reaches zero count, its TC output momentarily drops to a low logic level, to reset its associated flip-flop (red counter 71*a* resets its red flip-flop 73*a*, green counter 71*b* resets its associated green flip-flop 73*b*, and blue counter 71*c* resets its associated blue flip-flop 73*c*). Eventually, all three flip-flops 73*a*, 73*b*, and 73*c* will be reset. The Q outputs of flip-flops 73*a*, 73*b*, and 73*c* are connected to red bus 5, green bus 6, and blue bus 7, respectively, via suitable buffers 62*a*, 62*b*, and 62*c*, as shown in FIG. 12, to respectively energize red bus 5, green bus 6, and blue bus 7 for variable periods of time.

By referring now more particularly to the timing diagram shown in FIGS. 36 and 37, the EXAMPLE 4 considers red memory data '80', green memory data '00', and blue memory data '80', all in hexadecimal notation, to generate light of substantially purple color. At the beginning of the counter cycle, pulse 99*c* simultaneously loads data '80' from red memory 76*a* into red counter 71*a*, data '00' from green memory 76*b* into green counter 71*b*, and data '80' from blue memory 76*c* into blue counter 71*c*. The counters 71*a*, 71*b*, and 71*c* will be thereafter stepped down. The red counter 71*a* will reach its zero count after 128 clock cycles; green counter 71*b* will reach its zero count immediately; blue counter 71*c* will reach its zero count after 128 clock cycles.

It is readily apparent that red flip-flop 73*a* was set for 128 clock cycles, or about 50% of the time, green flip-flop 73*b* was never set, and blue flip-flop 73*c* was set for 128 clock cycles, or about 50% of the time. Accordingly, red bus 5 of display element 43 is energized for about 50% of the time, green bus 6 is never energized, and blue bus 7 is energized for about 50% of the time. As a result of blending substantially equal portions of red and blue colors, display element 43 illuminates in substantially purple color.

The EXAMPLE 5 considers red memory data '00', green memory data '80', and blue memory data '80', to generate light of substantially blue-green color. At the beginning of the counter cycle, data '00' are loaded into red counter 71*a*, data '80' are loaded into green counter 71*b*, and data '80' are loaded into blue counter 71*c*. The red counter 71*a* will reach its zero count immediately, green counter 71*b* will reach its zero count after 128 clock periods, and so will blue counter 71*c*.

The red flip-flop 73*a* was never set, green flip-flop 73*b* was set for 128 clock pulses, or about 50% of the time, and so was blue flip-flop 73*c*. Accordingly, green bus 6 of display element 43 is energized for about 50% of the time, and so is blue bus 7. As a result, display element 43 illuminates in substantially blue-green color.

The EXAMPLE 6 considers red memory data '40', green memory data '40', and blue memory data '80', to generate light of substantially cyan color. At the beginning of the counter cycle, the data '40' are loaded into red counter 71*a*, data '40' are loaded into green counter 71*b*, and data '80' are loaded into blue counter 71*c*. The red counter 71*a* will reach its zero count after 64 clock cycles, and so will green counter 71*b*. The blue counter 71*c* will reach its zero count after 128 clock cycles.

The red flip-flop 73*a* was set for 64 clock cycles, or about 25% of the time, and so was green flip-flop 73*b*. The blue flip-flop 73*c* was set for 128 clock cycles, or about 50% of the time. Accordingly, red bus 5 and green bus 6 of display element 43 are energized for about 25% of the time, and blue bus 7 is energized for about 50% of the time. As a result of blending about 50% of blue color, 25% of red color, and 25% of green color, display element 43 illuminates in substantially cyan color.

The EXAMPLE 7 considers red memory data '80', green memory data '40', and blue memory data '40', to generate light of substantially magenta color. At the beginning of the counter cycle, the data '80' are loaded into red counter 71*a*, data '40' are loaded into green counter 71*b*, and data '40' are loaded into blue counter 71*c*. The red counter 71*a* will reach its zero count after 128 clock cycles, green counter 71*b* will reach its zero count after 64 clock cycles, and so will blue counter 71*c*.

The red flip-flop 73*a* was set for 128 clock cycles, or about 50% of the time, green flip-flop 73*b* and blue flip-flop 73*c* were set for 64 clock cycles, or about 25% of the time. Accordingly, red bus 5 of display element 43 is energized for about 50% of the time, green bus 6 and blue bus 7 are energized for about 25% of the time. As a result, display element 43 illuminates in substantially magenta color.

Figure 38:
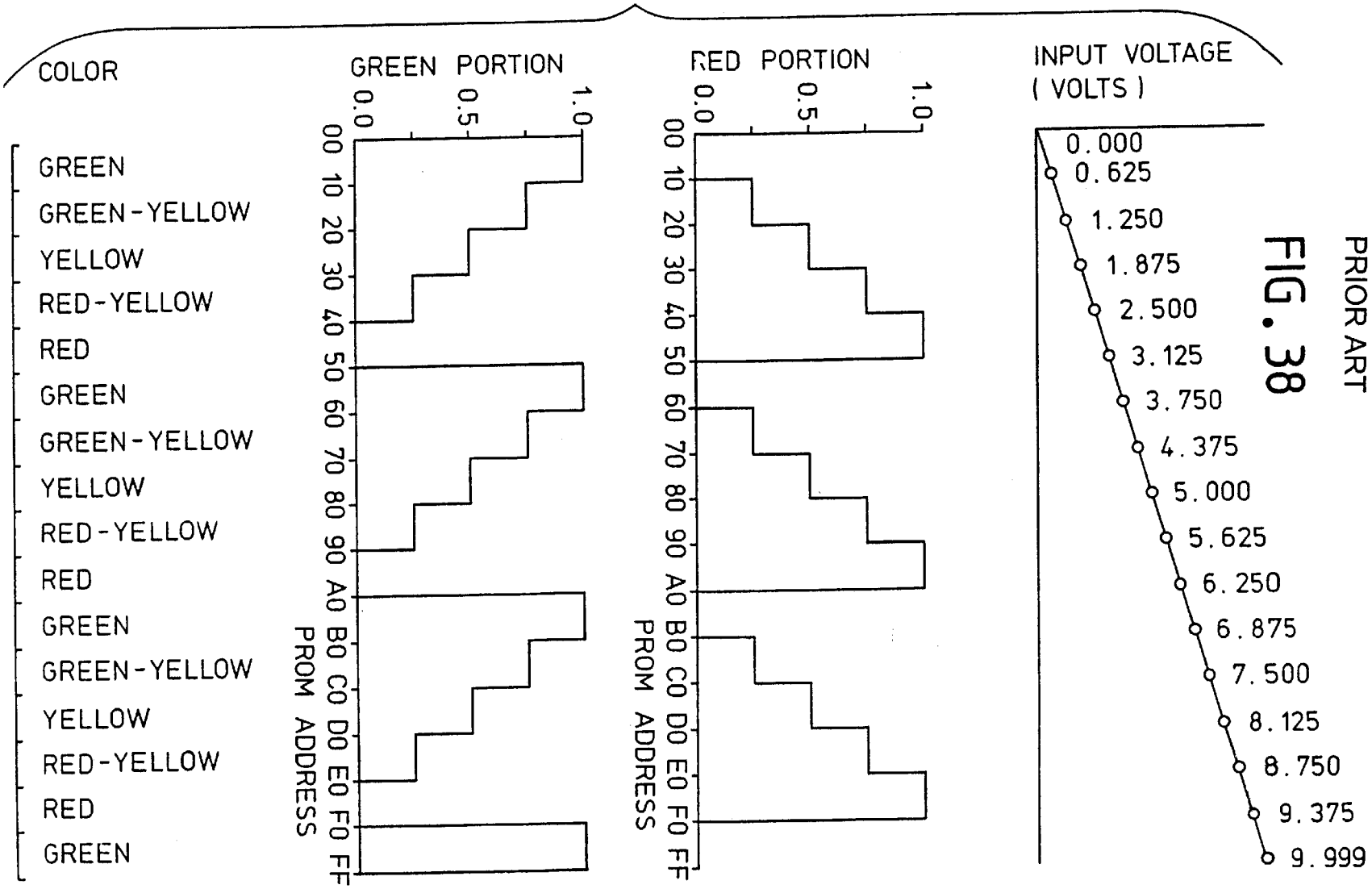
PRIOR ART FIG. 38
FIG. 38 is a graphic representation of TABLE 1.
Figure 39:
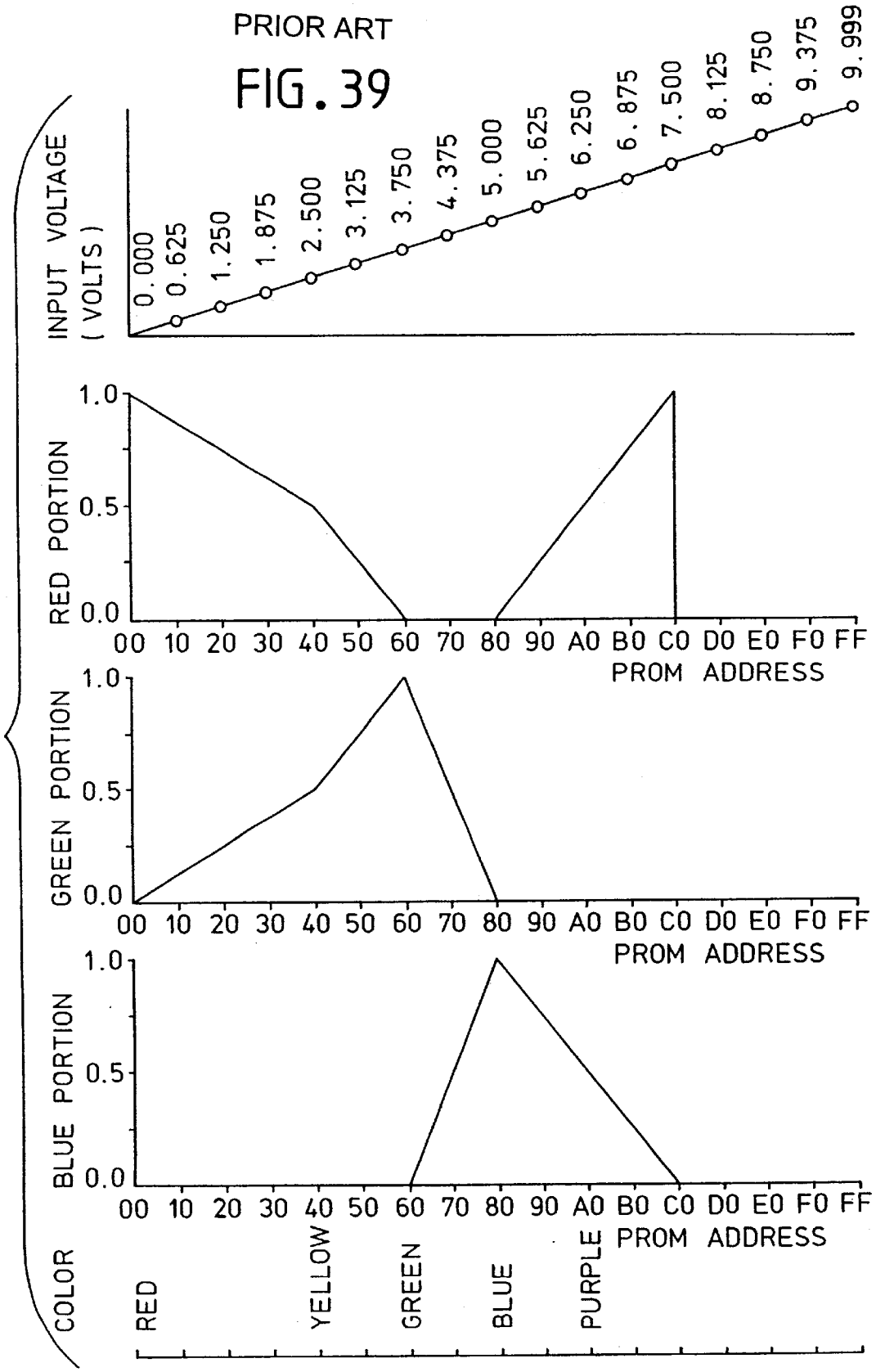
PRIOR ART FIG. 39
FIG. 39 is a graphic representation of TABLE 2.

By referring now more particularly to FIGS. 38 and 39, which are graphic representations of TABLES 1 and 2, respectively, the data at each memory address are digital representation of the portion of the particular primary color. All examples consider an 8-bit wide PROM (Programmable Read Only Memory) . However, the principles of the invention could be applied to other types of memories.

In FIG. 38, RED PORTION indicates the portion of red primary color; GREEN PORTION indicates the portion of green primary color. The RED PORTION for a particular memory address was calculated by dividing the actual value of data residing at that address by the maximum possible data 'FF' (HEX) . The GREEN PORTION for the same memory address is complementary; it was obtained by subtracting the calculated value of the RED PORTION from number 1.0.

In FIG. 38 is shown the characteristic of a 2-primary color converter, defined in TABLE 1, for developing color variable in steps: pure green for input voltages less than 0.625 V, substantially yellow for voltages between 1.25 V and 1.875 V, pure red for voltages between 2.5 V and 3.125 V, and of intermediate colors therebetween, this sequence being repeated three times over the voltage range.

In FIG. 39, RED PORTION indicates the portion of red primary color; GREEN PORTION indicates the portion of green primary color; BLUE PORTION indicates the portion of blue primary color. The RED PORTION for a particular memory address was calculated by dividing the value of red data residing at such address by the maximum possible data 'FF' (HEX). Similarly, the GREEN PORTION for that memory address was obtained by dividing the value of green data by 'FF' (HEX) . The BLUE PORTION was obtained by dividing the value of blue data by 'FF' (HEX).

In FIG. 39 is shown the characteristic of 3-primary color converter, defined in TABLE 2, for developing color continuously variable from pure red, through substantially orange and yellow, pure green, pure blue, to substantially purple, in a rainbow-like fashion.

In the examples of the characteristics of color converters shown in TABLE 1 and TABLE 2, the data values stored in red memory 76*a*, green memory 76*b*, and blue memory 76*c* are so designed that the sums of the red data, green data, and blue data are constant for all memory addresses, to provide uniform light intensities for all colors. It is further contemplated that data stored in red memory 76*a*, green memory 76*b*, and blue memory 76*c* may be modified, in order to compensate for different efficiencies of red, green, and blue LEDs. By way of an example, data values for a low efficiency LED may be proportionally incremented such that the time of energization is proportionally increased, to effectively provide equal luminances for LEDs of unequal efficiencies.

Figure 40:
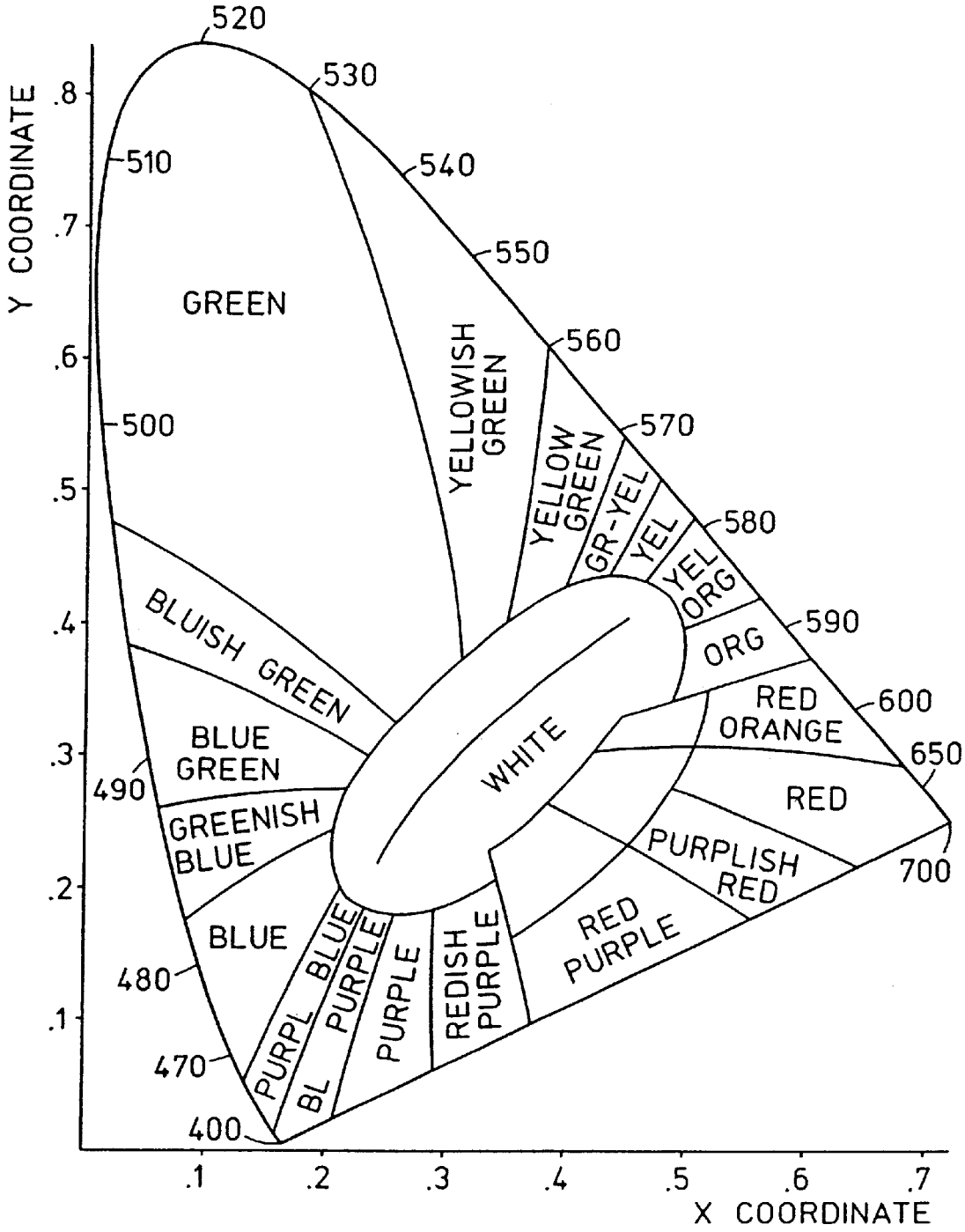
FIG. 40 PRIOR ART
FIG. 40 is a graph of the ICI chromaticity diagram.

With reference to FIG. 40 there is shown the ICI (International Committee on Illumination) chromaticity diagram designed to specify a particular color in terms of x and y coordinates. Pure colors are located along the horseshoe-like periphery. Reference numbers along the periphery indicate wavelength in nanometers. When relative portions of three primary colors are known, the color of light produced by blending their emissions can be determined by examining the x and y values of ICI coordinates.

Figures 41, 42:
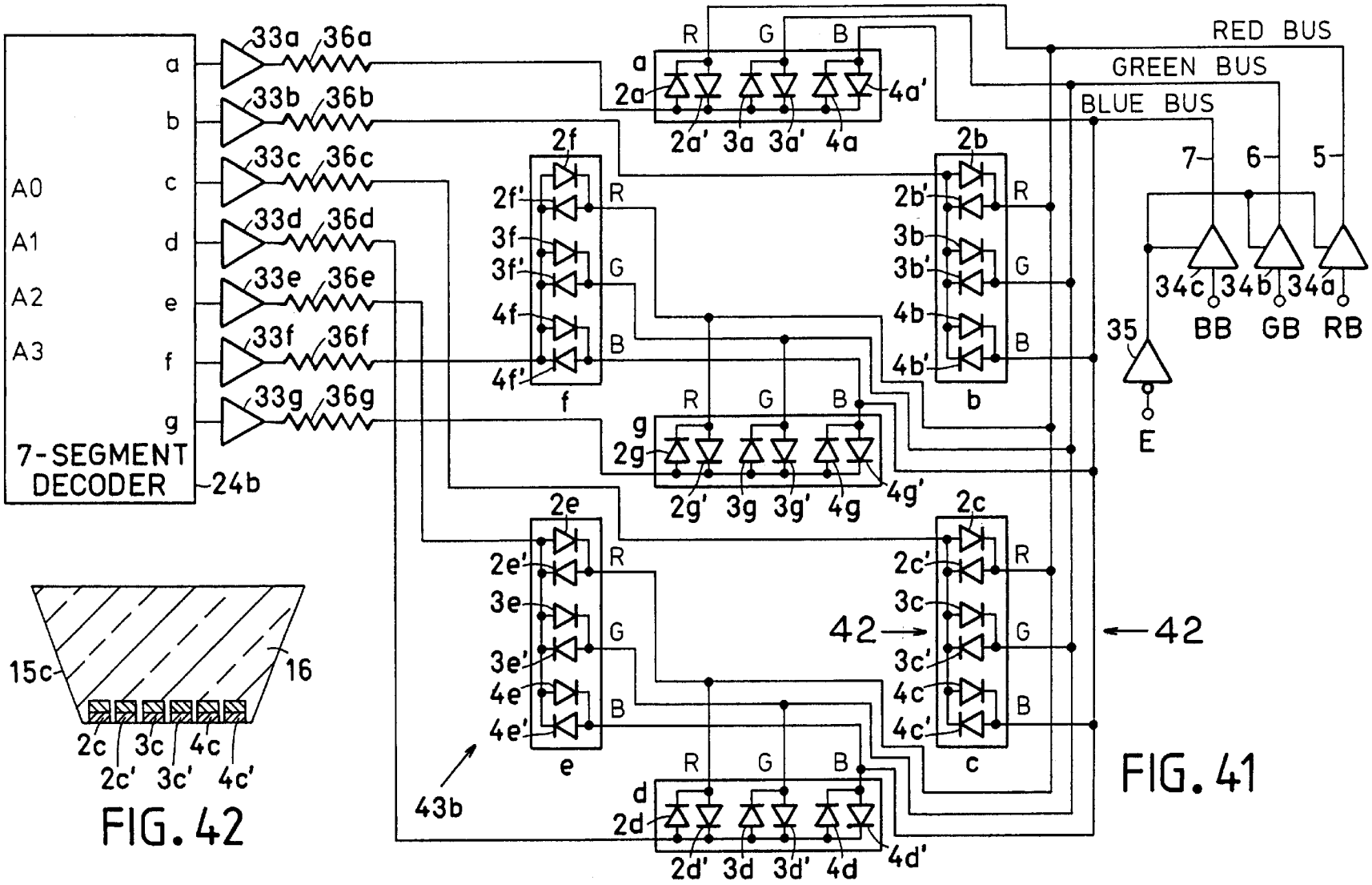
FIG. 41 is a schematic diagram of one digit variable color complementary display device of this invention.
FIG. 42 is an enlarged cross-sectional view of one display segment in FIG. 41, taken along the line 42—42.

In FIG. 41 is shown schematic diagram of a preferred embodiment of a variable color complementary display device of the invention, which is capable of exhibiting a selected display unit, by illuminating the display areas that correspond by their positions to the selected display unit, in a selective display color, and of automatically illuminating the remaining display areas in a color which is substantially complementary to the display color, without the need for converting display color control signals to complementary color control signals. The invention is achieved by using anti-parallel (back-to-back) connected light emitting diodes of three primary colors in each display area of the display device, as will be pointed out subsequently.

It will be recalled that complementary colors are those colors that produce a neutral color when additively mixed in suitable proportions. Generally, red colors are complementary to blue-green colors, green colors are complementary to purple colors, and blue colors are complementary to yellow colors. However, it would be obvious to persons of ordinary skill, in the view of this disclosure, that the principles of the invention are also applicable to other contrasting colors.

In the schematic diagram in FIG. 41 is shown a 3 -primary color 7-segment display element 43*b* which can selectively exhibit digital fonts in different colors on display segments a, b, c, d, e, f, and g. Each display segment includes six LEDs: two anti-parallel red LEDs 2 and 2', two anti-parallel green LEDs 3 and 3', and two anti-parallel blue LEDs 4 and 4', which are closely adjacent such that the light signals emitted therefrom are substantially superimposed upon one another to mix the colors. To facilitate the illustration, the LEDs are designated by segment symbols, e. g., the two red LEDs in segment a are designated as 2*a* and 2*a*', etc.

In the display segment a, the anode of red LED 2*a* is connected to the cathode of red LED 2*a*', and the cathode of red LED 2*a* is connected to the anode of red LED 2*a*'. The two green LEDs 3*a* and 3*a*' are similarly connected back-to-back. The two blue LEDs 4*a* and 4*a*' are connected back-to-back in a similar fashion. In all remaining display segments b, c, d, e, f, and g, the pairs of LEDs of the same primary color are also connected back-to-back in the same fashion.

As a consequence of the back-to-back connecting of the light emitting diodes, each pair has two terminals which are functionally equivalent, because the rectifying effect of the light emitting diode has been practically eliminated. However, it may be advantageous for facilitating the description of the schematic diagram in FIG. 41, to refer to the interconnected terminals of the pair which are on the top of segments a, g, and d and on the right of segments b, c, e, and f, as the first terminals of the pairs. Similarly, the other terminals, on the bottom of segments a, g, and d and on the left of segments b, c, e, and f, will be referred to as the second terminals of the pairs.

The first terminals of the pairs of all red LEDs are commonly coupled to red bus 5, the first terminals of the pairs of all green LEDs are commonly coupled to green bus 6, and the first terminals of the pairs of all blue LEDs are commonly coupled to blue bus 7. Thus all LEDs in display element 43*b* are coupled to red bus 5, green bus 6, and blue bus 7 in accordance with their colors.

The second terminals of the pair of all three pairs of LEDs are interconnected in each display segment. The interconnected second terminals of the pairs in segment a are coupled, via current limiting resistor 36*a*, to the output of non-inverting buffer 33*a*, which has its input coupled to the output a of 7-segment decoder 24*b*. In a similar fashion, the interconnected second terminals in all remaining segments b, c, d, e, f, and g are respectively coupled to the remaining outputs b, c, d, e, f, and g of 7-segment decoder 24*b*, via respective current limiting resistors 36*b*, 36*c*, 36*d*, 36*e*, 36*f*, and 36*g*, and via the remaining non-inverting buffers 33*b*, 33*c*, 33*d*, 33*e*, 33*f*, and 33*g*. Thus all display segments a, b, c, d, e, f, and g are effectively coupled to the equally designated outputs of 7-segment decoder 24*b*, in accordance with their positions in display element 43*b*. The purpose of non-inverting buffers 33*a*, 33*b*, 33*c*, 33*d*, 33*e*, 33*f*, and 33*g* is to provide sufficient current needed for forwardly biasing all LEDs in display element 43*b*. The purpose of current limiting resistors 36*a*, 36*b*, 36*c*, 36*d*, 36*e*, 36*f*, and 36*g* is to constrain the current flow through the LEDs to provide uniform brightness.

The red bus 5 is connected to the output of a tri-state non-inverting buffer 34*a*, capable of sourcing or sinking sufficient current to forwardly bias all red LEDs 2*a* to 2*g* and 2*a*' to 2*g*' in display element 43*b*. The green bus 6 is connected to the output of a like tri-state non-inverting buffer 34*b*. The blue bus 7 is connected to the output of a like tri-state non-inverting buffer 34*c*.

The tri-state non-inverting buffers 34*a*, 34*b*, and 34*c* can be simultaneously enabled by applying a low logic level signal to enable input E of an inverter 35, and disabled by applying a high logic level signal thereto. When tri-state non-inverting buffers 34*a*, 34*b*, and 34*c* are jointly enabled, the conditions of red bus 5, green bus 6, and blue bus 7 can be selectively controlled by applying valid combinations of logic level signals to bus color control inputs RB (red bus), GB (green bus), and BB (blue bus), for illuminating display element 43*b* in a selected color. When tri-state non-inverting buffers 34*a*, 34*b*, and 34*c* are jointly disabled, all three buses are effectively disconnected, and display element 43*b* is extinguished.

The operation of display element 43*b* shown in FIG. 41 will be now explained by the example of illuminating a digit '4' in six different colors. To display decimal number '4', a BCD code 0100 is applied to the inputs A0, A1, A2, and A3 of common anode 7-segment decoder 24*b*. The decoder 24*b* develops low voltage levels at its outputs c, f and g, thereby causing the outputs of non-inverting buffers 33*c*, 33*f*, and 33*g* to drop to a low logic level, and high voltage levels at all remaining outputs a, b, d, and e, thereby causing the outputs of non-inverting buffers 33*a*, 33*b*, 33*d*, and 33*e* to rise to a high logic level. As a consequence, as will be pointed out in more detail subsequently, the equally designated segments c, f, and g illuminate in a desired color, and the remaining segments a, b, d, and e automatically illuminate in a color substantially complementary to the desired color.

To illuminate display element 43*b* in red color, the bus color control input RB (red bus) is raised to a high logic level, while both remaining bus color control inputs GB (green bus) and BB (blue bus) are maintained at a low logic level. As a result, the output of buffer 34*a* rises to a high logic level, while the outputs of buffers 34*b* and 34*c* remain at a low logic level. The current flows from the output of buffer 34*a*, via red bus 5, red LED 2*c*', and resistor 36*c*, to the output of buffer 33*c*. The current also flows from the output of buffer 34*a*, via red bus 5, red LED 2*f*', and resistor 36*f*, to the output of buffer 33*f*. The current also flows from the output of buffer 34*a*, via red bus 5, red LED 2*g*', and resistor 36*g*, to the output of buffer 33*g*. The current cannot flow from the output of buffer 34*a*, which is at a high logic level, to the outputs of buffers 33*a*, 33*b*, 33*d*, and 33*e*, because their outputs are also at a high logic level. As a result, segments c, f and g illuminate in red color, thereby causing a visual impression of a character '4'.

At the same time, current flows from the output of buffer 33*a*, via resistor 36*a*, green LED 3*a*, and green bus 6, to the output of buffer 34*b*. The current also flows from the output of buffer 33*a*, via resistor 36*a*, blue LED 4*a*, and blue bus 7, to the output of buffer 34*c*. The current also flows from the output of buffer 33*b*, via resistor 36*b*, green LED 3*b*, and green bus 6, to the output of buffer 34*b*. The current also flows from the output of buffer 33*b*, via resistor 36*b*, blue LED 4*b*, and blue bus 7, to the output of buffer 34*c*. The current also flows from the output of buffer 33*d*, via resistor 36*d*, green LED 3*d*, and green bus 6, to the output of buffer 34*b*. The current also flows from the output of buffer 33*d*, via resistor 36*d*, blue LED 4*d*, and blue bus 7, to the output of buffer 34*c*. The current also flows from the output of buffer 33*e*, via resistor 36*e*, green LED 3*e*, and green bus 6, to the output of buffer 34*b*. The current also flows from the output of buffer 33*e*, via resistor 36*e*, blue LED 4*e*, and blue bus 7, to the output of buffer 34*c*. The current cannot flow from the outputs of buffers 33*c*, 33*f*, and 33*g*, which are at a low logic level, to the outputs of buffers 34*b* and 34*c*, because these are also at a low logic level. As a consequence, segments a, b, d, and e illuminate in a substantially blue-green color, which is obtained by blending equal portions of blue and green light signals in each segment a, b, d, and e.

The overall effect is a visual impression of a character '4' exhibited in red color on a background of a substantially blue-green color, which has an effect of enhancing the exhibited character and improve its readability, in a visually pleasing and harmonious manner.

To illuminate display element 43*b* in green color, the bus color control input GB is raised to a high logic level, while both remaining bus color control inputs RB and BB are maintained at a low logic level. As a result, the output of buffer 34*b* rises to a high logic level, while the outputs of buffers 34*a* and 34*c* remain at a low logic level. The current flows from the output of buffer 34*b*, via green bus 6, green LED 3*c*', and resistor 36*c*, to the output of buffer 33*c*. The current also flows from the output of buffer 34*b*, via green bus 6, green LED 3*f*', and resistor 36*f*, to the output of buffer 33*f*. The current also flows from the output of buffer 34*b*, via green bus 6, green LED 3*g*', and resistor 36*g*, to the output of buffer 33*g*. The current cannot flow from the output of buffer 34*b*, which is at a high logic level, to the outputs of buffers 33*a*, 33*b*, 33*d*, and 33*e*, because their outputs are also at a high logic level. As a result, segments c, f and g illuminate in green color, thereby causing a visual impression of a character '4'.

At the same time, current flows from the output of buffer 33*a*, via resistor 36*a*, red LED 2*a*, and red bus 5, to the output of buffer 34*a*. The current also flows from the output of 33*a*, via resistor 36*a*, blue LED 4*a*, and blue bus 7, to the output of buffer 34*c*. The current also flows from the output of buffer 33*b*, via resistor 36*b*, red LED 2*b*, and red bus 5, to the output of buffer 34*a*. The current also flows from the output of buffer 33*b*, via resistor 36*b*, blue LED 4*b*, and blue bus 7, to the output of buffer 34*c*. The current also flows from the output of buffer 33*d*, via resistor 36*d*, red LED 2*d*, and red bus 5, to the output of buffer 34*a*. The current also flows from the output of buffer 33*d*, via resistor 36*d*, blue LED 4*d*, and blue bus 7, to the output of buffer 34*c*. The current also flows from the output of 33*e*, via resistor 36*e*, red LED 2*e*, and red bus 5, to the output of buffer 34*a*. The current also flows from the output of buffer 33*e*, via resistor 36*e*, blue LED 4*e*, and blue bus 7, to the output of buffer 34*c*. The current cannot flow from the outputs of buffers 33*c*, 33*f*, and 33*g*, which are at a low logic level, to the outputs of buffers 34*a* and 34*c*, because these are also at a low logic level. As a consequence, segments a, b, d, and e illuminate in a substantially purple color, which is obtained by blending equal portions of red and blue light signals in each segment a, b, d, and e.

The overall effect is a visual impression of a character '4' exhibited in green color on a background of a substantially purple color.

To illuminate display element 43*b* in blue color, the bus color control input BB is raised to a high logic level, while both remaining bus color control inputs RB and GB are maintained at a low logic level. As a result, the output of buffer 34*c* rises to a high logic level, while the outputs of buffers 34*a* and 34*b* remain at a low logic level. The current flows from the output of buffer 34*c*, via blue bus 7, blue LED 4*c*', and resistor 36*c*, to the output of buffer 33*c*. The current also flows from the output of buffer 34*c*, via blue bus 7, blue LED 4*f*', and resistor 36*f*, to the output of buffer 33*f*. The current also flows from the output of buffer 34*c*, via blue bus 7, blue LED 4*g*', and resistor 36*g*, to the output of buffer 33*g*. The current cannot flow from the output of buffer 34*c*, which is at a high logic level, to the outputs of buffers 33*a*, 33*b*, 33*d*, and 33*e*, because their outputs are also at a high logic level. As a result, segments c, f and g illuminate in blue color, thereby causing a visual impression of a character '4'.

At the same time, current flows from the output of buffer 33*a*, via resistor 36*a*, red LED 2*a*, and red bus 5, to the output of buffer 34*a*. The current also flows from the output of 33*a*, via resistor 36*a*, green LED 3*a*, and green bus 6, to the output of buffer 34*b*. The current also flows from the output of buffer 33*b*, via resistor 36*b*, red LED 2*b*, and red bus 5, to the output of buffer 34*a*. The current also flows from the output of buffer 33*b*, via resistor 36*b*, green LED 3*b*, and green bus 6, to the output of buffer 34*b*. The current also flows from the output of buffer 33*d*, via resistor 36*d*, red LED 2*d*, and red bus 5, to the output of buffer 34*a*. The current also flows from the output of buffer 33*d*, via resistor 36*d*, green LED 3*d*, and green bus 6, to the output of buffer 34*b*. The current also flows from the output of 33*e*, via resistor 36*e*, red LED 2*e*, and red bus 5, to the output of buffer 34*a*. The current also flows from the output of buffer 33*e*, via resistor 36*e*, green LED 3*e*, and green bus 6, to the output of buffer 34*b*. The current cannot flow from the outputs of buffers 33*c*, 33*f*, and 33*g*, which are at a low logic level, to the outputs of buffers 34*a* and 34*b*, because these are also at a low logic level. As a consequence, segments a, b, d, and e illuminate in a substantially yellow color, which is obtained by blending equal portions of red and green light signals in each segment a, b, d, and e.

The overall effect is a visual impression of a character '4' exhibited, in blue color on a background of a substantially yellow color.

To illuminate display element 43*b* in yellow color, the bus color control inputs RB and GB are raised to a high logic level, while the remaining bus color control input BB is maintained at a low logic level. As a result, the outputs of buffers 34*a* and 34*b* rise to a high logic level, while the output of buffer 34*c* remains at a low logic level. The current flows from the output of buffer 34*a*, via red bus 5, red LED 2*c*', and resistor 36*c*, to the output of buffer 33*c*. The current also flows from the output of buffer 34*a*, via red bus 5, red LED 2*f*', and resistor 36*f*, to the output of buffer 33*f*. The current also flows from the output of buffer 34*a*, via red bus 5, red LED 2*g*', and resistor 36*g*, to the output of buffer 33*g*. The current flows from the output of buffer 34*b*, via green bus 6, green LED 3*c*', and resistor 36*c*, to the output of buffer 33*c*. The current also flows from the output of buffer 34*b*, via green bus 6, green LED 3*f*', and resistor 36*f*, to the output of buffer 33*f*. The current also flows from the output of buffer 34*b*, via green bus 6, green LED 3*g*', and resistor 36*g*, to the output of buffer 33*g*. The current cannot flow from the output of buffer 34*a*, which is at a high logic level, to the outputs of buffers 33*a*, 33*b*, 33*d*, and 33*e*, because their outputs are also at a high logic level. For the same reason, the current cannot flow from the output of buffer 34*b*, which is at a high logic level, to the outputs of buffers 33*a*, 33*b*, 33*d*, and 33*e*. As a result of blending equal portions of red and green light signals in each segment, segments c, f and g illuminate in a substantially yellow color, thereby causing a visual impression of a character '4'.

At the same time, current flows from the output of buffer 33*a*, via resistor 36*a*, blue LED 4*a*, and blue bus 7, to the output of buffer 34*c*. The current also flows from the output of buffer 33*b*, via resistor 36*b*, blue LED 4*b*, and blue bus 7, to the output of buffer 34*c*. The current also flows from the output of buffer 33*d*, via resistor 36*d*, blue LED 4*d*, and blue bus 7, to the output of buffer 34*c*. The current also flows from the output of 33*e*, via resistor 36*e*, blue LED 4*e*, and blue bus 7, to the output of buffer 34*c*. The current cannot flow from the outputs of buffers 33*c*, 33*f*, and 33*g*, which are at a low logic level, to the output of buffer 34*c*, because that is also at a low logic level. As a consequence, segments a, b, d, and e illuminate in blue color.

The overall effect is a visual impression of a character '4' exhibited in a substantially yellow color on a background of blue color.

To illuminate display element 43*b* in purple color, the bus color control inputs RB and BB are raised to a high logic level, while the remaining bus color control input GB is maintained at a low logic level. As a result, the outputs of buffers 34*a* and 34*c* rise to a high logic level, while the output of buffer 34*b* remains at a low logic level. The current flows from the output of buffer 34*a*, via red bus 5, red LED 2*c*', and resistor 36*c*, to the output of buffer 33*c*. The current also flows from the output of buffer 34*a*, via red bus 5, red LED 2*f*', and resistor 36*f*, to the output of buffer 33*f*. The current also flows from the output of buffer 34*a*, via red bus 5, red LED 2*g*', and resistor 36*g*, to the output of buffer 33*g*. The current flows from the output of buffer 34*c*, via blue bus 7, blue LED 4*c*', and resistor 36*c*, to the output of buffer 33*c*. The current also flows from the output of buffer 34*c*, via blue bus 7, blue LED 4*f*', and resistor 36*f*, to the output of buffer 33*f*. The current also flows from the output of buffer 34*c*, via blue bus 7, blue LED 4*g*', and resistor 36*g*, to the output of buffer 33*g*. The current cannot flow from the output of buffer 34*a*, which is at a high logic level, to the outputs of buffers 33*a*, 33*b*, 33*d*, and 33*e*, because their outputs are also at a high logic level. For the same reason, the current cannot flow from the output of buffer 34*c*, which is at a high logic level, to the outputs of buffers 33*a*, 33*b*, 33*d*, and 33*e*. As a result of blending equal portions of red and blue light signals in each segment, segments c, f and g illuminate in a substantially purple color, thereby causing a visual impression of a character '4'.

At the same time, current flows from the output of buffer 33*a*, via resistor 36*a*, green LED 3*a*, and green bus 6, to the output of buffer 34*b*. The current also flows from the output of buffer 33*b*, via resistor 36*b*, green LED 3*b*, and green bus 6, to the output of buffer 34*b*. The current also flows from the output of buffer 33*d*, via resistor 36*d*, green LED 3*d*, and green bus 6, to the output of buffer 34*b*. The current also flows from the output of 33*e*, via resistor 36*e*, green LED 3*e*, and green bus 6, to the output of buffer 34*b*. The current cannot flow from the outputs of buffers 33*c*, 33*f*, and 33*g*, which are at a low logic level, to the output of buffer 34*b*, because that is also at a low logic level. As a consequence, segments a, b, d, and e illuminate in green color.

The overall effect is a visual impression of a character '4' exhibited in a substantially purple color on a background of green color.

To illuminate display element 43*b* in blue-green color, the bus color control inputs GB and BB are raised to a high logic level, while the remaining bus color control input RB is maintained at a low logic level. As a result, the outputs of buffers 34*b* and 34*c* rise to a high logic level, while the output of buffer 34*a* remains at a low logic level. The current flows from the output of buffer 34*b*, via green bus 6, green LED 3*c*', and resistor 36*c*, to the output of buffer 33*c*. The current also flows from the output of buffer 34*b*, via green bus 6, green LED 3*f*', and resistor 36*f*, to the output of buffer 33*f*. The current also flows from the output of buffer 34*b*, via green bus 6, green LED 3*g*', and resistor 36*g*, to the output of buffer 33*g*. The current flows from the output of buffer 34*c*, via blue bus 7, blue LED 4*c*', and resistor 36*c*, to the output of buffer 33*c*. The current also flows from the output of buffer 34*c*, via blue bus 7, blue LED 4*f*', and resistor 36*f*, to the output of buffer 33*f*. The current also flows from the output of buffer 34*c*, via blue bus 7, blue LED 4*g*', and resistor 36*g*, to the output of buffer 33*g*. The current cannot flow from the output of buffer 34*b*, which is at a high logic level, to the outputs of buffers 33*a*, 33*b*, 33*d*, and 33*e*, because their outputs are also at a high logic level. For the same reason, the current cannot flow from the output of buffer 34*c*, which is at a high logic level, to the outputs of buffers 33*a*, 33*b*, 33*d*, and 33*e*. As a result of blending equal portions of green and blue light signals in each segment, segments c, f and g illuminate in a substantially blue-green color, thereby causing a visual impression of a character '4'.

At the same time, current flows from the output of buffer 33*a*, via resistor 36*a*, red LED 2*a*, and red bus 5, to the output of buffer 34*a*. The current also flows from the output of buffer 33*b*, via resistor 36*b*, red LED 2*b*, and red bus 5, to the output of buffer 34*a*. The current also flows from the output of buffer 33*d*, via resistor 36*d*, red LED 2*d*, and red bus 5, to the output of buffer 34*a*. The current also flows from the output of buffer 33*e*, via resistor 36*e*, red LED 2*e*, and red bus 5, to the output of buffer 34*a*. The current cannot flow from the outputs of buffers 33*c*, 33*f*, and 33*g*, which are at a low logic level, to the output of buffer 34*a*, because that is also at a low logic level. As a consequence, segments a, b, d, and e illuminate in red color.

The overall effect is a visual impression of a character '4' exhibited in a substantially blue-green color on a background of red color.

In FIG. 42, red LEDs 2*c*, 2*c*', green LEDs 3*c*, 3*c*', and blue LEDs 4*c*, 4*c*' are placed on the base of a segment body 15*c* which is filled with a transparent light scattering material 16. When forwardly biased, either LEDs 2*c*, 3*c*, and 4*c*, or LEDs 2*c*', 3*c*', and 4*c*' emit light signals of red, green, and blue colors, respectively, which are scattered within transparent material 16, thereby blending the red, green, and blue light signals into a composite light signal that emerges at the upper surface of segment body 15*c*. The color of the composite light signal may be controlled by varying the portions of the red, green, and blue light signals.

It would be obvious to persons of ordinary skill that the described variable color complementary display device is not limited to a 7-segment display font, but may have any other suitable shape or arrangement, such as a dot matrix or the like. It would be further obvious, in the view of this disclosure, that other display colors, and their automatically generated complementary colors, may be obtained by applying pulses to bus color control inputs RB, GB, and BB.

In brief summary, the invention describes a variable color complementary display device which includes a plurality of display areas arranged in a pattern for exhibiting, upon selective activation, a plurality of display units. Each said display area includes a first pair of light emitting diodes for emitting, when forwardly biased, light signals of a first color, a second pair of light emitting diodes for emitting, when forwardly biased, light signals of a second color, a third pair of light emitting diodes for emitting, when forwardly biased, light signals of a third color, and a device for combining the light signals in the display area to obtain a light signal of a composite color. Each pair includes a first light emitting diode and a second light emitting diode connected in an anti-parallel fashion such that their polarities are opposite, thereby defining a first terminal of the pair and a second terminal of the pair. A decoder is provided which includes a decoder input, for receiving an input code defining a selected display unit, and a plurality of decoder outputs. The decoder outputs are coupled to the first terminals in accordance with the positions of the display areas in the pattern. The decoder outputs produce selective decoder output signals, for selecting the first light emitting diodes in certain of the display areas, corresponding by their positions in the pattern to the selected display unit, in response to a specific input code. The decoder also produces opposite output signals on the remaining decoder outputs, for selecting the second light emitting diodes in the remaining display areas. A first bus is provided to which the second terminals of all pairs of the first primary color are commonly coupled such that the first light emitting diodes in each pair of the first primary color in each display area selected by the decoder outputs are forwardly biased when the first bus is energized. Similarly, a second bus is provided to which the second terminals of all pairs of the second primary color are commonly coupled such that the first light emitting diodes in each pair of the second primary color in each display area selected by the decoder outputs are forwardly biased when the second bus is energized. In a similar fashion, a third bus is provided to which the second terminals of all pairs of the third primary color are commonly coupled such that the first light emitting diodes in each pair of the third primary color in each display area selected by the decoder outputs are forwardly biased when the third bus is energized. The display device is activated by selectively energizing the buses, for forwardly biasing certain ones of the first light emitting diodes, in accordance with the output signals of the decoder, for illuminating in a selective display color the display areas corresponding by their positions to one of said display units. As a consequence, certain ones of the second light emitting diodes are forwardly biased, in accordance with the opposite output signals of the decoder, for illuminating the remaining display areas in a color substantially complementary to the display color.

It would be obvious, in the view of the present disclosure, that the hardware design of the present invention may be also implemented by software. It would be further obvious that persons skilled in the art may resort to modifications in the construction of the preferred embodiment described herein, without departing from the spirit and scope of the invention as defined in the appended claims. It is contemplated that the principles of the invention are also applicable to numerous diverse types of display devices, such as luminescent devices, liquid crystal display devices, plasma display devices, cathode ray tube display devices, and the like.

CORRELATION TABLE

This is a correlation table of reference characters used in the drawings herein, their descriptions, and examples of commercially available parts.

| # | DESCRIPTION | EXAMPLE |
|---|---|---|
| 1 | display segment | |
| 2 | red LED | |
| 3 | green LED | |
| 4 | blue LED | |
| 5 | red bus | |
| 6 | green bus | |
| 7 | blue bus | |
| 10 | device developing electric signals | |
| 11 | analog voltage source | |
| 12 | digital device | |
| 15 | segment body | |
| 16 | light scattering material | |
| 20 | decoder | |
| 21 | digital decoder driver | |
| 22 | 7-segment display decoder driver | |
| 23 | common cathode 7-segment decoder driver | 74LS49 |
| 24 | common anode 7-segment decoder driver | 74LS47 |
| 30 | monochromatic digital display | |
| 33 | non-inverting buffer | 74LS244 |
| 34 | non-inverting buffer | 74LS244 |
| 35 | inverter | part of 74LS244 |
| 36 | resistor | |
| 40 | variable color digital display | |
| 41 | multiplexed variable color display | |

-continued

CORRELATION TABLE

This is a correlation table of reference characters used in the drawings herein, their descriptions, and examples of commercially available parts.

| # | DESCRIPTION | EXAMPLE |
|---|---|---|
| 42 | variable color 7-segment display element (2 LEDs) | |
| 43 | variable color 7-segment display element (3 LEDs) | |
| 46 | variable color display element (2 LEDs) | |
| 47 | variable color display element (3 LEDs) | |
| 48 | 3 ½ digit variable color display | |
| 49 | 6 ½ digit variable color 7-segment display | |
| 50 | color control | |
| 51 | step variable color control | |
| 52 | color control (2 LEDs) | |
| 53 | color control (3 LEDs) | |
| 55 | color converter | |
| 56 | continuously variable color converter | |
| 57 | 2-primary color converter | |
| 58 | 3-primary color converter | |
| 59 | single color converter | |
| 60 | 2-input OR gate | 74HC32 |
| 61 | 4-input OR gate | 4072 |
| 62 | non-inverting buffer | 74LS244 |
| 63 | inverting buffer | 74LS240 |
| 64 | inverter | part of 74LS240,4 |
| 65 | inverter | 74HC04 |
| 66 | 2-input AND gate | 74HC08 |
| 67 | priority encoder | 74HC147 |
| 68 | 3-to-8 line decoder | 74HC138 |
| 69 | logic circuit | |
| 71 | 8-bit counter | 74F579 |
| 73 | D type flip-flop | 74HC74 |
| 74 | A/D converter | |
| 75 | 8-bit A/D converter | AD570 |
| 76 | memory | |
| 77 | 2k × 8 bit PROM | 2716 |
| 80 | scaling circuit | |
| 81 | op amp | LM741 |
| 82 | analog comparator | LM339 |
| 85 | signal converter | |
| 90 | resistor | |
| 91 | resistor | |
| 92 | potentiometer | |
| 93 | capacitor | |
| 99 | pulse | |

The examples of commercially available components should be considered as merely illustrative. It will be appreciated that other components may be readily and effectively used. The integrated circuits used in the description of the invention are manufactured by several known companies, such are Analog Devices, Inc., Fairchild Camera and Instrument Corporation, Intel Corporation, Intersil, Inc., Motorola Semiconductor Products Inc., National Semiconductor Incorporated, Precision Monolithics Incorporated, Teledyne Semiconductor, Texas Instruments Inc., etc.

TABLE 1

| DATA PORTIONS | | | | |
|---|---|---|---|---|
| Input Voltage (Volts) | PROM Address (Hex) | 'Red' PROM (Hex) | red | green |
| 0.0 | 00 | 00 | 0.0 | 1.0 |
| 0.039 | 01 | 00 | 0.0 | 1.0 |
| 0.078 | 02 | 00 | 0.0 | 1.0 |
| 0.117 | 03 | 00 | 0.0 | 1.0 |
| 0.156 | 04 | 00 | 0.0 | 1.0 |
| 0.195 | 05 | 00 | 0.0 | 1.0 |

TABLE 1-continued

| Input Voltage (Volts) | DATA PORTIONS PROM Address (Hex) | 'Red' PROM (Hex) | red | green |
|---|---|---|---|---|
| 0.234 | 06 | 00 | 0.0 | 1.0 |
| 0.273 | 07 | 00 | 0.0 | 1.0 |
| 0.312 | 08 | 00 | 0.0 | 1.0 |
| 0.352 | 09 | 00 | 0.0 | 1.0 |
| 0.391 | 0A | 00 | 0.0 | 1.0 |
| 0.430 | 0B | 00 | 0.0 | 1.0 |
| 0.469 | 0C | 00 | 0.0 | 1.0 |
| 0.508 | 0D | 00 | 0.0 | 1.0 |
| 0.547 | 0E | 00 | 0.0 | 1.0 |
| 0.586 | 0F | 00 | 0.0 | 1.0 |
| 0.625 | 10 | 40 | 0.25 | 0.75 |
| 0.664 | 11 | 40 | 0.25 | 0.75 |
| 0.703 | 12 | 40 | 0.25 | 0.75 |
| 0.742 | 13 | 40 | 0.25 | 0.75 |
| 0.781 | 14 | 40 | 0.25 | 0.75 |
| 0.820 | 15 | 40 | 0.25 | 0.75 |
| 0.859 | 16 | 40 | 0.25 | 0.75 |
| 0.898 | 17 | 40 | 0.25 | 0.75 |
| 0.937 | 18 | 40 | 0.25 | 0.75 |
| 0.977 | 19 | 40 | 0.25 | 0.75 |
| 1.016 | 1A | 40 | 0.25 | 0.75 |
| 1.055 | 1B | 40 | 0.25 | 0.75 |
| 1.094 | 1C | 40 | 0.25 | 0.75 |
| 1.133 | 1D | 40 | 0.25 | 0.75 |
| 1.172 | 1E | 40 | 0.25 | 0.75 |
| 1.211 | 1F | 40 | 0.25 | 0.75 |
| 1.250 | 20 | 80 | 0.5 | 0.5 |
| 1.289 | 21 | 80 | 0.5 | 0.5 |
| 1.328 | 22 | 80 | 0.5 | 0.5 |
| 1.367 | 23 | 80 | 0.5 | 0.5 |
| 1.406 | 24 | 80 | 0.5 | 0.5 |
| 1.445 | 25 | 80 | 0.5 | 0.5 |
| 1.484 | 26 | 80 | 0.5 | 0.5 |
| 1.523 | 27 | 80 | 0.5 | 0.5 |
| 1.562 | 28 | 80 | 0.5 | 0.5 |
| 1.602 | 29 | 80 | 0.5 | 0.5 |
| 1.641 | 2A | 80 | 0.5 | 0.5 |
| 1.680 | 2B | 80 | 0.5 | 0.5 |
| 1.719 | 2C | 80 | 0.5 | 0.5 |
| 1.758 | 2D | 80 | 0.5 | 0.5 |
| 1.797 | 2E | 80 | 0.5 | 0.5 |
| 1.836 | 2F | 80 | 0.5 | 0.5 |
| 1.875 | 30 | C0 | 0.75 | 0.25 |
| 1.914 | 31 | C0 | 0.75 | 0.25 |
| 1.953 | 32 | C0 | 0.75 | 0.25 |
| 1.992 | 33 | C0 | 0.75 | 0.25 |
| 2.031 | 34 | C0 | 0.75 | 0.25 |
| 2.070 | 35 | C0 | 0.75 | 0.25 |
| 2.109 | 36 | C0 | 0.75 | 0.25 |
| 2.148 | 37 | C0 | 0.75 | 0.25 |
| 2.187 | 38 | C0 | 0.75 | 0.25 |
| 2.227 | 39 | C0 | 0.75 | 0.25 |
| 2.266 | 3A | C0 | 0.75 | 0.25 |
| 2.305 | 3B | C0 | 0.75 | 0.25 |
| 2.344 | 3C | C0 | 0.75 | 0.25 |
| 2.389 | 3D | C0 | 0.75 | 0.25 |
| 2.422 | 3E | C0 | 0.75 | 0.25 |
| 2.461 | 3F | C0 | 0.75 | 0.25 |
| 2.500 | 40 | FF | 1.0 | 0.0 |
| 2.539 | 41 | FF | 1.0 | 0.0 |
| 2.578 | 42 | FF | 1.0 | 0.0 |
| 2.617 | 43 | FF | 1.0 | 0.0 |
| 2.656 | 44 | FF | 1.0 | 0.0 |
| 2.695 | 45 | FF | 1.0 | 0.0 |
| 2.734 | 46 | FF | 1.0 | 0.0 |
| 2.773 | 47 | FF | 1.0 | 0.0 |
| 2.812 | 48 | FF | 1.0 | 0.0 |
| 2.852 | 49 | FF | 1.0 | 0.0 |
| 2.891 | 4A | FF | 1.0 | 0.0 |
| 2.930 | 4B | FF | 1.0 | 0.0 |
| 2.969 | 4C | FF | 1.0 | 0.0 |
| 3.008 | 4D | FF | 1.0 | 0.0 |
| 3.047 | 4E | FF | 1.0 | 0.0 |

TABLE 1-continued

| Input Voltage (Volts) | DATA PORTIONS PROM Address (Hex) | 'Red' PROM (Hex) | red | green |
|---|---|---|---|---|
| 3.086 | 4F | FF | 1.0 | 0.0 |
| 3.125 | 50 | 00 | 0.0 | 1.0 |
| 3.164 | 51 | 00 | 0.0 | 1.0 |
| 3.203 | 52 | 00 | 0.0 | 1.0 |
| 3.242 | 53 | 00 | 0.0 | 1.0 |
| 3.281 | 54 | 00 | 0.0 | 1.0 |
| 3.320 | 55 | 00 | 0.0 | 1.0 |
| 3.359 | 56 | 00 | 0.0 | 1.0 |
| 3.398 | 57 | 00 | 0.0 | 1.0 |
| 3.437 | 58 | 00 | 0.0 | 1.0 |
| 3.477 | 59 | 00 | 0.0 | 1.0 |
| 3.516 | 5A | 00 | 0.0 | 1.0 |
| 3.555 | 5B | 00 | 0.0 | 1.0 |
| 3.594 | 5C | 00 | 0.0 | 1.0 |
| 3.633 | 5D | 00 | 0.0 | 1.0 |
| 3.672 | 5E | 00 | 0.0 | 1.0 |
| 3.711 | 5F | 00 | 0.0 | 1.0 |
| 3.750 | 60 | 40 | 0.25 | 0.75 |
| 3.789 | 61 | 40 | 0.25 | 0.75 |
| 3.828 | 62 | 40 | 0.25 | 0.75 |
| 3.867 | 63 | 40 | 0.25 | 0.75 |
| 3.906 | 64 | 40 | 0.25 | 0.75 |
| 3.945 | 65 | 40 | 0.25 | 0.75 |
| 3.984 | 66 | 40 | 0.25 | 0.75 |
| 4.023 | 67 | 40 | 0.25 | 0.75 |
| 4.062 | 68 | 40 | 0.25 | 0.75 |
| 4.102 | 69 | 40 | 0.25 | 0.75 |
| 4.141 | 6A | 40 | 0.25 | 0.75 |
| 4.178 | 6B | 40 | 0.25 | 0.75 |
| 4.219 | 6C | 40 | 0.25 | 0.75 |
| 4.258 | 6D | 40 | 0.25 | 0.75 |
| 4.299 | 6E | 40 | 0.25 | 0.75 |
| 4.336 | 6F | 40 | 0.25 | 0.75 |
| 4.375 | 70 | 80 | 0.5 | 0.5 |
| 4.414 | 71 | 80 | 0.5 | 0.5 |
| 4.453 | 72 | 80 | 0.5 | 0.5 |
| 4.492 | 73 | 80 | 0.5 | 0.5 |
| 4.531 | 74 | 80 | 0.5 | 0.5 |
| 4.570 | 75 | 80 | 0.5 | 0.5 |
| 4.609 | 76 | 80 | 0.5 | 0.5 |
| 4.648 | 77 | 80 | 0.5 | 0.5 |
| 4.687 | 78 | 80 | 0.5 | 0.5 |
| 4.727 | 79 | 80 | 0.5 | 0.5 |
| 4.766 | 7A | 80 | 0.5 | 0.5 |
| 4.805 | 7B | 80 | 0.5 | 0.5 |
| 4.844 | 7C | 80 | 0.5 | 0.5 |
| 4.883 | 7D | 80 | 0.5 | 0.5 |
| 4.922 | 7E | 80 | 0.5 | 0.5 |
| 4.961 | 7F | 80 | 0.5 | 0.5 |
| 5.000 | 80 | C0 | 0.75 | 0.25 |
| 5.039 | 81 | C0 | 0.75 | 0.25 |
| 5.078 | 82 | C0 | 0.75 | 0.25 |
| 5.117 | 83 | C0 | 0.75 | 0.25 |
| 5.156 | 84 | C0 | 0.75 | 0.25 |
| 5.195 | 85 | C0 | 0.75 | 0.25 |
| 5.234 | 86 | C0 | 0.75 | 0.25 |
| 5.273 | 87 | C0 | 0.75 | 0.25 |
| 5.312 | 88 | C0 | 0.75 | 0.25 |
| 5.352 | 89 | C0 | 0.75 | 0.25 |
| 5.391 | 8A | C0 | 0.75 | 0.25 |
| 5.430 | 8B | C0 | 0.75 | 0.25 |
| 5.469 | 8C | C0 | 0.75 | 0.25 |
| 5.508 | 8D | C0 | 0.75 | 0.25 |
| 5.547 | 8E | C0 | 0.75 | 0.25 |
| 5.586 | 8F | C0 | 0.75 | 0.25 |
| 5.625 | 90 | FF | 1.0 | 0.0 |
| 5.664 | 91 | FF | 1.0 | 0.0 |
| 5.703 | 92 | FF | 1.0 | 0.0 |
| 5.742 | 93 | FF | 1.0 | 0.0 |
| 5.781 | 94 | FF | 1.0 | 0.0 |
| 5.820 | 95 | FF | 1.0 | 0.0 |
| 5.859 | 96 | FF | 1.0 | 0.0 |
| 5.898 | 97 | FF | 1.0 | 0.0 |

TABLE 1-continued

| Input Voltage (Volts) | DATA PORTIONS PROM Address (Hex) | 'Red' PROM (Hex) | red | green |
|---|---|---|---|---|
| 5.937 | 98 | FF | 1.0 | 0.0 |
| 5.977 | 99 | FF | 1.0 | 0.0 |
| 6.016 | 9A | FF | 1.0 | 0.0 |
| 6.055 | 9B | FF | 1.0 | 0.0 |
| 6.094 | 9C | FF | 1.0 | 0.0 |
| 6.133 | 9D | FF | 1.0 | 0.0 |
| 6.172 | 9E | FF | 1.0 | 0.0 |
| 6.211 | 9F | FF | 1.0 | 0.0 |
| 6.250 | A0 | 00 | 0.0 | 1.0 |
| 6.289 | A1 | 00 | 0.0 | 1.0 |
| 6.328 | A2 | 00 | 0.0 | 1.0 |
| 6.367 | A3 | 00 | 0.0 | 1.0 |
| 6.406 | A4 | 00 | 0.0 | 1.0 |
| 6.445 | A5 | 00 | 0.0 | 1.0 |
| 6.484 | A6 | 00 | 0.0 | 1.0 |
| 6.524 | A7 | 00 | 0.0 | 1.0 |
| 6.562 | A8 | 00 | 0.0 | 1.0 |
| 6.602 | A9 | 00 | 0.0 | 1.0 |
| 6.641 | AA | 00 | 0.0 | 1.0 |
| 6.680 | AB | 00 | 0.0 | 1.0 |
| 6.719 | AC | 00 | 0.0 | 1.0 |
| 6.758 | AD | 00 | 0.0 | 1.0 |
| 6.797 | AE | 00 | 0.0 | 1.0 |
| 6.836 | AF | 00 | 0.0 | 1.0 |
| 6.875 | B0 | 40 | 0.25 | 0.75 |
| 6.914 | B1 | 40 | 0.25 | 0.75 |
| 6.953 | B2 | 40 | 0.25 | 0.75 |
| 6.992 | B3 | 40 | 0.25 | 0.75 |
| 7.031 | B4 | 40 | 0.25 | 0.75 |
| 7.070 | B5 | 40 | 0.25 | 0.75 |
| 7.109 | B6 | 40 | 0.25 | 0.75 |
| 7.148 | B7 | 40 | 0.25 | 0.75 |
| 7.187 | B8 | 40 | 0.25 | 0.75 |
| 7.227 | B9 | 40 | 0.25 | 0.75 |
| 7.266 | BA | 40 | 0.25 | 0.75 |
| 7.305 | BB | 40 | 0.25 | 0.75 |
| 7.344 | BC | 40 | 0.25 | 0.75 |
| 7.383 | BD | 40 | 0.25 | 0.75 |
| 7.422 | BE | 40 | 0.25 | 0.75 |
| 7.461 | BF | 40 | 0.25 | 0.75 |
| 7.500 | C0 | 80 | 0.5 | 0.5 |
| 7.539 | C1 | 80 | 0.5 | 0.5 |
| 7.587 | C2 | 80 | 0.5 | 0.5 |
| 7.617 | C3 | 80 | 0.5 | 0.5 |
| 7.656 | C4 | 80 | 0.5 | 0.5 |
| 7.695 | C5 | 80 | 0.5 | 0.5 |
| 7.734 | C6 | 80 | 0.5 | 0.5 |
| 7.773 | C7 | 80 | 0.5 | 0.5 |
| 7.812 | C8 | 80 | 0.5 | 0.5 |
| 7.852 | C9 | 80 | 0.5 | 0.5 |
| 7.891 | CA | 80 | 0.5 | 0.5 |
| 7.930 | CB | 80 | 0.5 | 0.5 |
| 7.969 | CC | 80 | 0.5 | 0.5 |
| 8.008 | CD | 80 | 0.5 | 0.5 |
| 8.047 | CE | 80 | 0.5 | 0.5 |
| 8.086 | CF | 80 | 0.5 | 0.5 |
| 8.125 | D0 | C0 | 0.75 | 0.25 |
| 8.164 | D1 | C0 | 0.75 | 0.25 |
| 8.203 | D2 | C0 | 0.75 | 0.25 |
| 8.242 | D3 | C0 | 0.75 | 0.25 |
| 8.281 | D4 | C0 | 0.75 | 0.25 |
| 8.320 | D5 | C0 | 0.75 | 0.25 |
| 8.359 | D6 | C0 | 0.75 | 0.25 |
| 8.398 | D7 | C0 | 0.75 | 0.25 |
| 8.437 | D8 | C0 | 0.75 | 0.25 |
| 8.477 | D9 | C0 | 0.75 | 0.25 |
| 8.516 | DA | C0 | 0.75 | 0.25 |
| 8.555 | DB | C0 | 0.75 | 0.25 |
| 8.594 | DC | C0 | 0.75 | 0.25 |
| 8.633 | DD | C0 | 0.75 | 0.25 |
| 8.672 | DE | C0 | 0.75 | 0.25 |
| 8.711 | DF | C0 | 0.75 | 0.25 |
| 8.750 | E0 | FF | 1.0 | 0.0 |

TABLE 1-continued

| Input Voltage (Volts) | DATA PORTIONS PROM Address (Hex) | 'Red' PROM (Hex) | red | green |
|---|---|---|---|---|
| 8.789 | E1 | FF | 1.0 | 0.0 |
| 8.828 | E2 | FF | 1.0 | 0.0 |
| 8.867 | E3 | FF | 1.0 | 0.0 |
| 8.906 | E4 | FF | 1.0 | 0.0 |
| 8.945 | E5 | FF | 1.0 | 0.0 |
| 8.984 | E6 | FF | 1.0 | 0.0 |
| 9.023 | E7 | FF | 1.0 | 0.0 |
| 9.062 | E8 | FF | 1.0 | 0.0 |
| 9.102 | E9 | FF | 1.0 | 0.0 |
| 9.141 | EA | FF | 1.0 | 0.0 |
| 9.180 | EB | FF | 1.0 | 0.0 |
| 9.219 | EC | FF | 1.0 | 0.0 |
| 9.258 | ED | FF | 1.0 | 0.0 |
| 9.299 | EE | FF | 1.0 | 0.0 |
| 9.336 | EF | FF | 1.0 | 0.0 |
| 9.375 | F0 | 00 | 0.0 | 1.0 |
| 9.414 | F1 | 00 | 0.0 | 1.0 |
| 9.453 | F2 | 00 | 0.0 | 1.0 |
| 9.492 | F3 | 00 | 0.0 | 1.0 |
| 9.531 | F4 | 00 | 0.0 | 1.0 |
| 9.570 | F5 | 00 | 0.0 | 1.0 |
| 9.609 | F6 | 00 | 0.0 | 1.0 |
| 9.648 | F7 | 00 | 0.0 | 1.0 |
| 9.687 | F8 | 00 | 0.0 | 1.0 |
| 9.727 | F9 | 00 | 0.0 | 1.0 |
| 9.766 | FA | 00 | 0.0 | 1.0 |
| 9.805 | FB | 00 | 0.0 | 1.0 |
| 9.844 | FC | 00 | 0.0 | 1.0 |
| 9.883 | FD | 00 | 0.0 | 1.0 |
| 9.922 | FE | 00 | 0.0 | 1.0 |
| 9.961 | FF | 00 | 0.0 | 1.0 |

TABLE 2

| Input Voltage (Volts) | DATA PORTIONS PROM Address (Hex) | 'Red' PROM (Hex) | 'Green' PROM (Hex) | 'Blue' PROM (Hex) | red | green | blue |
|---|---|---|---|---|---|---|---|
| 0.0 | 00 | FF | 00 | 00 | 1.0 | 0.0 | 0.0 |
| 0.039 | 01 | FE | 02 | 00 | 0.992 | 0.008 | 0.0 |
| 0.078 | 02 | FC | 04 | 00 | 0.984 | 0.016 | 0.0 |
| 0.117 | 03 | FA | 06 | 00 | 0.976 | 0.024 | 0.0 |
| 0.156 | 04 | F8 | 08 | 00 | 0.969 | 0.031 | 0.0 |
| 0.195 | 05 | F6 | 0A | 00 | 0.961 | 0.039 | 0.0 |
| 0.234 | 06 | F4 | 0C | 00 | 0.953 | 0.047 | 0.0 |
| 0.273 | 07 | F2 | 0E | 00 | 0.945 | 0.055 | 0.0 |
| 0.312 | 08 | F0 | 10 | 00 | 0.937 | 0.063 | 0.0 |
| 0.352 | 09 | EE | 12 | 00 | 0.930 | 0.070 | 0.0 |
| 0.391 | 0A | EC | 14 | 00 | 0.922 | 0.078 | 0.0 |
| 0.430 | 0B | EA | 16 | 00 | 0.914 | 0.086 | 0.0 |
| 0.469 | 0C | E8 | 18 | 00 | 0.906 | 0.094 | 0.0 |
| 0.508 | 0D | E6 | 1A | 00 | 0.899 | 0.101 | 0.0 |
| 0.547 | 0E | E4 | 1C | 00 | 0.891 | 0.109 | 0.0 |
| 0.586 | 0F | E2 | 1E | 00 | 0.883 | 0.117 | 0.0 |
| 0.625 | 10 | E0 | 20 | 00 | 0.875 | 0.125 | 0.0 |
| 0.664 | 11 | DE | 22 | 00 | 0.867 | 0.133 | 0.0 |
| 0.703 | 12 | DC | 24 | 00 | 0.859 | 0.141 | 0.0 |
| 0.742 | 13 | DA | 26 | 00 | 0.851 | 0.149 | 0.0 |
| 0.781 | 14 | D8 | 28 | 00 | 0.844 | 0.156 | 0.0 |
| 0.820 | 15 | D6 | 2A | 00 | 0.836 | 0.164 | 0.0 |
| 0.859 | 16 | D4 | 2C | 00 | 0.828 | 0.172 | 0.0 |
| 0.898 | 17 | D2 | 2E | 00 | 0.820 | 0.180 | 0.0 |
| 0.937 | 18 | D0 | 30 | 00 | 0.812 | 0.188 | 0.0 |
| 0.977 | 19 | CE | 32 | 00 | 0.804 | 0.196 | 0.0 |
| 1.016 | 1A | CC | 34 | 00 | 0.796 | 0.204 | 0.0 |
| 1.055 | 1B | CA | 36 | 00 | 0.788 | 0.212 | 0.0 |
| 1.094 | 1C | C8 | 38 | 00 | 0.781 | 0.219 | 0.0 |
| 1.133 | 1D | C6 | 3A | 00 | 0.773 | 0.227 | 0.0 |

TABLE 2-continued

| Input Voltage (Volts) | PROM Address (Hex) | DATA PORTIONS 'Red' PROM (Hex) | 'Green' PROM (Hex) | 'Blue' PROM (Hex) | red | green | blue |
|---|---|---|---|---|---|---|---|
| 1.172 | 1E | C4 | 3C | 00 | 0.766 | 0.234 | 0.0 |
| 1.211 | 1F | C2 | 3E | 00 | 0.758 | 0.242 | 0.0 |
| 1.250 | 20 | C0 | 40 | 00 | 0.75 | 0.25 | 0.0 |
| 1.289 | 21 | BE | 42 | 00 | 0.742 | 0.258 | 0.0 |
| 1.328 | 22 | BC | 44 | 00 | 0.734 | 0.266 | 0.0 |
| 1.367 | 23 | BA | 46 | 00 | 0.726 | 0.274 | 0.0 |
| 1.406 | 24 | B8 | 48 | 00 | 0.719 | 0.281 | 0.0 |
| 1.445 | 25 | B6 | 4A | 00 | 0.711 | 0.289 | 0.0 |
| 1.484 | 26 | B4 | 4C | 00 | 0.703 | 0.297 | 0.0 |
| 1.523 | 27 | B2 | 4E | 00 | 0.695 | 0.305 | 0.0 |
| 1.562 | 28 | B0 | 50 | 00 | 0.687 | 0.313 | 0.0 |
| 1.602 | 29 | AE | 52 | 00 | 0.680 | 0.320 | 0.0 |
| 1.641 | 2A | AC | 54 | 00 | 0.672 | 0.328 | 0.0 |
| 1.680 | 2B | AA | 56 | 00 | 0.664 | 0.336 | 0.0 |
| 1.719 | 2C | A8 | 58 | 00 | 0.656 | 0.344 | 0.0 |
| 1.758 | 2D | A6 | 5A | 00 | 0.648 | 0.352 | 0.0 |
| 1.797 | 2E | A4 | 5C | 00 | 0.641 | 0.359 | 0.0 |
| 1.836 | 2F | A2 | 5E | 00 | 0.633 | 0.367 | 0.0 |
| 1.875 | 30 | A0 | 60 | 00 | 0.625 | 0.375 | 0.0 |
| 1.914 | 31 | 9E | 62 | 00 | 0.613 | 0.383 | 0.0 |
| 1.953 | 32 | 9C | 64 | 00 | 0.609 | 0.391 | 0.0 |
| 1.992 | 33 | 9A | 66 | 00 | 0.602 | 0.398 | 0.0 |
| 2.031 | 34 | 98 | 68 | 00 | 0.594 | 0.406 | 0.0 |
| 2.070 | 35 | 96 | 6A | 00 | 0.586 | 0.414 | 0.0 |
| 2.109 | 36 | 94 | 6C | 00 | 0.578 | 0.422 | 0.0 |
| 2.148 | 37 | 92 | 6E | 00 | 0.570 | 0.430 | 0.0 |
| 2.187 | 38 | 90 | 70 | 00 | 0.562 | 0.438 | 0.0 |
| 2.227 | 39 | 8E | 72 | 00 | 0.554 | 0.446 | 0.0 |
| 2.266 | 3A | 8C | 74 | 00 | 0.547 | 0.453 | 0.0 |
| 2.305 | 3B | 8A | 76 | 00 | 0.539 | 0.461 | 0.0 |
| 2.344 | 3C | 88 | 78 | 00 | 0.531 | 0.469 | 0.0 |
| 2.389 | 3D | 86 | 7A | 00 | 0.524 | 0.476 | 0.0 |
| 2.422 | 3E | 84 | 7C | 00 | 0.516 | 0.484 | 0.0 |
| 2.461 | 3F | 82 | 7E | 00 | 0.508 | 0.492 | 0.0 |
| 2.500 | 40 | 80 | 80 | 00 | 0.5 | 0.5 | 0.0 |
| 2.539 | 41 | 7C | 84 | 00 | 0.484 | 0.516 | 0.0 |
| 2.578 | 42 | 78 | 88 | 00 | 0.469 | 0.531 | 0.0 |
| 2.617 | 43 | 74 | 8C | 00 | 0.453 | 0.547 | 0.0 |
| 2.656 | 44 | 70 | 90 | 00 | 0.437 | 0.563 | 0.0 |
| 2.695 | 45 | 6C | 94 | 00 | 0.422 | 0.578 | 0.0 |
| 2.734 | 46 | 68 | 98 | 00 | 0.406 | 0.594 | 0.0 |
| 2.773 | 47 | 64 | 9C | 00 | 0.391 | 0.609 | 0.0 |
| 2.812 | 48 | 60 | A0 | 00 | 0.375 | 0.625 | 0.0 |
| 2.852 | 49 | 5C | A4 | 00 | 0.359 | 0.641 | 0.0 |
| 2.891 | 4A | 58 | A8 | 00 | 0.344 | 0.656 | 0.0 |
| 2.930 | 4B | 54 | AC | 00 | 0.328 | 0.672 | 0.0 |
| 2.969 | 4C | 50 | B0 | 00 | 0.312 | 0.688 | 0.0 |
| 3.008 | 4D | 4C | B4 | 00 | 0.297 | 0.703 | 0.0 |
| 3.047 | 4E | 48 | B8 | 80 | 0.281 | 0.719 | 0.0 |
| 3.086 | 4F | 44 | BC | 00 | 0.266 | 0.734 | 0.0 |
| 3.125 | 50 | 40 | C0 | 00 | 0.25 | 0.75 | 0.0 |
| 3.164 | 51 | 3C | C4 | 00 | 0.234 | 0.766 | 0.0 |
| 3.203 | 52 | 38 | C8 | 00 | 0.219 | 0.781 | 0.0 |
| 3.242 | 53 | 34 | CC | 00 | 0.203 | 0.797 | 0.0 |
| 3.281 | 54 | 30 | D0 | 00 | 0.187 | 0.813 | 0.0 |
| 3.320 | 55 | 2C | D4 | 00 | 0.172 | 0.828 | 0.0 |
| 3.359 | 56 | 28 | D8 | 00 | 0.156 | 0.844 | 0.0 |
| 3.398 | 57 | 24 | DC | 00 | 0.141 | 0.859 | 0.0 |
| 3.437 | 58 | 20 | E0 | 00 | 0.125 | 0.875 | 0.0 |
| 3.477 | 59 | 1C | E4 | 00 | 0.109 | 0.891 | 0.0 |
| 3.516 | 5A | 18 | E8 | 00 | 0.094 | 0.906 | 0.0 |
| 3.555 | 5B | 14 | EC | 00 | 0.078 | 0.922 | 0.0 |
| 3.594 | 5C | 10 | F0 | 00 | 0.062 | 0.938 | 0.0 |
| 3.633 | 5D | 0C | F4 | 00 | 0.047 | 0.953 | 0.0 |
| 3.672 | 5E | 08 | F8 | 00 | 0.031 | 0.967 | 0.0 |
| 3.711 | 5F | 04 | FC | 00 | 0.016 | 0.984 | 0.0 |
| 3.750 | 60 | 00 | FF | 00 | 0.0 | 1.0 | 0.0 |
| 3.789 | 61 | 00 | F8 | 08 | 0.0 | 0.969 | 0.031 |
| 3.828 | 62 | 00 | F0 | 10 | 0.0 | 0.937 | 0.063 |
| 3.867 | 63 | 00 | E8 | 18 | 0.0 | 0.906 | 0.094 |
| 3.906 | 64 | 00 | E0 | 20 | 0.0 | 0.875 | 0.125 |
| 3.945 | 65 | 00 | D8 | 28 | 0.0 | 0.844 | 0.156 |
| 3.984 | 66 | 00 | D0 | 30 | 0.0 | 0.812 | 0.188 |

TABLE 2-continued

| Input Voltage (Volts) | PROM Address (Hex) | DATA PORTIONS 'Red' PROM (Hex) | 'Green' PROM (Hex) | 'Blue' PROM (Hex) | red | green | blue |
|---|---|---|---|---|---|---|---|
| 4.023 | 67 | 00 | C8 | 38 | 0.0 | 0.781 | 0.219 |
| 4.062 | 68 | 00 | C0 | 40 | 0.0 | 0.75 | 0.25 |
| 4.102 | 69 | 00 | B8 | 48 | 0.0 | 0.719 | 0.281 |
| 4.141 | 6A | 00 | B0 | 50 | 0.0 | 0.687 | 0.313 |
| 4.178 | 6B | 00 | A8 | 58 | 0.0 | 0.656 | 0.344 |
| 4.219 | 6C | 00 | A0 | 60 | 0.0 | 0.625 | 0.375 |
| 4.258 | 6D | 00 | 98 | 68 | 0.0 | 0.594 | 0.406 |
| 4.299 | 6E | 00 | 90 | 70 | 0.0 | 0.562 | 0.438 |
| 4.336 | 6F | 00 | 88 | 78 | 0.0 | 0.531 | 0.469 |
| 4.375 | 70 | 00 | 80 | 80 | 0.0 | 0.5 | 0.5 |
| 4.414 | 71 | 00 | 78 | 88 | 0.0 | 0.469 | 0.531 |
| 4.453 | 72 | 00 | 70 | 90 | 0.0 | 0.437 | 0.563 |
| 4.492 | 73 | 00 | 68 | 98 | 0.0 | 0.406 | 0.594 |
| 4.531 | 74 | 00 | 60 | A0 | 0.0 | 0.375 | 0.625 |
| 4.570 | 75 | 00 | 58 | A8 | 0.0 | 0.344 | 0.656 |
| 4.609 | 76 | 00 | 50 | B0 | 0.0 | 0.312 | 0.688 |
| 4.648 | 77 | 00 | 48 | B8 | 0.0 | 0.281 | 0.710 |
| 4.687 | 78 | 00 | 40 | C0 | 0.0 | 0.25 | 0.75 |
| 4.727 | 79 | 00 | 38 | C8 | 0.0 | 0.219 | 0.781 |
| 4.766 | 7A | 00 | 30 | D0 | 0.0 | 0.187 | 0.813 |
| 4.805 | 7B | 00 | 28 | D8 | 0.0 | 0.156 | 0.844 |
| 4.844 | 7C | 00 | 20 | E0 | 0.0 | 0.125 | 0.875 |
| 4.883 | 7D | 00 | 18 | E8 | 0.0 | 0.094 | 0.906 |
| 4.922 | 7E | 00 | 10 | F0 | 0.0 | 0.062 | 0.938 |
| 4.961 | 7F | 00 | 08 | F8 | 0.0 | 0.031 | 0.967 |
| 5.000 | 80 | 00 | 00 | FF | 0.0 | 0.0 | 1.0 |
| 5.039 | 81 | 04 | 00 | FC | 0.016 | 0.0 | 0.984 |
| 5.078 | 82 | 08 | 00 | F8 | 0.031 | 0.0 | 0.969 |
| 5.117 | 83 | 0C | 00 | F4 | 0.047 | 0.0 | 0.953 |
| 5.156 | 84 | 10 | 00 | F0 | 0.063 | 0.0 | 0.937 |
| 5.195 | 85 | 14 | 00 | EC | 0.078 | 0.0 | 0.922 |
| 5.234 | 86 | 18 | 00 | E8 | 0.094 | 0.0 | 0.906 |
| 5.273 | 87 | 1C | 00 | E4 | 0.109 | 0.0 | 0.891 |
| 5.312 | 88 | 20 | 00 | E0 | 0.125 | 0.0 | 0.875 |
| 5.352 | 89 | 24 | 00 | DC | 0.141 | 0.0 | 0.859 |
| 5.391 | 8A | 28 | 00 | D8 | 0.156 | 0.0 | 0.844 |
| 5.430 | 8B | 2C | 00 | D4 | 0.172 | 0.0 | 0.828 |
| 5.469 | 8C | 30 | 00 | D0 | 0.188 | 0.0 | 0.812 |
| 5.508 | 8D | 34 | 00 | CC | 0.2 | 0.0 | 0.8 |
| 5.547 | 8E | 38 | 00 | C8 | 0.219 | 0.0 | 0.781 |
| 5.586 | 8F | 3C | 00 | C4 | 0.234 | 0.0 | 0.766 |
| 5.625 | 90 | 40 | 00 | C0 | 0.25 | 0.0 | 0.75 |
| 5.664 | 91 | 44 | 00 | BC | 0.266 | 0.0 | 0.734 |
| 5.703 | 92 | 48 | 00 | B8 | 0.281 | 0.0 | 0.719 |
| 5.742 | 93 | 4C | 00 | B4 | 0.297 | 0.0 | 0.703 |
| 5.781 | 94 | 50 | 00 | B0 | 0.313 | 0.0 | 0.687 |
| 5.820 | 95 | 54 | 00 | AC | 0.328 | 0.0 | 0.672 |
| 5.859 | 96 | 58 | 00 | A8 | 0.344 | 0.0 | 0.656 |
| 5.898 | 97 | 5C | 00 | A4 | 0.359 | 0.0 | 0.641 |
| 5.937 | 98 | 60 | 00 | A0 | 0.375 | 0.0 | 0.625 |
| 5.977 | 99 | 64 | 00 | 9C | 0.391 | 0.0 | 0.609 |
| 6.016 | 9A | 68 | 00 | 98 | 0.406 | 0.0 | 0.594 |
| 6.055 | 9B | 6C | 00 | 94 | 0.422 | 0.0 | 0.578 |
| 6.094 | 9C | 70 | 00 | 90 | 0.438 | 0.0 | 0.562 |
| 6.133 | 9D | 74 | 00 | 8C | 0.453 | 0.0 | 0.547 |
| 6.172 | 9E | 78 | 00 | 88 | 0.469 | 0.0 | 0.531 |
| 6.211 | 9F | 7C | 00 | 84 | 0.484 | 0.0 | 0.516 |
| 6.250 | A0 | 80 | 00 | 80 | 0.5 | 0.0 | 0.5 |
| 6.289 | A1 | 84 | 00 | 7C | 0.516 | 0.0 | 0.484 |
| 6.328 | A2 | 88 | 00 | 78 | 0.531 | 0.0 | 0.469 |
| 6.367 | A3 | 8C | 00 | 74 | 0.547 | 0.0 | 0.453 |
| 6.406 | A4 | 90 | 00 | 70 | 0.563 | 0.0 | 0.437 |
| 6.445 | A5 | 94 | 00 | 6C | 0.578 | 0.0 | 0.422 |
| 6.484 | A6 | 98 | 00 | 68 | 0.594 | 0.0 | 0.406 |
| 6.524 | A7 | 9C | 00 | 64 | 0.609 | 0.0 | 0.391 |
| 6.562 | A8 | A0 | 00 | 60 | 0.625 | 0.0 | 0.375 |
| 6.602 | A9 | A4 | 00 | 5C | 0.641 | 0.0 | 0.359 |
| 6.641 | AA | A8 | 00 | 58 | 0.656 | 0.0 | 0.344 |
| 6.680 | AB | AC | 00 | 54 | 0.672 | 0.0 | 0.328 |
| 6.719 | AC | B0 | 00 | 50 | 0.688 | 0.0 | 0.312 |
| 6.758 | AD | B4 | 00 | 4C | 0.703 | 0.0 | 0.297 |
| 6.797 | AE | B8 | 00 | 48 | 0.719 | 0.0 | 0.281 |
| 6.836 | AF | BC | 00 | 44 | 0.734 | 0.0 | 0.266 |

TABLE 2-continued

| Input Voltage (Volts) | PROM Address (Hex) | DATA PORTIONS 'Red' PROM (Hex) | 'Green' PROM (Hex) | 'Blue' PROM (Hex) | red | green | blue |
|---|---|---|---|---|---|---|---|
| 6.875 | B0 | C0 | 00 | 40 | 0.75 | 0.0 | 0.25 |
| 6.914 | B1 | C4 | 00 | 3C | 0.766 | 0.0 | 0.234 |
| 6.953 | B2 | C8 | 00 | 38 | 0.781 | 0.0 | 0.219 |
| 6.992 | B3 | CC | 00 | 34 | 0.797 | 0.0 | 0.203 |
| 7.031 | B4 | D0 | 00 | 30 | 0.813 | 0.0 | 0.187 |
| 7.070 | B5 | D4 | 00 | 2C | 0.828 | 0.0 | 0.172 |
| 7.109 | B6 | D8 | 00 | 28 | 0.844 | 0.0 | 0.156 |
| 7.148 | B7 | DC | 00 | 24 | 0.859 | 0.0 | 0.141 |
| 7.187 | B8 | E0 | 80 | 20 | 0.875 | 0.0 | 0.125 |
| 7.227 | B9 | E4 | 00 | 1C | 8.891 | 0.8 | 0.109 |
| 7.266 | BA | E8 | 00 | 18 | 0.906 | 0.0 | 0.094 |
| 7.305 | BB | EC | 00 | 14 | 0.922 | 0.0 | 0.078 |
| 7.344 | BC | F0 | 00 | 10 | 0.938 | 0.0 | 0.062 |
| 7.383 | BD | F4 | 00 | 0C | 0.953 | 0.0 | 0.047 |
| 7.422 | BE | F8 | 00 | 08 | 0.967 | 0.0 | 0.031 |
| 7.461 | BF | FC | 00 | 04 | 0.984 | 0.0 | 0.016 |

What I claim is:

1. A method for illuminating a variable color complementary display device which includes a plurality of display areas arranged in a pattern for exhibiting, upon selective activation, a plurality of display units, each said display area including a plurality of pairs of light emitting diodes for emitting, when forwardly biased, light signals of respective primary colors and means for combining said light signals in said display area to obtain a light signal of a composite color, each said pair including a first light emitting diode and a second light emitting diode of the same color connected in an anti-parallel fashion such that their polarities are opposite, the method comprising:

forwardly biasing said first light emitting diodes of a selective primary color in selective display areas, for illuminating them in a display color; and forwardly biasing said second light emitting diodes of the remaining primary colors in the remaining display areas, for illuminating them in a color contrasting to said display color.

2. A variable color complementary display device comprising:

a plurality of display areas arranged in a pattern for exhibiting, upon selective activation, a plurality of display units, each said display area including a plurality of pairs of light emitting diodes for emitting, when forwardly biased, light signals of respective primary colors and means for combining said light signals in said display area to obtain a light signal of a composite color, each said pair including a first light emitting diode and a second light emitting diode connected in an anti-parallel fashion such that their polarities are opposite;

means for forwardly biasing said first light emitting diodes of a selective primary color in selective display areas, for illuminating them in a display color; and means for forwardly biasing said second light emitting diodes of the remaining primary colors in the remaining display areas, for illuminating them in a color contrasting to said display color.

3. The variable color complementary display device of claim 2 wherein said contrasting color is substantially complementary to said display color.

4. A method for illuminating a variable color complementary display device which includes a plurality of display areas arranged in a pattern for exhibiting, upon selective activation, a plurality of display units, each said display area including a first pair of light emitting diodes for emitting, when forwardly biased, light signals of a first color, a second pair of light emitting diodes for emitting, when forwardly biased, light signals of a second color, a third pair of light emitting diodes for emitting, when forwardly biased, light signals of a third color, and means for combining said light signals in said display area to obtain a light signal of a composite color, each said pair including a first light emitting diode and a second light emitting diode connected in an anti-parallel fashion such that their polarities are opposite, the method comprising:

forwardly biasing said first light emitting diodes of a selective primary color in selective display areas, for illuminating them in a display color; and forwardly biasing said second light emitting diodes of the remaining primary colors in the remaining display areas, for illuminating them in a color substantially complementary to said display color.

5. A variable color complementary display device comprising:

a plurality of display areas arranged in a pattern for exhibiting, upon selective activation, a plurality of display units, each said display area including a first pair of light emitting diodes for emitting, when forwardly biased, light signals of a first color, a second pair of light emitting diodes for emitting, when forwardly biased, light signals of a second color, a third pair of light emitting diodes for emitting, when forwardly biased, light signals of a third color, and means for combining said light signals in said display area to obtain a light signal of a composite color, each said pair including a first light emitting diode and a second light emitting diode connected in an anti-parallel fashion such that their polarities are opposite;

means for forwardly biasing said first light emitting diodes of a selective primary color in selective display areas, for illuminating them in a display color; and means for forwardly biasing said second light emitting diodes of the remaining primary colors in the remaining display areas, for illuminating them in a color substantially complementary to said display color.

6. A method for illuminating a variable color complementary display device which includes a plurality of display areas arranged in a pattern for exhibiting, upon selective activation, a plurality of display units, each said display area including a plurality of pairs of light emitting diodes for emitting, when forwardly biased, light signals of respective primary colors and means for combining said light signals in said display area to obtain a light signal of a composite color, each said pair including a first light emitting diode and a second light emitting diode connected in an anti-parallel fashion such that their polarities are opposite, thereby defining a first terminal of the pair and a second terminal of the pair, a decoder including a decoder input, for receiving an input code defining a selected display unit, and a plurality of decoder outputs, said decoder outputs being coupled to said first terminals in accordance with the positions of said display areas in said pattern, said decoder outputs producing selective decoder output signals, for selecting said first light emitting diodes in certain of said display areas, corresponding by their positions in said pattern to the selected display unit, in response to a specific input code, and producing opposite output signals on the remaining decoder outputs, for selecting said second light emitting diodes in the remaining display areas, and a plurality of buses, same in number as the plurality of said primary colors and respectively associated therewith, to which said second terminals of all said pairs are commonly coupled in accordance with their colors, such that said first light emitting diodes in each said pair in each display area selected by said decoder outputs are forwardly biased when the respective bus is energized, the method comprising:

selectively energizing said buses for forwardly biasing certain ones of said first light emitting diodes, in accordance with said output signals, for illuminating in a selective display color the display areas corresponding by their positions to one of said display units; and forwardly biasing certain ones of said second light emitting diodes, in accordance with said opposite output signals, for illuminating the remaining display areas in a color contrasting to said display color.

7. A variable color complementary display device comprising:

a plurality of display areas arranged in a pattern for exhibiting, upon selective activation, a plurality of display units, each said display area including a plurality of pairs of light emitting diodes for emitting, when forwardly biased, light signals of respective primary colors and means for combining said light signals in said display area to obtain a light signal of a composite color, each said pair including a first light emitting diode and a second light emitting diode connected in an anti-parallel fashion such that their polarities are opposite, thereby defining a first terminal of the pair and a second terminal of the pair;

means for decoding including a decoder input, for receiving an input code defining a selected display unit, and a plurality of decoder outputs, said decoder outputs being coupled to said first terminals in accordance with the positions of said display areas in said pattern, said decoder outputs producing selective decoder output signals, for selecting said first light emitting diodes in certain of said display areas, corresponding by their positions in said pattern to the selected display unit, in response to a specific input code, and producing opposite output signals on the remaining decoder outputs, for selecting said second light emitting diodes in the remaining display areas;

a plurality of buses, same in number as the plurality of said primary colors and respectively associated therewith, to which said second terminals of all said pairs are commonly coupled in accordance with their colors, such that said first light emitting diodes in each said pair in each display area selected by said decoder outputs are forwardly biased when the respective bus is energized;

means for selectively energizing said buses for forwardly biasing certain ones of said first light emitting diodes, in accordance with said output signals, for illuminating in a selective display color the display areas corresponding by their positions to one of said display units; and means for forwardly biasing certain ones of said second light emitting diodes, in accordance with said opposite output signals, for illuminating the remaining display areas in a color contrasting to said display color.

8. The variable color complementary display device of claim 7 wherein said contrasting color is substantially complementary to said display color.

9. A variable color complementary display device comprising:

a plurality of display areas arranged in a pattern for exhibiting, upon selective activation, a plurality of display units, each said display area including a first pair of light emitting diodes for emitting, when forwardly biased, light signals of a first color, a second pair of light emitting diodes for emitting, when forwardly biased, light signals of a second color, a third pair of light emitting diodes for emitting, when forwardly biased, light signals of a third color, and means for combining said light signals in said display area to obtain a light signal of a composite. color, each said pair including a first light emitting diode and a second light emitting diode connected in an anti-parallel fashion such that their polarities are opposite, thereby defining a first terminal of the pair and a second terminal of the pair;

means for decoding including a decoder input, for receiving an input code defining a selected display unit, and a plurality of decoder outputs, said decoder outputs being coupled to said first terminals in accordance with the positions of said display areas in said pattern, said decoder outputs producing selective decoder output signals, for selecting said first light emitting diodes in certain of said display areas, corresponding by their positions in said pattern to the selected display unit, in response to a specific input code, and producing opposite output signals on the remaining decoder outputs, for selecting said second light emitting diodes in the remaining display areas;

a first bus to which said second terminals of all said pairs of said first primary color are commonly coupled such that said first light emitting diodes in each said pair of said first primary color in each display area selected by said decoder outputs are forwardly biased when said first bus is energized;

a second bus to which said second terminals of all said pairs of said second primary color are commonly coupled such that said first light emitting diodes in each said pair of said second primary color in each display area selected by said decoder outputs are forwardly biased when said second bus is energized;

a third bus to which said second terminals of all said pairs of said third primary color are commonly coupled such that said first light emitting diodes in each said pair of said third primary color in each display area selected by said decoder outputs are forwardly biased when said third bus is energized;

means for selectively energizing said buses for forwardly biasing certain ones of said first light emitting diodes, in accordance with said output signals, for illuminating in a selective display color the display areas corresponding by their positions to one of said display units; and means for forwardly biasing certain ones of said second light emitting diodes, in accordance with said opposite output signals, for illuminating the remaining display areas in a color substantially complementary to said display color.

10. A variable color complementary display device comprising:

a plurality of display areas arranged in a pattern for exhibiting, upon selective activation, a plurality of display units, each said display area including a plurality of pairs of light emitting diodes for emitting, when forwardly biased, light signals of respective primary colors and means for combining said light signals in said display area to obtain a light signal of a composite color, each said pair including a first light emitting diode and a second light emitting diode connected in an anti-parallel fashion such that their polarities are opposite, thereby defining a first terminal of the pair and a second terminal of the pair;

means for decoding including a decoder input, for receiving an input code defining a selected display unit, and a plurality of decoder outputs, said decoder outputs being coupled to said first terminals in accordance with the positions of said display areas in said pattern, said decoder outputs producing selective decoder output signals, for selecting said first light emitting diodes in certain of said display areas, corresponding by their positions in said pattern to the selected display unit, in response to a specific input code, and producing opposite output signals on the remaining decoder outputs, for selecting said second light emitting diodes in the remaining display areas;

a plurality of buses, same in number as the plurality of said primary colors and respectively associated therewith, to which said second terminals of all said pairs are commonly coupled in accordance with their colors, such that said first light emitting diodes in each said pair in each display area selected by said decoder outputs are forwardly biased when the respective bus is energized; and means for selectively energizing said buses for forwardly biasing certain ones of said first light emitting diodes, in accordance with said output signals, for illuminating in a selective display color the display areas corresponding by their positions to one of said display units, and for forwardly biasing certain ones of said second light emitting diodes, in accordance with said opposite output signals, for illuminating the remaining display areas in a color contrasting to said display color.

11. The variable color complementary display device of claim 10 wherein said contrasting color is substantially complementary to said display color.

12. A variable color complementary display device comprising:

a plurality of display areas arranged in a pattern for exhibiting, upon selective activation, a plurality of display units, each said display area including a first pair of light emitting diodes for emitting, when forwardly biased, light signals of a first color, a second pair of light emitting diodes for emitting, when forwardly biased, light signals of a second color, a third pair of light emitting diodes for emitting, when forwardly biased, light signals of a third color, and means for combining said light signals in said display area to obtain a light signal of a composite color, each said pair including a first light emitting diode and a second light emitting diode connected in an anti-parallel fashion such that their polarities are opposite, thereby defining a first terminal of the pair and a second terminal of the pair;

means for decoding including a decoder input, for receiving an input code defining a selected display unit, and a plurality of decoder outputs, said decoder outputs being coupled to said first terminals in accordance with the positions of said display areas in said pattern, said decoder outputs producing selective decoder output signals, for selecting said first light emitting diodes in certain of said display areas, corresponding by their positions in said pattern to the selected display unit, in response to a specific input code, and producing opposite output signals on the remaining decoder outputs, for selecting said second light emitting diodes in the remaining display areas;

a first bus to which said second terminals of all said pairs of said first primary color are commonly coupled such that said first light emitting diodes in each said pair of said first primary color in each display area selected by said decoder outputs are forwardly biased when said first bus is energized;

a second bus to which said second terminals of all said pairs of said second primary color are commonly coupled such that said first light emitting diodes in each said pair of said second primary color in each display area selected by said decoder outputs are forwardly biased when said second bus is energized;

a third bus to which said second terminals of all said pairs of said third primary color are commonly coupled such that said first light emitting diodes in each said pair of said third primary color in each display area selected by said decoder outputs are forwardly biased when said third bus is energized; and means for selectively energizing said buses for forwardly biasing certain ones of said first light emitting diodes, in accordance with said output signals, for illuminating in a selective display color the display areas corresponding by their positions to one of said display units, and for forwardly biasing certain ones of said second light emitting diodes, in accordance with said opposite output signals, for illuminating the remaining display areas in a color substantially complementary to said display color.

* * * * *